US009577389B2

(12) United States Patent
Dicks et al.

(10) Patent No.: US 9,577,389 B2
(45) Date of Patent: Feb. 21, 2017

(54) SYSTEMS AND METHODS FOR MODULAR SHOCK PROOF ELECTRICAL OUTLETS

(71) Applicant: International Safety Holdings, LLC, El Cajon, CA (US)

(72) Inventors: Michael Drew Dicks, Phoenix, AZ (US); Roger Dean Innes, Poway, CA (US); Paul Robert Edstrom, Poway, CA (US); Rafael Calderon, San Diego, CA (US); Alberto Herrera Rojas, Tijuana (MX)

(73) Assignee: International Safety Holdings, LLC, El Cajon, CA (US)

( * ) Notice: Subject to any disclaimer, the term of this patent is extended or adjusted under 35 U.S.C. 154(b) by 28 days.

(21) Appl. No.: 14/641,222

(22) Filed: Mar. 6, 2015

(65) Prior Publication Data

US 2015/0255932 A1 Sep. 10, 2015

Related U.S. Application Data

(60) Provisional application No. 61/949,904, filed on Mar. 7, 2014, provisional application No. 62/083,130, filed (Continued)

(51) Int. Cl.
*H01R 13/66* (2006.01)

(52) U.S. Cl.
CPC ..... *H01R 13/6683* (2013.01); *H01R 13/6666* (2013.01)

(58) Field of Classification Search
CPC ..... H01R 13/66–13/7197
See application file for complete search history.

(56) References Cited

U.S. PATENT DOCUMENTS 2,789,255 A 4/1957 Mekler
2,810,894 A 10/1957 Kerr (Continued)

FOREIGN PATENT DOCUMENTS

DE 38 44 176 A1 7/1990
EP 0 348 128 12/1989

(Continued)

OTHER PUBLICATIONS

International Search Report and Written Opinion mailed Jun. 18, 2015 for International Application No. PCT/US15/19270 filed Mar. 6, 2015, 16 pages.

(Continued)

*Primary Examiner* — Rexford Barnie
*Assistant Examiner* — David Shiao
(74) *Attorney, Agent, or Firm* — Knobbe, Martens, Olson & Bear LLP

(57) ABSTRACT

Systems and methods for providing electrical power from an electrical outlet. In some embodiments, an electrical outlet for providing high voltage power to a device includes power input terminals for connection to a high voltage power source, and at least one power output socket configured to receive a plug configured to receive high voltage power. The outlet may also include a shock-proof circuit connected to the at least one power output socket, a communication circuit configured, and a processor coupled to the communication circuit and the shock-proof circuit, the processor and the shock-proof circuit collectively configured to determine when to provide high voltage power to the at least one power output socket based on a sensed condition, and the processor and the communication circuit collectively configured to communicate information relating to an operation aspect of the electrical outlet with a remote computing device.

20 Claims, 63 Drawing Sheets

Related U.S. Application Data on Nov. 21, 2014, provisional application No. 62/109,527, filed on Jan. 29, 2015.

(56) References Cited

U.S. PATENT DOCUMENTS 2,937,322 A 5/1960 Nixon
3,115,874 A 12/1963 Roberts
3,158,791 A 11/1964 Deneen, Jr. et al.
3,184,651 A 5/1965 Albosta
3,280,375 A 10/1966 Jensen
3,308,365 A 3/1967 St. John
3,313,995 A 4/1967 Bach et al.
3,413,487 A 11/1968 Gershen
3,524,133 A 8/1970 Arndt
3,525,903 A 8/1970 Morris et al.
3,566,189 A 2/1971 Wilson et al.
3,621,334 A 11/1971 Burns et al.
3,624,338 A 11/1971 Ellis et al.
3,626,201 A 12/1971 Chambers et al.
3,648,059 A 3/1972 Beaudry et al.
3,654,515 A 4/1972 Kato et al.
3,676,738 A 7/1972 Scanlan
3,727,106 A 4/1973 Mendel et al.
3,729,696 A 4/1973 Pope
3,809,961 A 5/1974 Kershaw
3,866,197 A 2/1975 Schweitzer, Jr.
3,870,928 A 3/1975 Allen
3,886,434 A 5/1975 Schreiner
3,974,446 A 8/1976 Schweitzer, Jr.
3,991,366 A 11/1976 Schweitzer, Jr.
4,028,594 A 6/1977 Schossow
4,034,360 A 7/1977 Schweitzer, Jr.
4,042,967 A 8/1977 Yamamoto
4,064,546 A 12/1977 Domanski
4,077,056 A 2/1978 Galiana
4,184,186 A 1/1980 Barkan
4,204,243 A 5/1980 Ross
4,255,773 A 3/1981 Jabbal
4,319,144 A 3/1982 King et al.
4,360,740 A 11/1982 Conard
4,360,847 A 11/1982 Bloomer et al.
4,393,432 A 7/1983 Neuhaus et al.
4,410,925 A 10/1983 Tucker et al.
4,414,543 A 11/1983 Schweitzer et al.
4,447,844 A 5/1984 Schossow et al.
4,463,402 A 7/1984 Cottrell
4,471,400 A 9/1984 Reza
4,520,419 A 5/1985 Locher et al.
4,706,153 A 11/1987 Sainomoto et al.
4,769,586 A 9/1988 Kaxmierowicz
4,841,407 A 6/1989 Baba et al.
4,843,514 A 6/1989 Bodkin
4,853,821 A 8/1989 Lewis
4,888,660 A 12/1989 Bartelink
4,947,278 A * 8/1990 Nichols, III ..... H01H 47/002 30/45
4,948,044 A 8/1990 Cacciatore
5,003,486 A 3/1991 Hendel et al.
5,019,935 A 5/1991 Nakamura
5,029,037 A 7/1991 Bartelink
5,069,632 A 12/1991 Avitan
5,151,841 A 9/1992 Knights
5,182,466 A 1/1993 Ohkubo
5,194,758 A 3/1993 Ver Meer
5,267,116 A 11/1993 Avitan
5,347,095 A 9/1994 Zeder
5,426,552 A 6/1995 Avitan
5,485,339 A 1/1996 Dufresne
5,485,340 A 1/1996 Avitan
5,508,603 A 4/1996 Strong, III
5,519,559 A 5/1996 Dides et al.
5,541,800 A 7/1996 Misencik
5,565,714 A 10/1996 Cunningham
5,737,161 A 4/1998 Thomas
5,892,644 A 4/1999 Evans et al.
5,920,452 A 7/1999 Sullivan
5,923,514 A 7/1999 Scott et al.
5,946,180 A 8/1999 Simpson
5,988,516 A 11/1999 Gilmour
6,032,867 A 3/2000 Dushane et al.
6,040,969 A 3/2000 Winch et al.
6,049,143 A 4/2000 Simpson et al.
6,094,330 A 7/2000 Criniti et al.
6,100,607 A 8/2000 Olivieri et al.
6,118,639 A 9/2000 Goldstein
6,262,492 B1 7/2001 Sheng
6,307,482 B1 10/2001 Le Bel
6,501,196 B1 12/2002 Lo
6,548,916 B1 4/2003 Kanazawa et al.
6,552,888 B2 4/2003 Weinberger
6,653,751 B1 11/2003 Teh Lo
6,657,839 B2 12/2003 de Oliveira
6,710,587 B1 3/2004 Reynoso et al.
6,717,781 B2 4/2004 Xu et al.
6,731,024 B1 5/2004 Molnar et al.
6,738,238 B2 5/2004 Lontka et al.
6,749,456 B1 6/2004 Conner et al.
6,768,224 B2 7/2004 Shen et al.
6,829,124 B2 12/2004 Leopold et al.
6,891,454 B1 5/2005 Naito et al.
6,920,025 B2 7/2005 Nelson
6,957,910 B1 10/2005 Wan et al.
7,009,859 B2 3/2006 Chen et al.
RE39,446 E 12/2006 Winch et al.
7,190,246 B2 3/2007 Angle et al.
7,224,086 B2 5/2007 Germagian et al.
7,233,220 B2 6/2007 Batteux
7,400,476 B1 7/2008 Hull, Jr.
7,505,237 B2 * 3/2009 Baxter ..... H02H 11/005 361/42
7,575,467 B2 8/2009 Ferguson et al.
7,869,173 B2 1/2011 Kempler
7,928,609 B2 4/2011 Cruz
8,138,626 B2 * 3/2012 Jonsson ..... G01D 4/002 307/38
8,139,328 B2 3/2012 DiSalvo et al.
8,376,782 B2 2/2013 Govekar
8,957,551 B1 * 2/2015 Alberth, Jr. ..... G05B 15/02 307/116
2001/0007800 A1 7/2001 Skarie et al.
2002/0097546 A1 7/2002 Weinberger
2002/0154461 A1 10/2002 Chapman et al.
2003/0007302 A1 1/2003 Gerfast
2005/0128043 A1 6/2005 Ying
2005/0131552 A1 6/2005 Yuan
2006/0232366 A1 10/2006 Li
2006/0268472 A1 11/2006 Winch
2008/0025058 A1 1/2008 Gerber
2008/0049367 A1 2/2008 Carson et al.
2008/0094769 A1 4/2008 Cruz
2008/0122296 A1 5/2008 Cruz
2009/0225480 A1 9/2009 Baxter
2009/0243847 A1 10/2009 Chen
2009/0315409 A1 * 12/2009 Wheeler ..... H01R 13/665 307/126
2010/0130142 A1 * 5/2010 Schubert ..... H01R 13/66 455/90.3
2011/0316355 A1 12/2011 Gruber et al.
2012/0214412 A1 8/2012 Schlub et al.
2013/0154808 A1 * 6/2013 Han ..... H01R 13/465 340/10.5
2013/0162517 A1 * 6/2013 Gay ..... G06F 3/046 345/156
2014/0177737 A1 * 6/2014 Vasquez ..... H02H 5/04 375/257
2015/0249337 A1 * 9/2015 Raneri ..... H02J 3/005 307/24
2016/0126950 A1 * 5/2016 Lucantonio ..... H03K 17/955 307/113

(56) References Cited

U.S. PATENT DOCUMENTS

FOREIGN PATENT DOCUMENTS

| | | | |
|---|---|---|---|
| EP | 0 384 881 | | 8/1990 |
| EP | 0 683 927 | | 11/1995 |
| JP | 2006-296111 | | 10/2006 |
| WO | WO 93/09634 | | 5/1993 |
| WO | WO 94/17573 | | 8/1994 |
| WO | WO 2008/082636 | | 7/2008 |
| WO | WO 2010/041085 | A1 | 4/2010 |
| WO | WO 2014/169324 | A1 | 10/2014 |

OTHER PUBLICATIONS

Goodwin, May 16, 2011, Michelin smart jumper cables for easier jumpstarte, CNET Reviews, Goodwin, May 16, 2011, Michelin smart jumper cables for easier jumpstarte, CNET Reviews, http://www.cnet.com/news/michelin-smart-jumper-cables-for-easier-jump-starts/#!, 4 pp.

Written Opinion of the Examining Authority issued Jun. 10, 2016 in PCT/US2015/19270.

* cited by examiner

SYSTEMS AND METHODS FOR MODULAR SHOCK PROOF ELECTRICAL OUTLETS

RELATED APPLICATIONS

The present application claims the benefit of U.S. Provisional Application No. 61/949,904, entitled "SYSTEMS AND METHODS FOR MODULAR SHOCK PROOF ELECTRICAL OUTLETS," filed Mar. 7, 2014, U.S. Provisional Application No. 62/083,130, entitled "SYSTEMS AND METHODS FOR MODULAR SHOCK PROOF ELECTRICAL OUTLETS," filed Nov. 21, 2014, and U.S. Provisional Application No. 62/109,527, entitled "SYSTEMS AND METHODS FOR MODULAR SHOCK PROOF ELECTRICAL OUTLETS," filed Jan. 29, 2015, each of these applications being expressly incorporated herein by reference in its entirety.

FIELD

This invention relates generally to electrical outlets having sensor, communication and/or safety features.

BACKGROUND

Electrical outlets in walls and floors present serious hazards to the public. The electrical receptacles can also be the cause of fires and other damage to property. Hospitals have treated many injuries associated with electrical outlets. A number of these injuries can occur when young children insert metal objects, for example, hair pins and keys, into the electrical outlet, resulting in electric shock or burn injuries to the hands or fingers, and death. According to the Electrical Safety Foundation International (ESFi), every month nearly 200 children are treated in hospital emergency rooms for electrical shock or burn injuries caused by tampering with a wall outlet. It is also reported that 70 percent of child-related electrical accidents occur at home. Since the modern high voltage AC outlet came into use more than 60 years ago, outlets have been boxed into a basic utilitarian form factor and functionality. Thus, there is a need to develop effective shock proof electrical outlets. In addition, there is a need for improving electrical outlets to address the technological advances people desire in their home and workplace.

SUMMARY

The systems, methods, devices, and computer program products discussed herein each have several aspects, no single one of which is solely responsible for its desirable attributes. Without limiting the scope of this invention as expressed by the claims which follow, some features are discussed briefly below.

One innovation includes an electrical outlet for providing high voltage power to a device. In addition to providing high voltage AC power (for example, 120 VAC) the electrical outlet includes various additional functionality, and is sometimes referred to herein as the "smart outlet" or simply the "outlet" for ease of description. Various aspects of the smart outlet are disclosed in various embodiments. As a person of ordinary skill in the art will appreciate, aspects disclosed in one embodiment may also be included in other embodiments unless otherwise stated, or impractical. In addition, embodiments of a smart outlet are not limited to the examples of embodiments disclosed herein, instead, other embodiments are also contemplated having more or additional aspects, or aspects combined in different ways, than what may be disclosed herein. In some embodiments, the outlet includes power input terminals for connection to a high voltage power source, at least one power output socket configured to receive a plug configured to receive high voltage power, a shock-proof circuit connected to the at least one power output socket, and a communication circuit configured to connect to and communicate via a communication network. The outlet may further include a processor coupled to the communication circuit and the shock-proof circuit, the processor and the shock-proof circuit collectively configured to determine when to provide high voltage power to the at least one power output socket based on a sensed condition, and the processor and the communication circuit collectively configured to communicate information relating to an operation aspect of the electrical outlet with a remote computing device via the communication network.

In some embodiments, the outlet may further include at least one sensor in communication with the processor, the processor being further configured to receive information from the at least one sensor, and the communication circuit being further configured to receive sensor information from the processor and send the sensor information to a remote computing device. The outlet may further include at least one sensor in communication with the processor, wherein the processor is further configured to receive information from the at least one sensor and control the shock-proof circuit to provide power to the at least one power output terminal based on the sensor information. In some embodiments, the at least one sensor includes a capacitance sensor configured to detect proximity of a person near the electrical outlet and provide proximity information to the processor, and the processor is configured to control the shock-proof circuit to not provide high voltage power to the at least one power output socket when the proximity information the processor receives from the capacitance sensor indicates a person is within a proximity distance threshold. In some embodiments, the proximity distance threshold is met when a person (or a portion of a person, for example, a hand, arm or finger) is positioned within one inch of the electrical outlet. In other words, the proximity distance threshold includes an area that is less than on inch form the outlet. In some embodiments, the proximity distance threshold is met when a person (or a portion of a person) is within six (6) inches of the outlet. In other embodiments, a proximity distance threshold may be determined to control stopping the power provided to a power providing socket of the outlet when a person is within a distance, for example, in the range of 0-20 inches of the smart outlet. In some embodiments, the distance greater than twenty (20) inches. Information indicating the proximity (distance) that power (for example high voltage AC power) is no longer provided to a socket of the outlet may be input to the outlet using an interface at the outlet or the information may be communicated to the outlet via a communication network, and then, for example, the outlet is programmed to operate using the provided distance information. In some embodiments, the capacitance sensor includes at least one antenna disposed around a portion of the electrical outlet, the at least one antenna configured to transmit a field and receive information that results from a disturbance in the field. In some embodiments the antenna is disposed around a perimeter of a portion of the outlet, for example, a portion of the outlet that extends out of a wall when at least a substantial part of the outlet is disposed inside the wall. In some embodiments, the capacitance circuit includes two or more antennas. In some embodiments, the capacitance circuit includes two or more antennas, one antenna for transmitting a field and one antenna for monitoring the transmitted field and receiving signals from the field, the signals being indicative of a disturbance in the field, which can indicate the presence of a person.

In some embodiments, the smart outlet includes at least one sensor coupled to a power output terminal of the at least one power output socket. The at least one sensor may be configured to detect a low voltage current flow through the power output terminal, the shock-proof circuit and the processor collectively configured to provide high voltage power to the at least one power output socket when the current sensor current indicates (by the low voltage current flow) that a load having a certain impedance (for example, the impedance of an electrical device) is coupled to the at least one power output terminal. In some embodiments, the at least one sensor is an optical sensor configured to detect the insertion of at least one prong of a plug into a prong receptacle (or socket) of the power output socket. For example, the optical sensor may detect a (male) prong of a plug being inserted into a neutral line (female) socket and/or a hot line (female) socket of at least one power output socket. In some embodiments, the at least one power output socket includes a first power output socket and a second power output socket, and at least one sensor includes a first optical sensor and a second optical sensor, the first optical sensor being configured to detect the insertion of plug prongs into a neutral line socket and a hot line socket of the first power output socket, and the second optical sensor configured to detect the insertion of plug prongs into a neutral line socket and a hot line socket of the second power output socket. Such embodiments can be scaled up for electrical outlets that have more than two sockets. For example, for a wall outlet that has four sockets each capable of receiving a plug. Also, for example, for a power strip embodiment that includes at least two smart outlets arranged in a row (for example, six outlets) to provide power to multiple plugs at one time. In some embodiments of such configurations, the outlets maybe configured to connect in a modular manner (for example, as shown in FIG. 5A), that is, having one or more electrical and/or electronic connections to connect each additional outlet to high power AC voltage and/or electronic functionality, for example, wireless control of each outlet, shock-proof functionality of each outlet and other aspects disclosed herein. In some embodiments, each or the connected outlets may have shock-proof functionality and additional functionality (for example, wireless communication and control technology) built-in. In other embodiments, at least some the shock-proof and additional functionality is incorporated in one of the connected modular outlets and is used by at least one of the other connected outlets.

In some embodiments, the electrical outlet may further include a housing around at least a portion of the at least one power output socket, the shock-proof circuit, the communication circuit and the processor. In some embodiments, the housing can be configured to fit into a wall such that a portion of the housing is disposed inside the wall and a portion of the housing extends outside of the wall, and the housing is further configured to have a flat surface disposed towards the portion of the housing that is configured to be disposed inside the wall such that the flat surface substantially contacts a planar surface of the wall when the housing is disposed inside the wall. Embodiments of the smart outlet may further comprise at least one sensor. The at least one sensor can be configured to be in communication with the processor, and the processor is configured to receive information from the at least one sensor. In various embodiments, communication circuit, and/or the processor and the communication circuit collectively, are further configured to receive sensor information and send the sensor information to a remote computing device. In some embodiments, the at least one sensor is disposed inside of a housing of the smart outlet. In other embodiments, the at least one sensor is disposed at least in part outside of a housing or the smart outlet and is connected to the smart outlet either with a wired connection or via a wireless connection. For example, the at least one sensor can be physically attached to a housing of the smart outlet, or be located a distance away from the smart outlet to be able to communicate with the smart outlet via wireless technology/protocol (for example, Bluetooth). Thus, in some embodiments the at least one sensor is in wireless communication with the communication circuit. In some embodiments, the communication circuit may be configured to wirelessly connect to a communication network and send information from the sensor to a computing device via the network. In some embodiments, the communication circuit and the processor of the outlet are collectively configured to communicate, via a communication network, with another smart outlet coupled to the communication network. In some embodiments, there may be a first smart outlet that is configured to connect to a medium range wireless network (for example, a LAN or a WAN that is within a house or a commercial building) and also there may be one or more second smart outlets that connect to the first smart outlet using a shorter, or another, wireless or wired technology so that the first smart outlet facilitates communication with a network for the one or more second smart outlets.

Another innovation is a method that includes sensing that a person is within a threshold distance to the electrical outlet using a capacitance sensor, and stopping providing high voltage power to the power output socket while the person is within the threshold distance to the electrical outlet. The method can further include further sensing the proximity of the person to the electrical outlet, and providing high voltage power to the power output socket when the person is no longer within the threshold distance to the electrical outlet.

In some embodiments, the electrical outlet includes the capacitance sensor. In some embodiments, the capacitance sensor comprises an antenna disposed around at least a portion of the electrical outlet.

Another innovation includes an apparatus for providing high voltage power to a device, the apparatus including power input terminals for connection to a high voltage power source, a power output socket configured to receive a plug configured to receive high voltage power, a shock-proof circuit connected to the at least one power output socket, the shock-proof circuit comprising a capacitance sensor including an antenna disposed around a portion of the apparatus, and a processor coupled to the shock-proof circuit, the processor configured to sense that a person is within a threshold distance to the electrical outlet using a capacitance sensor, and stop providing high voltage power to the power output socket while the person is within the threshold distance to the electrical outlet.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Throughout the drawings, similar symbols typically identify similar components, unless context dictates otherwise. Note that the relative dimensions of the following figures may not be drawn to scale.

FIGS. 3H-1 and 3H-2 are a schematic illustrating an example of an embodiment of a smart outlet (for example, of FIG. 3G) that includes ground fault interrupt circuitry and the wireless communications module in accordance with an exemplary embodiment.

FIGS. 3J-1 and 3J-2 are a schematic illustrating an example of an embodiment of the smart outlet block diagram of FIG. 3I.

FIGS. 3L-1 and 3L-2 are a schematic illustrating an example of an embodiment of the smart outlet of FIG. 3K.

FIGS. 3N-1 and 3N-2 are a schematic illustrating an example of an embodiment of the block diagram of FIG. 3M.

FIGS. 4B-1 and 4B-2 are a block diagram illustrating an example of an embodiment of the smart outlet of FIG. 4A.

FIGS. 4C-1, 4C-2 and 4C-3 are a schematic illustrating an example of an embodiment of the block diagram of FIGS. 4B-1 and 4B-2.

FIGS. 5C-1 and 5C-2 are a schematic illustrating another example of an embodiment of a smart outlet.

DESCRIPTION OF CERTAIN INVENTIVE ASPECTS

Figure 1A:
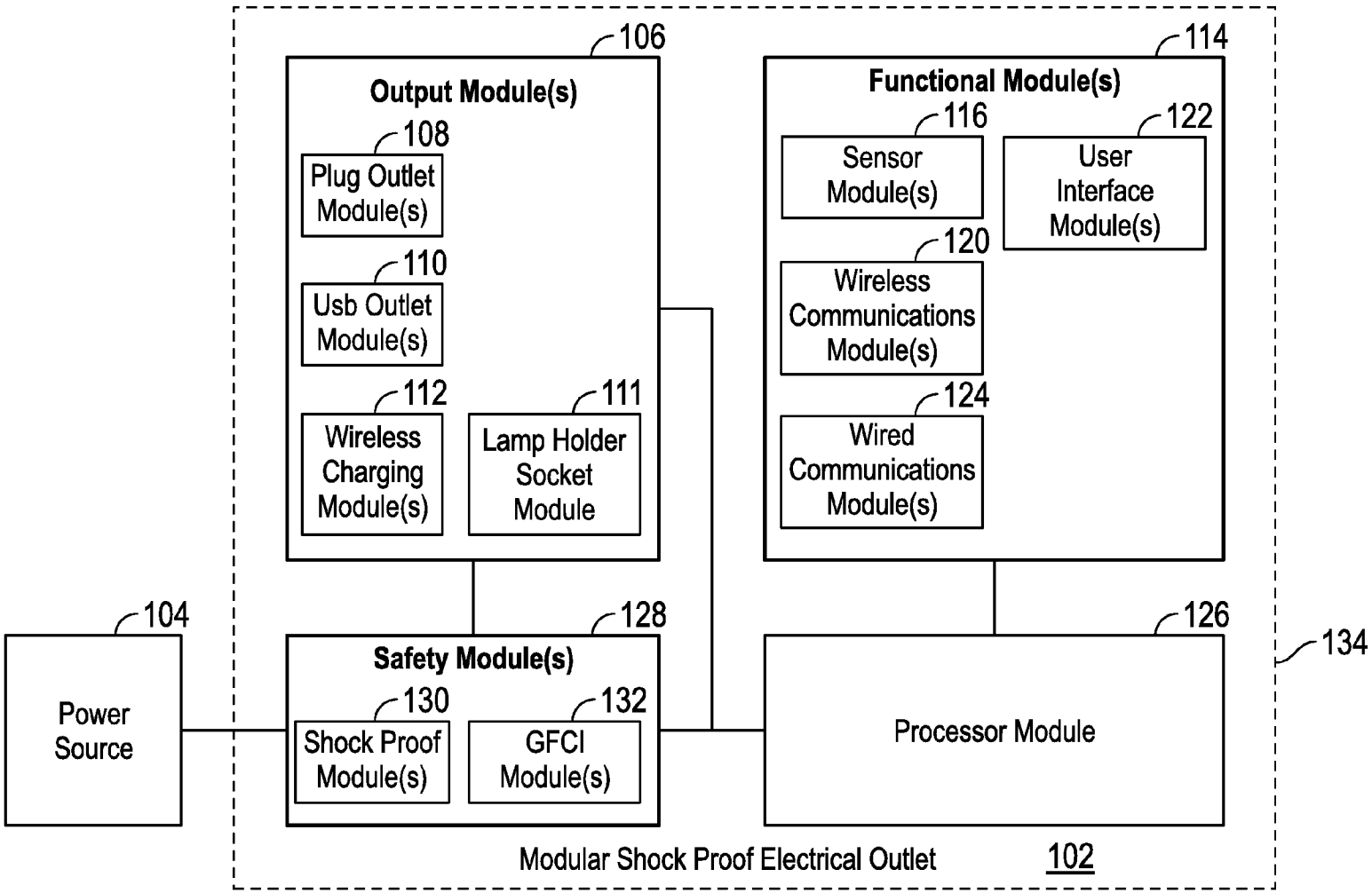
FIG. 1A is a block diagram illustrating an example of an embodiment of a smart outlet (some embodiments of which may be referred to herein as a "modular shock proof electrical outlet") connected to a power source.

The detailed description set forth below in connection with the appended drawings is intended as a description of certain implementations of the invention and is not intended to represent the only implementations in which the invention may be practiced. The term "exemplary" used throughout this description means "serving as an example, instance, or illustration," and should not necessarily be construed as preferred or advantageous over other exemplary implementations. The detailed description includes specific details for the purpose of providing a thorough understanding of the disclosed implementations. In some instances, some devices are shown in block diagram form.

Systems and methods are illustrated and described in accordance with a some embodiments of an electrical outlet, which may be referred to herein as a "smart outlet" for ease of description. Embodiments of a smart outlet may include structural modularity, for example, physically and/or electrically connecting various modules, each which may include different functionality or the same functionality. Embodiments of a smart outlet may also include component modularity, for example, including circuits or modules having various functionality, incorporated into a smart outlet. This may be, for example, in a housing surrounding a smart outlet, or connected to or in communication with a smart outlet via a wired or wireless connection. The smart outlet may include features to reduce or eliminate the risk of an electrical shock, and such electrical outlets may be referred to herein as being "shock-proof." As referred to herein a "modular shock proof electrical outlet" is an electrical outlet configured to be integrated with a number of modules that can address safety, power output or other functionalities at an electrical outlet.

As referred to herein, a module is a circuit that performs a particular purpose for the smart outlet. These modules may include, for example, safety modules, processor modules, outlet modules, communication modules and functional modules. Safety modules may control the flow of power to the outlet module. Outlet modules may provide an interface for an external device to receive power from a smart outlet. Functional modules can be sources of data input and output for a processor module to use in controlling functionality of a smart outlet. These modules may be implemented as part of an electrical circuit being controlled, for example, by a one processor module at a smart outlet. Such modules may be arranged in various combinations to provide specific functionalities for different applications, as will be discussed further herein. Smart outlets may include software, hardware or a combination of software and hardware to perform functionality incorporated into the smart outlet. In certain embodiments, combinations of various modules may be made using various connectors or communications (either wireless or wired). The modules may provide built in functionalities related to sensing and control for particular safety solutions not available in traditional electrical outlets. These modules may be located internal to a housing surrounding a smart outlet or on/along a housing of a smart outlet. These modules may also be part of a network of smart outlets that communicate across a wired or wireless network, for example, the Internet, a Wide Area Network (WAN), or a Local Area Network (LAN), with each other and with other devices, including remote functional modules (functional modules that are wirelessly connected with the smart outlet), computing devices and appliances.

In some embodiments, smart outlet may be directly connected with a power source (e.g., a power grid) and can be configured to replace a typical outlet that, that may be used in a residential or commercial building. For example, the smart outlet may be connected to wires that provide high voltage AC power using screws, push-in connectors or other suitable high voltage electrical connectors (for example, as used for typical wall outlets). In some embodiments, a housing that can be located partially or entirely in (or on) a structure (e.g., a wall floor, ceiling, or furniture) may be directly connected to wires of a power source, and the housing and the smart outlet may be configured such that the smart outlet can be inserted into the housing (for example, as illustrated in FIGS. 12A-12D). When inserted into the housing that's in a wall, the smart outlet 102 may be configured to be flush with the wall or extend from the wall. In some embodiments where the smart outlet includes a wireless power transmitter, a wireless transceiver and/or a capacitance sensor, the smart outlet may include an antenna that is disposed around a perimeter of the smart outlet, or a portion of the perimeter of the smart outlet. In such configurations, the antenna may be included in a portion of the smart outlet that extends from the wall to provide better wireless transmission or reception. Some example implementations are illustrated the figures that follow. The smart outlet may be configured to replace electrical outlets that are currently installed, in for example, residences or commercial buildings.

FIG. 1A is a block diagram illustrating an example of an embodiment of a smart outlet 102. In some embodiments, a smart outlet may have fewer, more and/or different features than smart outlet 102. The smart outlet is shown as connected to a power source 104. The smart outlet 102 includes output modules 106, functional modules 114, safety modules 128, and a processor module 126. The functional modules 114 are in communication with the processor module 126, and may be disposed within a housing 134 (as shown) or outside the housing. The functional modules 114 may be connected with and controlled by the processor module 126 by wired or wireless means. Although not illustrated, the output modules 106 and/or functional modules 114 may be formed along a surface of the housing 134. In various embodiments, the safety modules 128 are connected with the power source 104 and the output modules 106. The processor module 126 may be connected to and control some or all of the functionality of the various modules of the smart outlet 102.

The power source 104 may be, for example, 110/120 VAC or 220/240 VAC as is commonly found in many homes and businesses. Some embodiments may be configured to higher voltage power sources, for example, 440 VAC. The smart outlet 102 can include at least one safety module 128 configured to allow a high voltage power (current) to flow from the power source 104 to at least one output module 106. The safety module 128 may be controlled to allow the high voltage power to be provided by the output module 106 when certain conditions are met indicative of the presence of a proper electrical load (for example, not a human).

The safety module 102 may be controlled by the processor module 126. The control of the safety module 102 may be based on information provided by at least one sensor module 116 (for example, a current sensor). In the embodiment illustrated in FIG. 1A, the safety module 128 includes a shock proof module 130 configured to connect power (for example, high voltage or low voltage) to at least one output module 106 under certain conditions. For example, a shock proof module 130 collectively with one or more other modules of the smart outlet 102 may be configured to first provide a low voltage (for example, 24 VDC) current to a set of power output sockets that are configured to receive an electrical plug and monitor current that flows from one of the output sockets indicating completion of an electrical connection between the pair of output sockets. When the monitored current is above a certain threshold value (indicating the impedance of the load is a certain value indicative of an electrical device rather than a human), the shock proof module 130 provides high voltage (for example, 120 VAC) to the at least one output module 106 and to the connected device. If the load is indicative of a human, high voltage power will not be connected to the electrical outlet. If the load is indicative of a load of an appliance (for example, anything other than a human) high voltage power can be connected to the plug outlet module 108.

Accordingly, in some embodiments, the current threshold value can be set such that current above the current threshold is indicative of a dangerous condition (dangerous to a device or a machine) and current at or below the current threshold value is indicative of a safe condition (for a device or a machine). In some embodiments, a current threshold value can be set such that current above the current threshold is indicative of a proper load being plugged into the plug outlet module 108, thus indicating the presence of device to be powered, and current at or below the current threshold is indicative of a human or animal in contact with pair of sockets of the plug outlet module 108. In some embodiments the safety module 128 can include a Ground Fault Circuit Interrupter (GFCI) module 132 configured to monitor current flowing from the power source 104 and determine when the current goes to ground (a ground fault), indicating a hazardous electrical safety condition may exists. When a ground fault is detected the GFCI module 132 can stop the flow of current from the power source to the output module 106. The smart outlet 102 may include similar safety and shock-proof features for the USB outlet module 110, which may have different current threshold values, for example, to prevent damage to a USB device plugged into the USB outlet module 110.

The smart outlet illustrated in FIG. 1A can also include at least one output module 106. The output module 106 may be connected with the safety module 128 such that the safety module controls when power is provided to the output module 106. The output module 106 can include various types of interfaces that provide power and may allow a connected device to communicate with the smart outlet 102. For example, the output module 106 can include at least one of a plug outlet module 108, a Universal Serial Bus (USB) output module 110, a lampholder socket module 111, or a wireless charging output module 112. In some embodiments, the output module 106 includes two or more different types of output modules, for example, the USB outlet module 110 and the plug outlet module 108. The plug outlet module 108 can be any type of plug or socket specifically designed for power transfer. In particular, a plug outlet module 108 can include one or more sockets to receive a plug, the sockets including a neutral socket connected to a neutral wire, a protective earth socket connected to a protective earth wire (ground), and a line socket connected to a "hot" line wire as is found on a typical wall socket. Each of the sockets may be configured to receive a prong of an external device. A USB output module 110 can allow connection to a USB device and is configured to transfer power to an external device and/or communicate information a connected USB device. A wireless charging module 112 can be, for example, a wireless transmitter configured to provide wireless power to a wireless power receiver, for example by inductive wireless power transfer. In various embodiments, each of the output modules 106 may also include conversion circuitry to convert power provided from the power source 104 connected to the smart outlet 102 to a particular power level suitable for a connected device.

Still referring to FIG. 1A, the smart illustrated smart outlet 102 also include a processor module 126 connected to the safety module 128, the output module 106, and functional modules 114 that are included in the smart outlet 102. The processor module 126 can be configured to control (at least in part) the operation of the smart outlet 102, as further described throughout this disclosure. For example, the processor module 126 can be configured to control the safety module 128 to determine when to provide power to a device connected to an output module 106. The processor module 126 can also be configured to operate with and/or control one or more of the functional modules 114 for sensing or a wireless communication module 124 for communications with a remote computing device. The processor module 126 includes a processor and memory to perform processing based upon information generated by the a module of the smart outlet 102 (for example, a wireless communication module 122 or information the smart outlet 102 receives from another device. including for example a computing device connected with the processor module 126 over a network (see FIG. 1B). The processor module 126 may also include data connections to couple the processor module 126 to a variety of other electrical and electronic components that may be used in the smart outlet 126, for example, one or more of relays, sensors, LED's, communication components, power components and/or sensor components.

Embodiment of a smart outlet 102 can also include at least one functional module 114. The functional module 114 can be any type of module configured to add functionality to the smart outlet 102. The at least one functional module can include (but is not limited to) one or more of a sensor module 116, wireless communications module 120, wired communications module 124, and/or a user interface module 122. The sensor module 116 can include, for example, any type of sensor, for example, a capacitance sensor, a light sensor, movement sensor, smoke sensor, carbon dioxide sensor, vibration sensor, water sensor, noise sensor, temperature sensor, barometric pressure sensor, humidity sensor or a weight sensor. The wireless communication module 120 can be configured to perform wireless communication and can include a receiver, transmitter or a transceiver. The wired communication module 124 can be configured for wired communications with another device via any type of wired communication. The user interface module 122 can be a user interface on the smart outlet, for example, a speaker, touchscreen, display, Light Emitting Diode (LED) indicator lights, or button. In certain embodiments, at least one module (including the output module 106 and/or the functional module 114) may be protected by a door formed along a surface of the housing 134 that may be opened to expose the at least one module (including the output module 106 and/or the functional module 114).

In certain embodiments, the smart outlet 102 can store and process information accessible to the smart outlet 102, including information produced by the smart outlet 102 or information received from the smart outlet. The information 102 can be stored within the memory of the processor module and processed by the processor of the processor module in accordance with instructions stored or received by the processor module. In some embodiments, the outlet 102 can also include a memory component, for example, that is in data communication with a processor module 126 and/or in data communication with another component that connects to the outlet. In specific embodiments, the smart outlet can store and process information, for example, historical operation of the shock proof electrical outlet and the amount of power transmitted from the at least one output modules.

In a number of embodiments, the smart outlet is manually configurable based upon user input (for example, via the user interface module 122 and/or from instructions received from the wired communication module 124 and/or wireless communication module 120). The smart outlet 102 can also be automatically configured without user input (for example, from automated processes executing by the processor module).

In specific embodiments, the smart outlet includes numerous connectors on which the various modules can be connected with each other. The connectors can be physical (for example, by being physically connected via a port) or wireless (for example, by being connected with different modules via a wireless connection).

In some embodiments, the smart outlet 102 can be configured to communicate with a remote computing device to control functionality of the smart outlet 102. For example, various embodiments of the smart outlet 102 can gather collect and provide data from various sensors coupled to, connected with, or in communication with the smart outlet 102, including real-time or near real-time data. As further discussed herein, some embodiments of a smart outlet 102 can be controlled to start or stop providing power to an output module, collect information from at least one sensor and provide the information to one or more remote computing devices such as a mobile communication device, and/or facilitate wireless communications by relaying information received at the smart outlet 102 to a device in communication with the smart outlet 102. In some embodiments the smart outlet 102 (for example the processor module 126 collectively with at least one communication module 122, 124) is configured to receive information in one communication protocol and provide information in a different communication protocol. For example, a smart outlet may receive information over a LAN and provide information using a shorter range communication protocol (e.g., Bluetooth or another short range protocol) to one or more computing devices in the vicinity of the smart outlet 102. In some embodiments, the smart outlet 102 is configured to communicate with other devices using, at least in part, one or more of the power lines it is connected to (for example, a ground wire or a neutral wire). In such configurations, the power lines are considered to be a communication network.

Figure 1B:
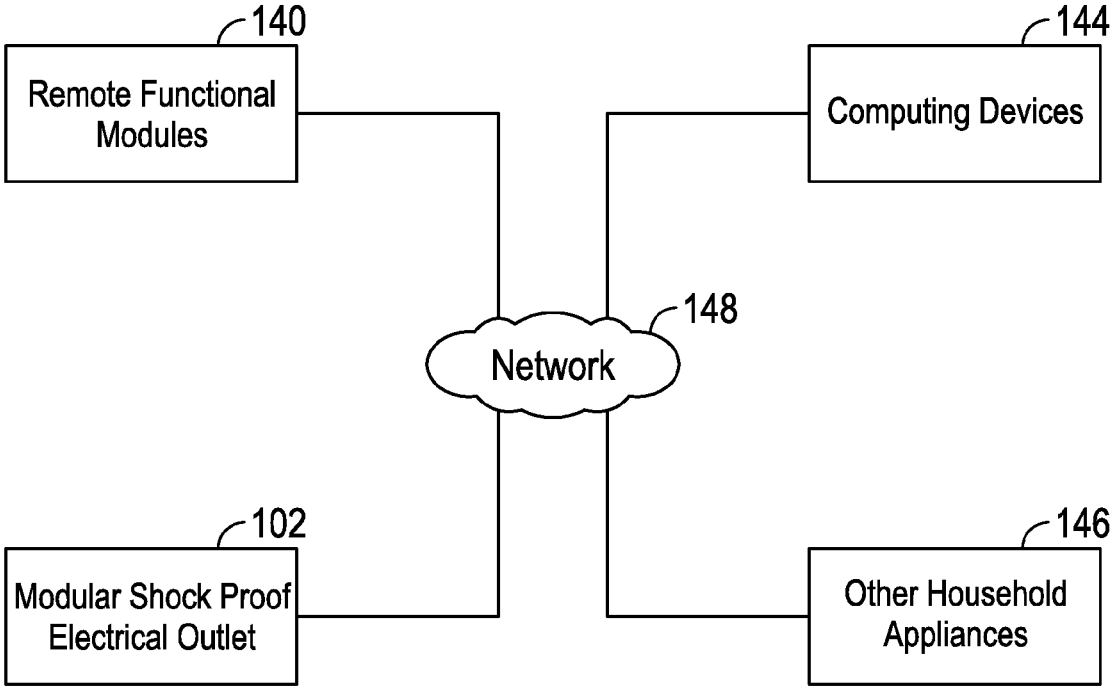
FIG. 1B is a diagram illustrating an example of an embodiment of a smart outlet (for example, as shown in FIG. 1A) connected to a network.

FIG. 1B is a network diagram illustrating an example of a system that includes a smart outlet 102 connected to a communication network 148. The network 148 can be any type of network, including (but not limited to) the Internet, a LAN, a WAN, or a personal network. Via the network 148, the smart outlet 102 can be connected with any number of devices over the network 148, for example, (but not limited to) remote functional modules or devices 140, computing devices 144 (for example, but not limited to laptops, smartphones, and/or tablets), one or more other smart outlets 102, and/or household appliances 146. Using the network 148, the smart outlet 102 can send and receive instructions and/or information to other devices connected over the network 148 in real (or near real) time. In certain embodiments, the smart outlet 102 can be configured to send information to other devices over the network 148, for example, instructions to shut off water in a house if water is detected by a sensor module 116 configured as a water sensor.

Figure 1C:
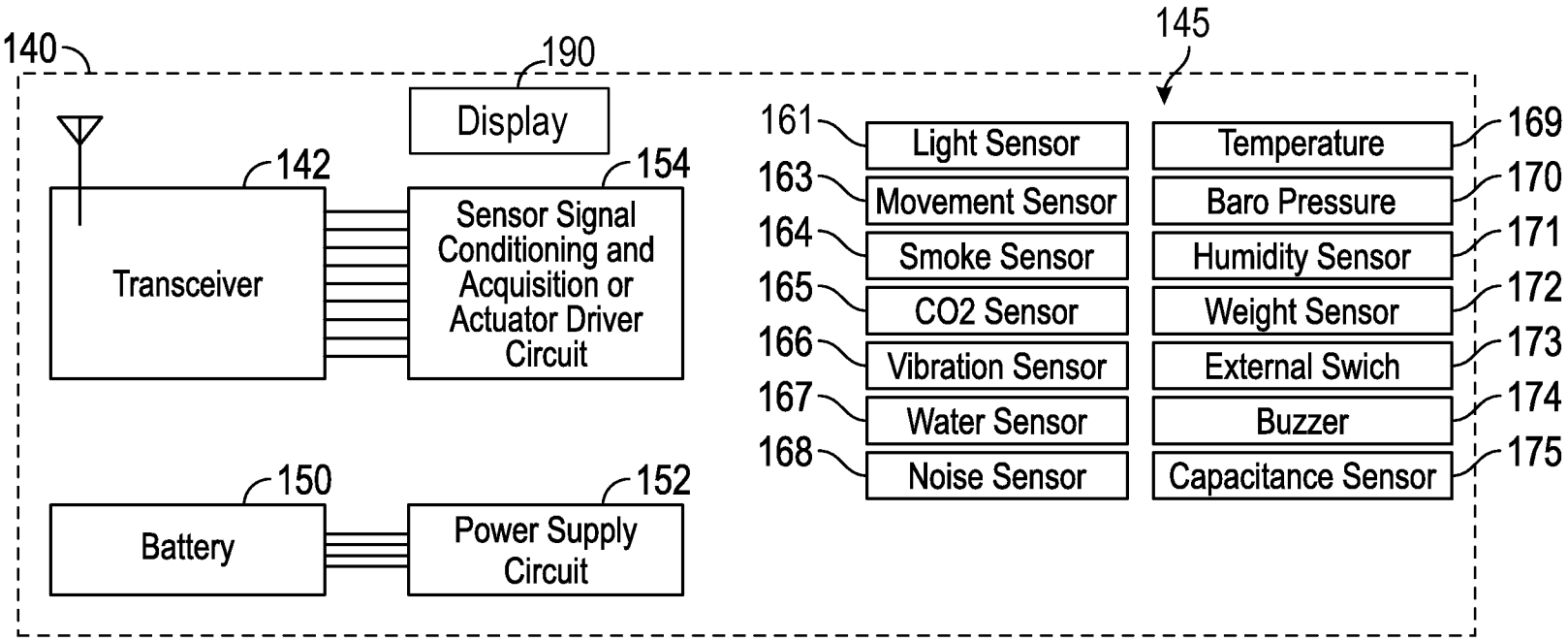
FIG. 1C is a perspective view diagram illustrating an example of an embodiment of a remote functional module (for example, as illustrated in FIG. 1).

FIG. 1C is a block diagram illustrating an example of an embodiment of a remote functional module 140, for example, a remote functional module 140 as illustrated in FIG. 1A. The remote functional module 140 can be configured to communicate wirelessly or via a wired connection with the smart outlet 102 via a communication network. The remote functional module 140 may include a transceiver 142 for communication with a smart outlet 102 either over a network (for example, network 148 as shown in FIG. 1B) or directly with at least one of a smart outlet including the smart outlet 102 (FIG. 1A), computing devices 144 or other household appliances 146 as illustrated in FIG. 1B. In some embodiments, the illustrated remote functional module 140 may be sensor module 116 (FIG. 1). The remote functional module 140 may include at least one of a number of sensors 145, for example, a light sensor 161, movement sensor 163, smoke sensor 164, CO2 sensor 165, vibration sensor 166, water sensor 167, noise sensor 168, temperature sensor 169, barometric pressure sensor 170, humidity sensor 171, weight sensor 172 and/or a capacitance sensor 175. The remote functional module 140 may also include a number of user interfaces (including at least one of a display 190, external switch 173 and/or a buzzer 174). The remote functional module 140 may also include supporting circuitry such as a battery 150 and a power supply circuit 152 coupled to the battery 150. The remote functional module 140 may also include a circuitry to facilitate communication using the transceiver, for example a sensor signal conditioning and acquisition circuit or actuator driver circuit 154. In some embodiments, the remote functional module 140 may have a display 190 which may be a touchscreen and be configured as a user interface.

The remote functional module 140 may be configured to communicate with the smart outlet using the transceiver 142. For example, the remote functional module 140 may be configured to send information gathered by the sensors 145 and/or user interfaces 190, 173, 174 to the smart outlet 102. Also, the remote functional module 140 may receive commands from the smart outlet 102 to configure the sensors 145 and/or user interfaces 190, 173, 174 in a certain manner. This may include turning certain sensors 145 on or off and/or presenting certain information via the user interfaces 190, 173, 174. Although the remote functional module 140 is described as communicating with the smart outlet 102, in some embodiments the remote functional module 140 may be considered as part of the smart outlet while the smart outlet 102 communicates with the remote functional module 140.

Figure 2A:
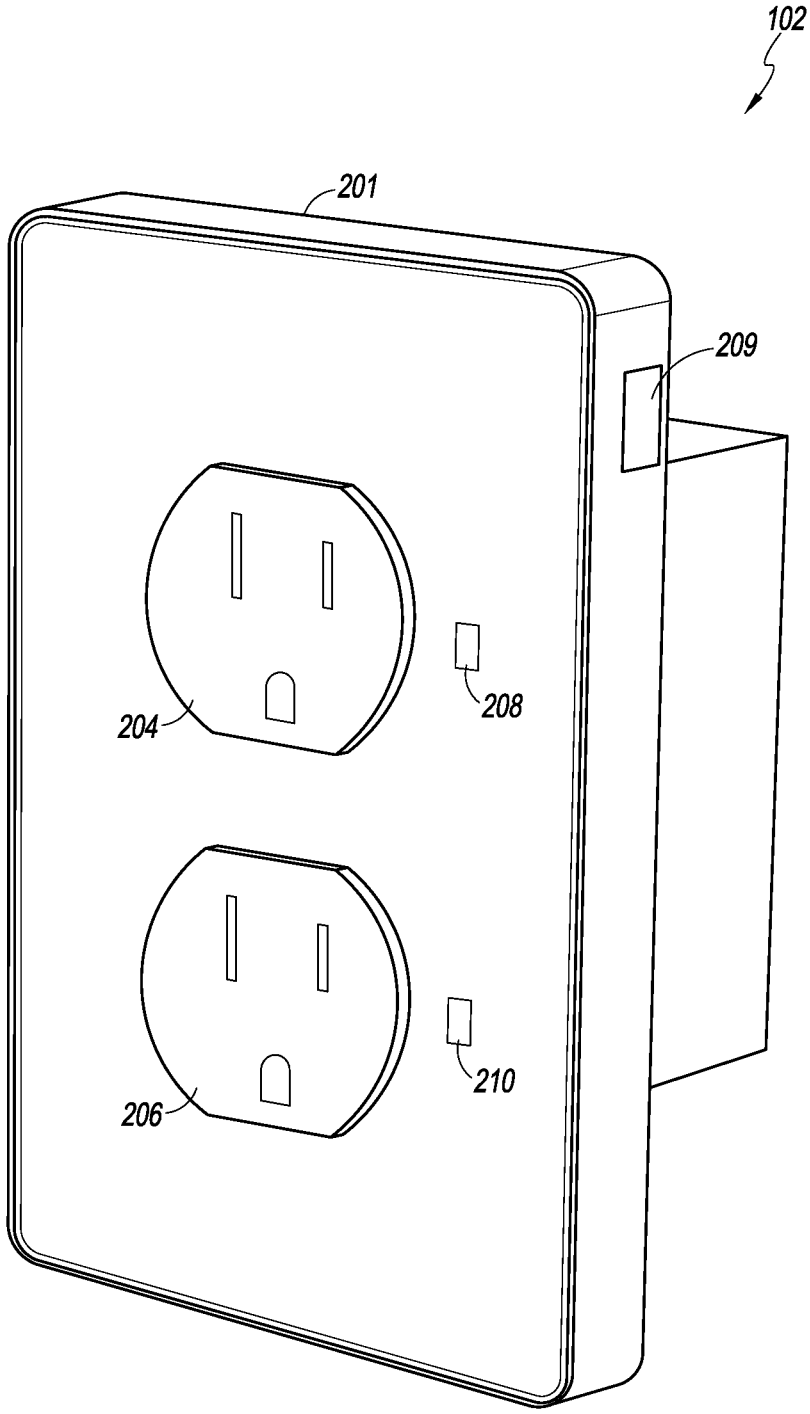
FIG. 2A is a front perspective view illustrating an example of an embodiment of a smart outlet (for example, as illustrated in FIG. 1) that includes a housing, user interface module, and plug outlet modules.

FIG. 2A is an illustration of a smart outlet 102 implemented within a single housing 201 with user interface modules and plug outlet modules in accordance with an exemplary embodiment. The smart outlet 200 includes two plug outlet sockets 204, 206, each configured to receive plug having a ground prong. The smart outlet 200 includes two indicator user interface functional modules 208, 210 implemented as LEDs. The smart outlet 200 includes an input user interface functional module 209 implemented as a button. An example of operation of the two indicator user interface functional modules 208, 210 implemented as LEDs and the input user interface functional module 209 implemented as a button in accordance with a particular embodiment is discussed further in connection with FIG. 2L. Although the smart outlet 200 is illustrated in FIG. 2A is of a particular physical structure, the physical structure of the smart outlet 200 can be customized with different colors or designs of the outward appearance of the smart outlet as discussed further below. Also, the arrangement and presentation of any user interface modules can be customized in any manner in accordance with different embodiments as discussed further below.

Figure 2B:
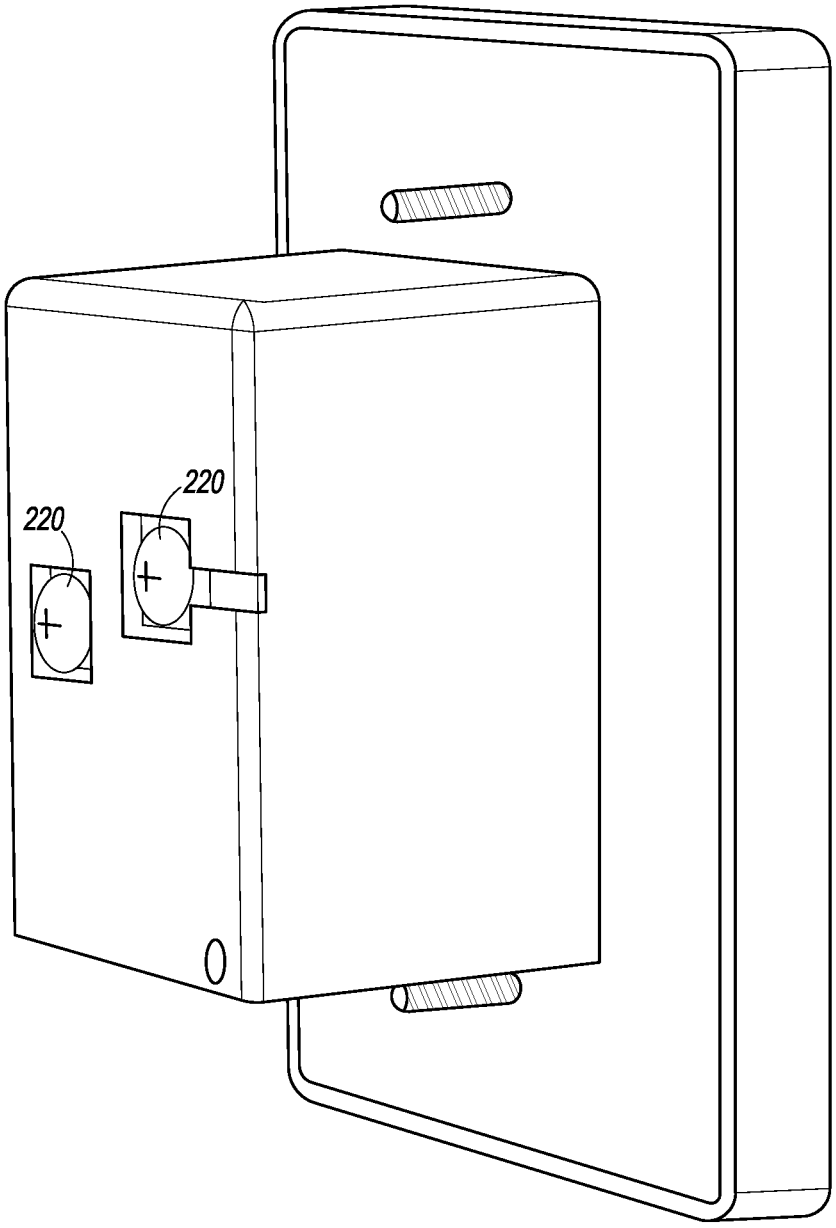
FIG. 2B is a back perspective view illustrating an example of an embodiment of the smart outlet of FIG. 2A.
Figure 2C:
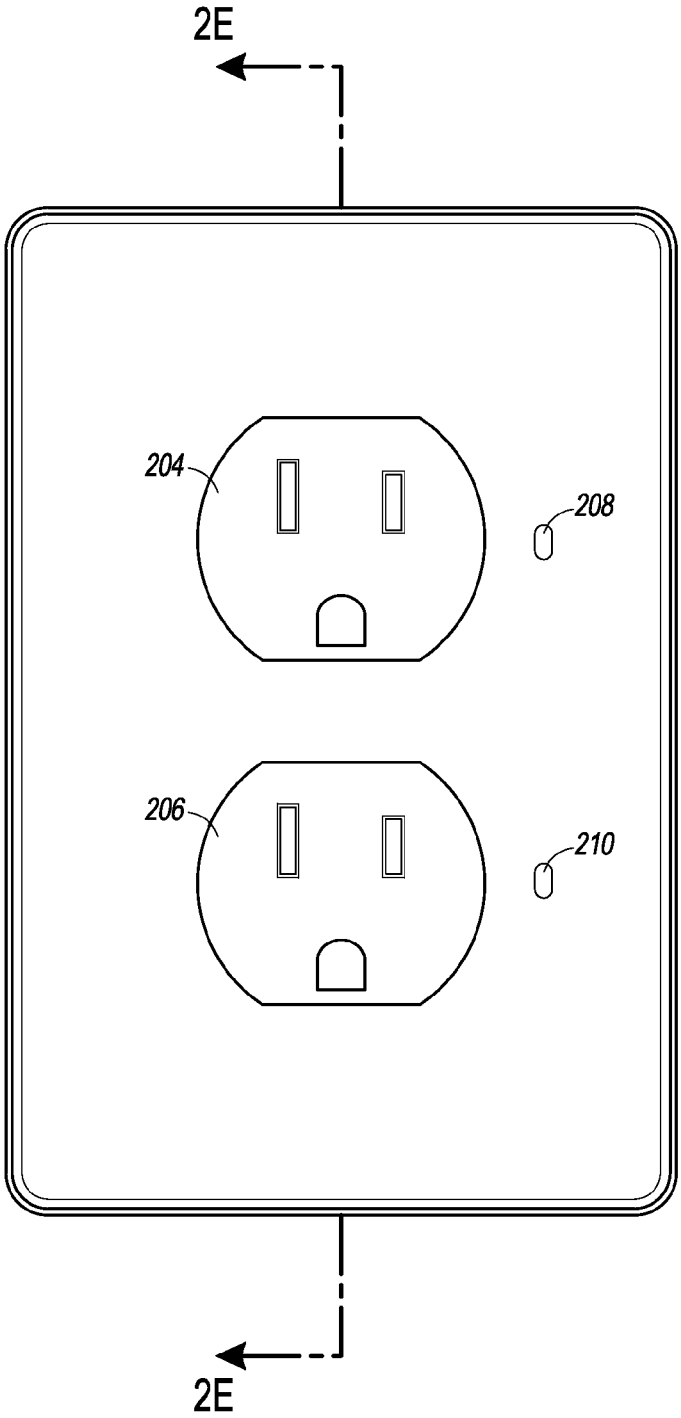
FIG. 2C is a front view illustrating an example of an embodiment of the smart outlet of FIG. 2A.
Figure 2D:
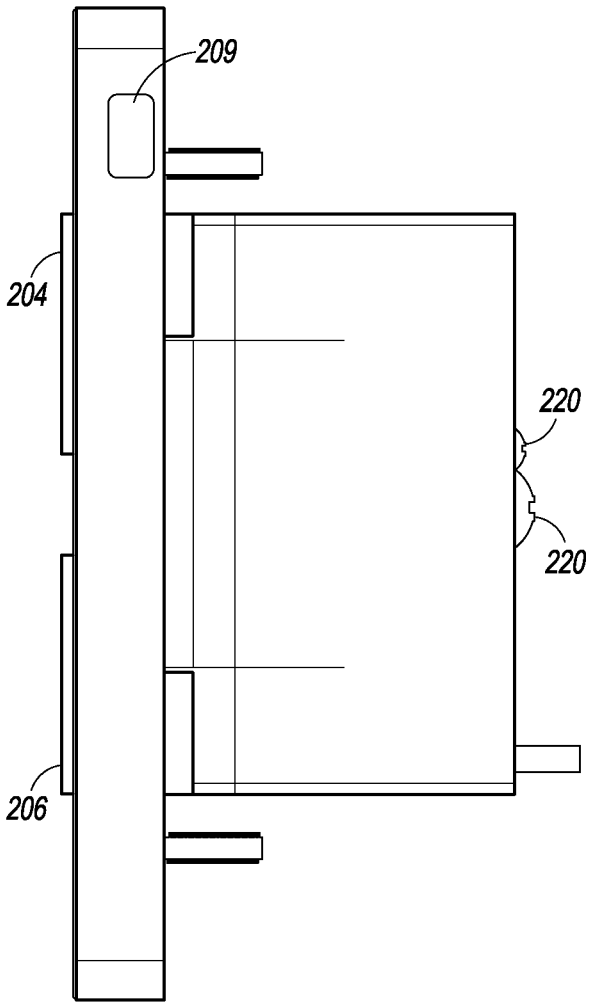
FIG. 2D is a side view illustrating an example of an embodiment of the smart outlet of FIG. 2A.
Figure 2E:
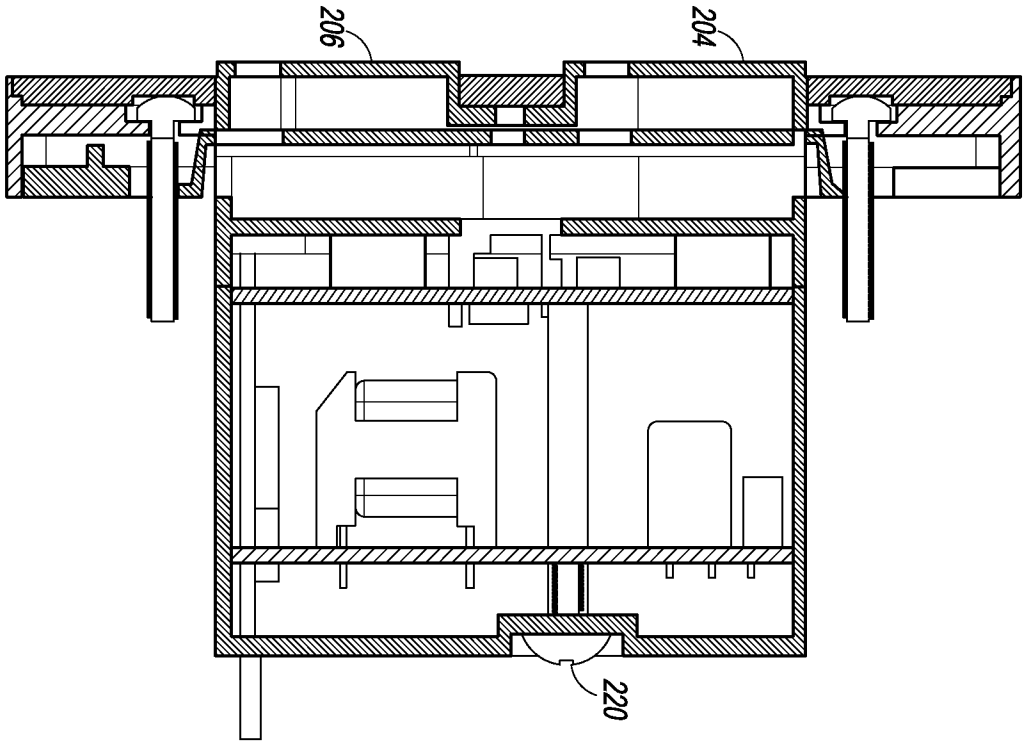
FIG. 2E is a cross sectional view illustrating an example of an embodiment of the smart outlet of FIG. 2A.
Figure 2F:
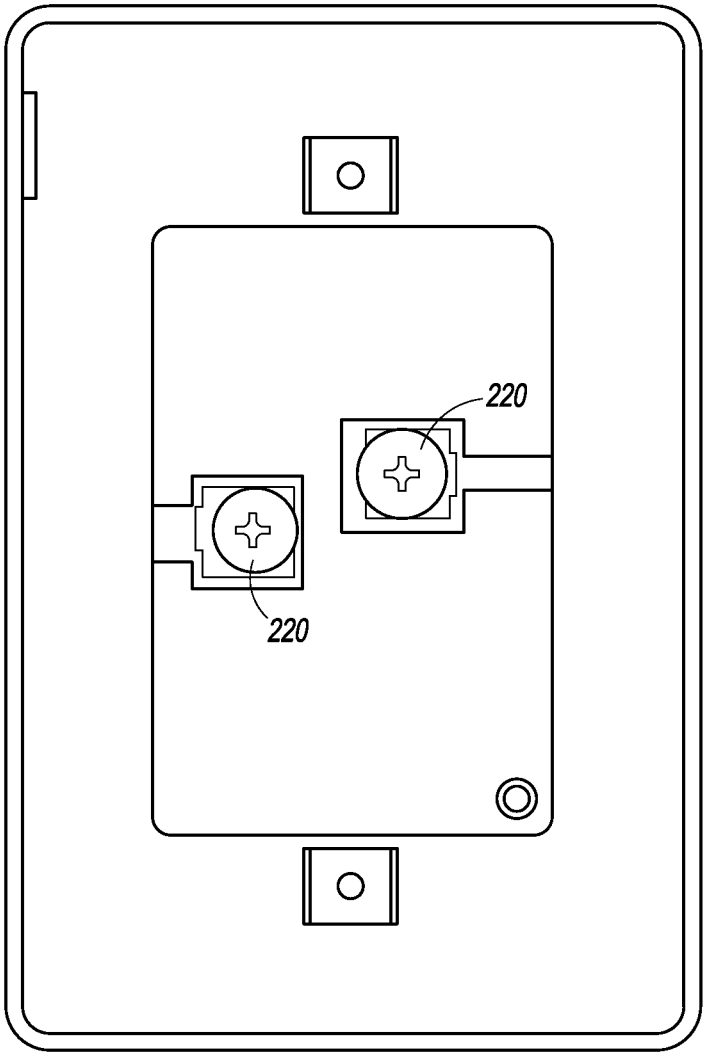
FIG. 2F is a back view illustrating an example of an embodiment of the smart outlet of FIG. 2A.

FIGS. 2B-2G illustrate various view of the smart outlet 200 of FIG. 2A. FIG. 2B is an illustration of a perspective back view of the smart outlet 102 of FIG. 2A in accordance with an exemplary embodiment. In FIG. 2B, the smart outlet 200 can use the input interface 220, when inserted into a wall, to interface with the power source 104. The input interface 220 may include a conductor that may be connected to the power source. The conductor may be a metallic screw or wire in certain embodiments. FIG. 2C is a front view of the smart outlet 200 of FIG. 2A in accordance with an exemplary embodiment. FIG. 2D is a side view of the smart outlet 200 of FIG. 2A in accordance with an exemplary embodiment. FIG. 2E is a cross sectional view of the smart outlet 200 of FIG. 2A in accordance with an exemplary embodiment. FIG. 2F is a back view of the smart outlet 200 of FIG. 2A in accordance with an exemplary embodiment.

Figure 2G:
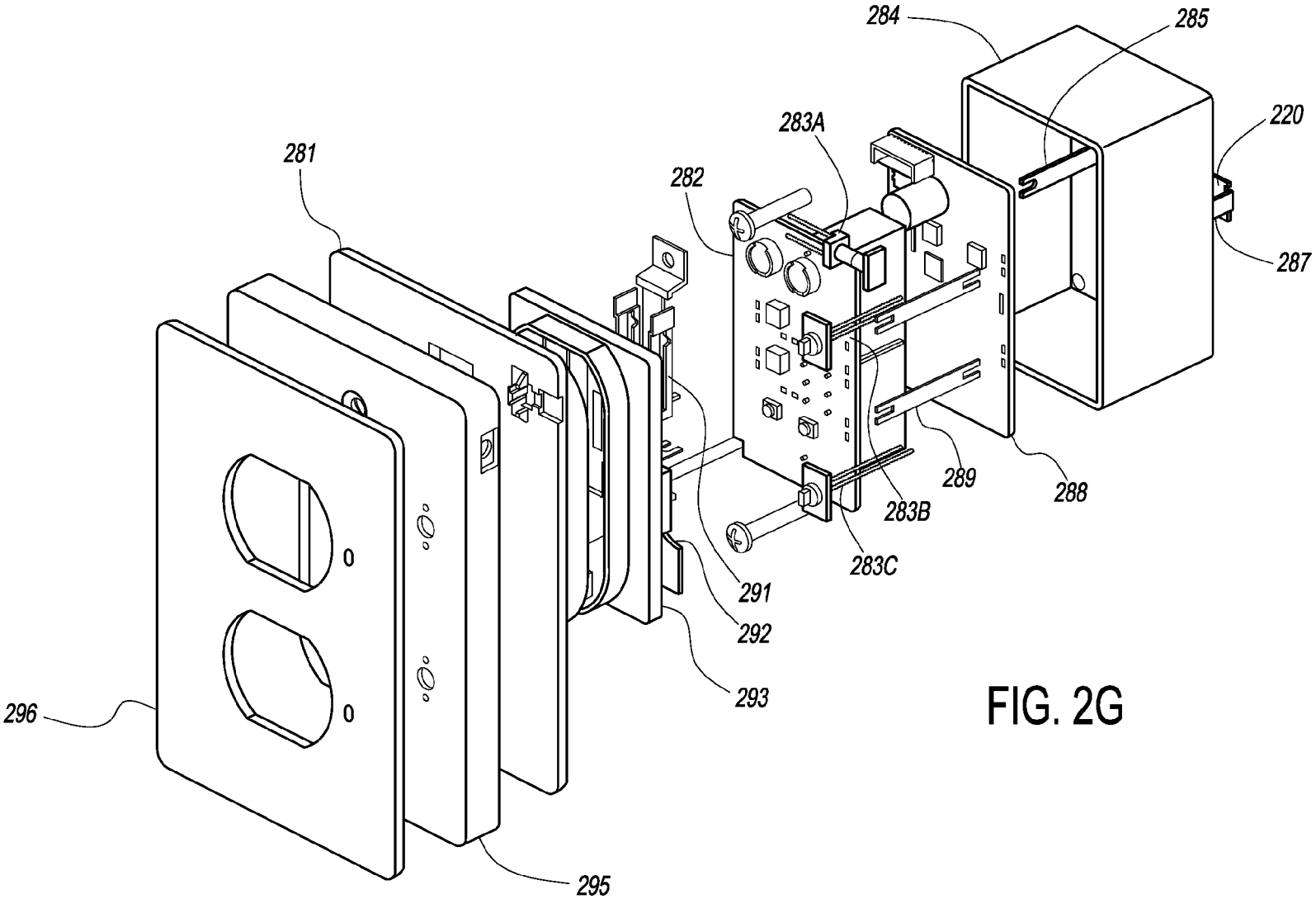
FIG. 2G is an exploded view diagram illustrating an example of an embodiment of the smart outlet of FIG. 2A.

FIG. 2G is an exploded view diagram 280 example of an embodiment of a smart outlet, for example, smart outlet 200 of FIG. 2A. The exploded view diagram 280 includes a front cover 296, bottom enclosure 281, relay printed circuit board (PCB) 282, fasteners 283A-C, socket box 284, first low voltage power supply connector 285, input interface 220, socket box ground 287, power PCB 288, second low voltage power supply connector 289, power bracket 291, ground bracket 292, top enclosure 293, and front enclosure 295. The relay printed circuit board (PCB) 282, first low voltage power supply connector 285, socket box ground 287, power PCB 288, second low voltage power supply connector 289 are enclosed by the top enclosure 293 and the socket box 284 using the power bracket 291, ground bracket 292, and fasteners 283A-C. The front enclosure 295 may be between the front cover 296 and the bottom enclosure 281. The bottom enclosure 281 may be connected with the top enclosure 293. The input interface 220 may be formed along a surface of the socket box 284. Also, certain modules, including the processor module and the safety module, may be formed on the power PCB 288 and/or the relay PCB 282. For example, the relay module may be formed on the relay PCB and the processor module may be formed on the power PCB 288.

Figure 2H:
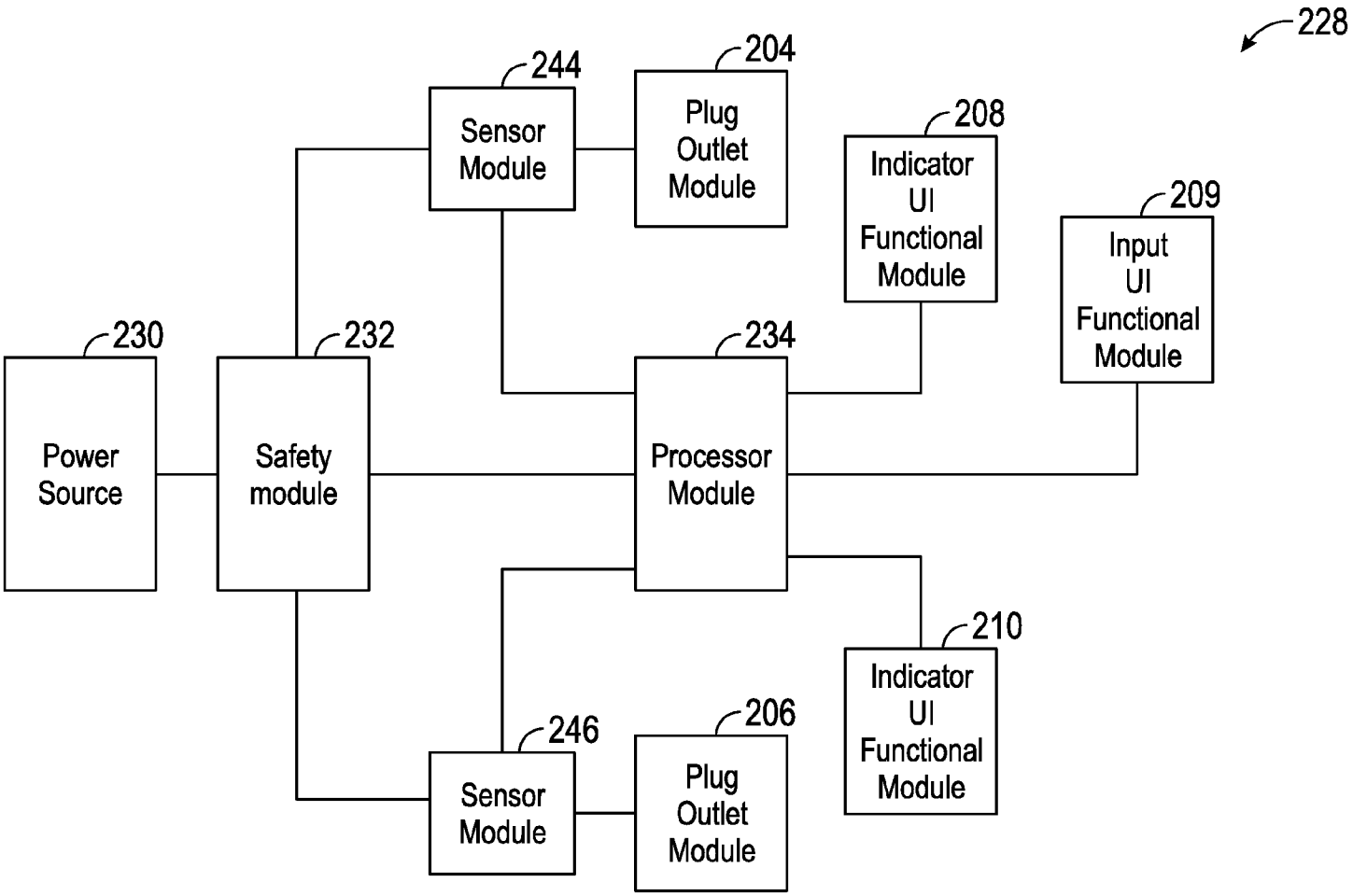
FIG. 2H is a block diagram illustrating an example of an embodiment of the smart outlet of FIG. 2A.

FIG. 2H is a block diagram 228 illustrating an example of an embodiment of a smart outlet, for example, the smart outlet 200 of FIG. 2A. The block diagram 228 includes a safety module 232, current sensor modules 244, 246, the plug output modules 204, 206, the indicator user interface functional modules 208, 210, input user interface functional module 209, and processor module 234 in accordance with an exemplary embodiment.

The current sensor modules 244, 246 may monitor current at the plug outlet modules 204, 206. In certain embodiments, the current sensor modules 244, 246 may include an ammeter (e.g., a moving coil ammeter, moving magnet ammeter, electrodynamic ammeter, moving-iron ammeter or hot wire ammeter). The current levels may be read by the processor module 234 from the current sensor modules 244, 246. The processor module 234 may read the current levels by receiving signals from the current sensor modules 244, 246 reflective of the current level measured by the current sensor modules 244, 246. Based on the measured current level, the processor module 234 may control the safety module 232 to selectively connect or disconnect the power source 230 to a particular plug outlet module 204, 206. The processor may control the safety module by sending a signal to the safety module to control the safety module. The safety module 232 may connect and/or disconnect the power source 230 from a particular plug outlet module 204, 206 by using a switch or a relay, as discussed further below.

The processor module 234 may also control the indicator user interface functional modules 208, 210. The indicator user interface functional modules 208, 210 may indicate whether the safety module 232 has connected or disconnected a particular plug outlet module 204, 206 from the power source 230. The indicator user interface functional modules 208, 210 may include LEDs that emit a particular colored light. The processor module 234 may receive commands from the input user interface functional module 209. In certain embodiments, the input user interface functional module 209 may be a button. The button (when selected by a user) may be used to send a command to the processor module 234 to control the safety module 232. The safety module 232 may be controlled to connect the power source 230 to the plug outlet modules 204, 206. An example of an embodiment that uses the input user interface functional module 209 is discussed in connection with FIG. 2L.

Figure 2I:
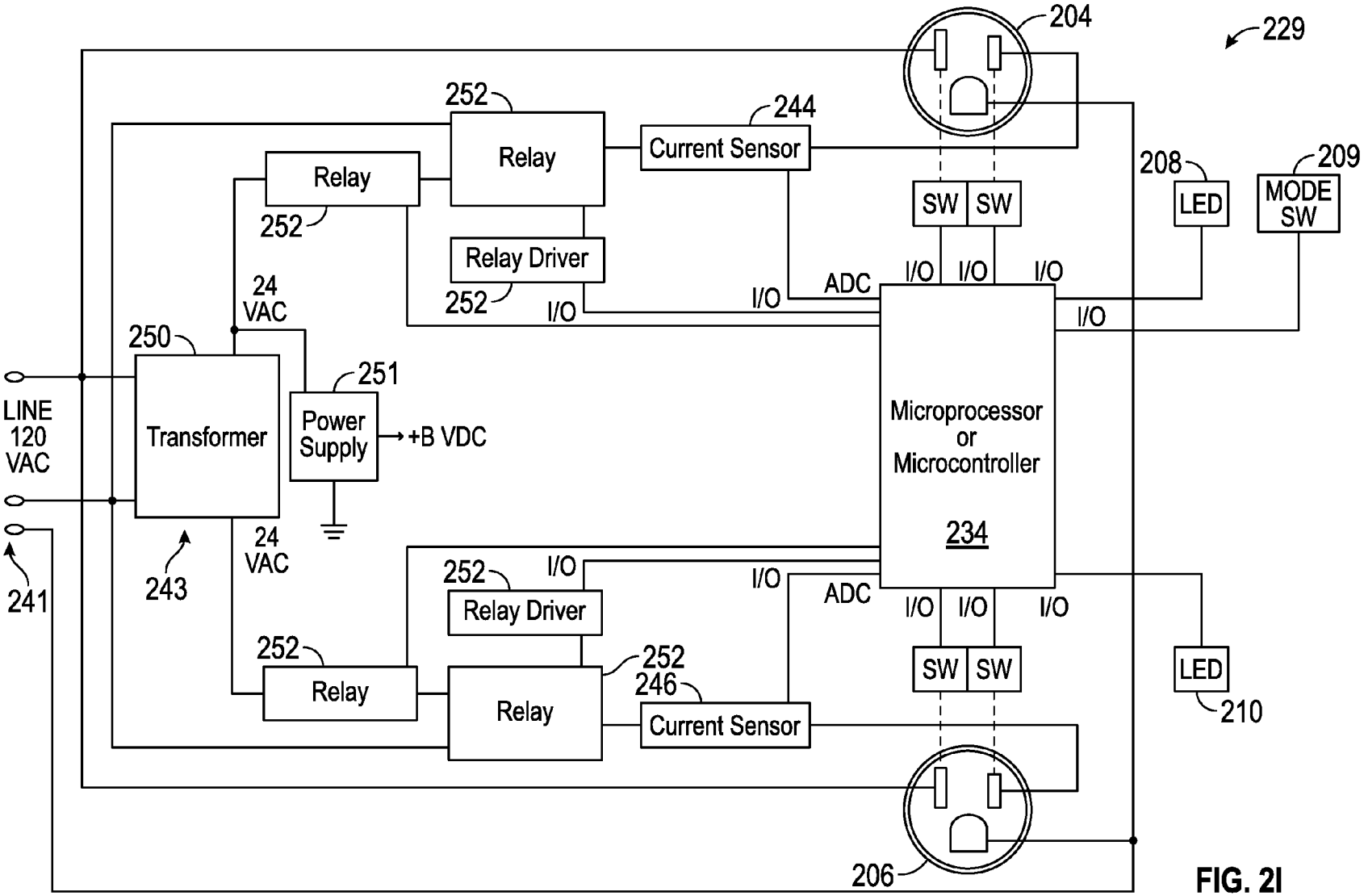
FIG. 2I is a schematic illustrating an example of an embodiment of a block diagram of FIG. 2H.

FIG. 2I is a schematic 229 illustrating example of an embodiment of the block diagram 228 of FIG. 2H. In the schematic 229, relays 252 may be part of the safety module 232 of FIG. 2H. The relays 252 may be connected with an input interface 241, 242. Also, the processor module 234 may be connected with the indicator user interface functional modules 208, 210, the input user interface functional module 209, the current sensor modules 244, 246, and relays 252 of the safety module 232. The relays 252 of the safety module 232 may be connected with the plug outlet modules 204, 206 and the input interface 241, 242.

The input interface 241, 242 includes a high power input interface 241 connected to the power source 230. The input interface 241, 242 also includes a low power input interface 243. The low power input interface 243 may include a transformer 250 and low voltage power supply 251. In certain embodiments, the power supply 251 receives power from the power source 230. For example, the low voltage power supply 251 may include power converted from the power source 230 by the transformer 250. The transformer 250 may include a step-down transformer configured to provide a low AC voltage of a known ratio (e.g., 20:1) of the high voltage input. In some embodiments, the power supply 251 includes one or more batteries.

The safety module 232 may include relays 252 controlled by the processor module 234. The safety module 232 may use the relays 252 to connect the plug output modules 204, 206 to the power source 230 via the high power input interface 241. Also, the safety module 232 may use the relays 252 to connect the plug output modules 204, 206 to the low voltage power supply 251.

In example of an embodiment that uses the safety module 232 to connect the plug outlet module 204 to the power source 230, the high voltage interface 241 may be at 120 VAC and the low voltage interface 243 may be at 24 VAC. The relays 252 of the safety module 232 may connect the plug outlet module 204 to the low voltage interface 243 or the high voltage interface 241. The current sensor 244 may measure the current at the plug outlet module 204. As discussed further below, the current measured by the current sensor 244 may be either a low voltage current (IL) or a high voltage current (IH). The low voltage current is measured when the relays 252 connect the plug outlet module 204 to the low voltage interface 243. The high voltage current is measured when the relays 252 connect the plug outlet module 204 to the high voltage interface 241.

The relays 252 may be controlled based on the magnitudes of the current sensed by the current sensor 244 flowing from the input interface 241, 242 to the plug outlet module 204. The relays 252 may be in a default state that connects the low voltage interface 243 to the plug outlet module 204 when one of the following conditions exists: (a) no load is present at the plug outlet module 204, e.g., no plugs are inserted within the sockets of the plug outlet module 204; (b) there is a load present at the plug outlet module 204, but the load's load impedance (ZL) exceeds a certain threshold load impedance (ZT) such that the low voltage current (IL) measured at the plug outlet module 204 stays below a certain threshold low voltage current (IL-TH); and (c) the low voltage power supply 251 is not powered. The low voltage power supply 251 may not be powered in certain embodiments because the high power input interface 241 is not connected to the power source 230.

The condition (a) (no load) also encompasses the condition in which a human body part is in contact with the plug outlet module 204. The impedance presented by human body can depend on internal impedance and impedance of skin. The internal impedance can depend on a variety of factors including current path and surface area of contact. The impedance of skin can also depend on a variety of factors including voltage, frequency, length of time, surface area of contact, pressure of contact, temperature, and amount of moisture. In certain embodiments, the threshold load impedance (ZT) is between about 500Ω and about 10 kΩ. In other embodiments, the ZT impedance is between about 10 kΩ and about 100 kΩ. The threshold load impedance (ZT) is a design parameter that can be selected depending on the application.

The relays 252 connect the plug output module 204 to the power source 230 via the high power input interface 241 when a load (ZL) is present at the plug outlet module 204 with ZL≤ZT such that IL≥IL-TH is satisfied. In this situation, the high voltage current (IH) is measured at the plug outlet module 204. Also, the relays 252 maintain connection of the plug output module 204 to the power source 230 via the high power input interface 241 while the high voltage current IH stays above a certain threshold value IH−TH (i.e., while IH≥IH−TH).

A human body typically represents a high impedance path. Therefore, under most conditions (e.g., wet), a human body touching the plug outlet module 204 would fail to draw a low voltage current (IL) sufficient enough to satisfy IL≥IL−TH. On the other hand, the requisite IL≥IL−TH condition is satisfied under most circumstances when a load present at the plug outlet module 204.

Although the above example of an embodiment uses the relays 252 to connect the plug outlet module 204 to the power source 230, other embodiments may similarly use the relays 252 to connect other plug outlet modules to the power source 230 in a similar manner as described above.

Figure 2J:
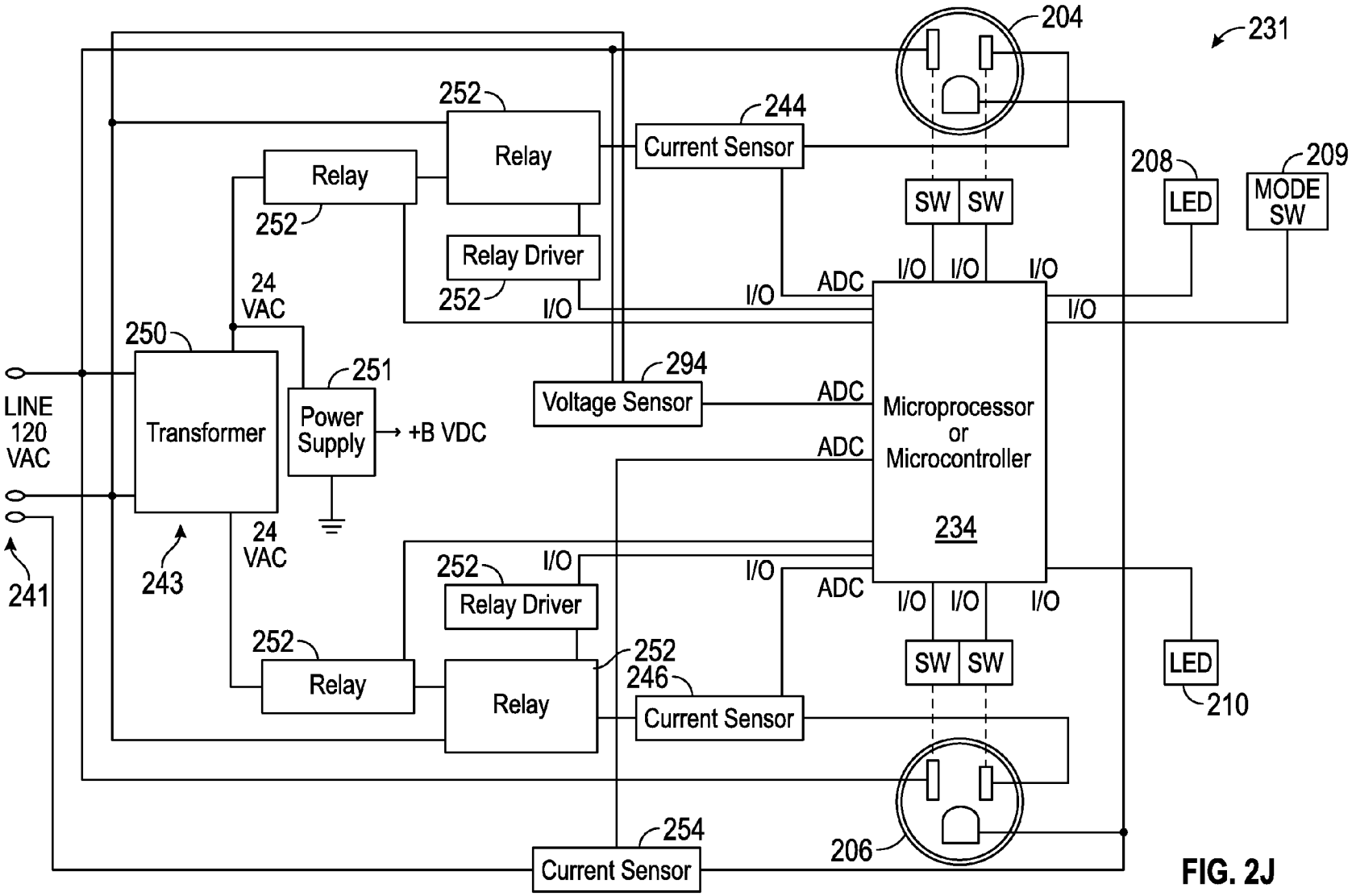
FIG. 2J is a schematic illustrating an example of an embodiment of the smart outlet of FIG. 2H.
Figures 1, 2K:
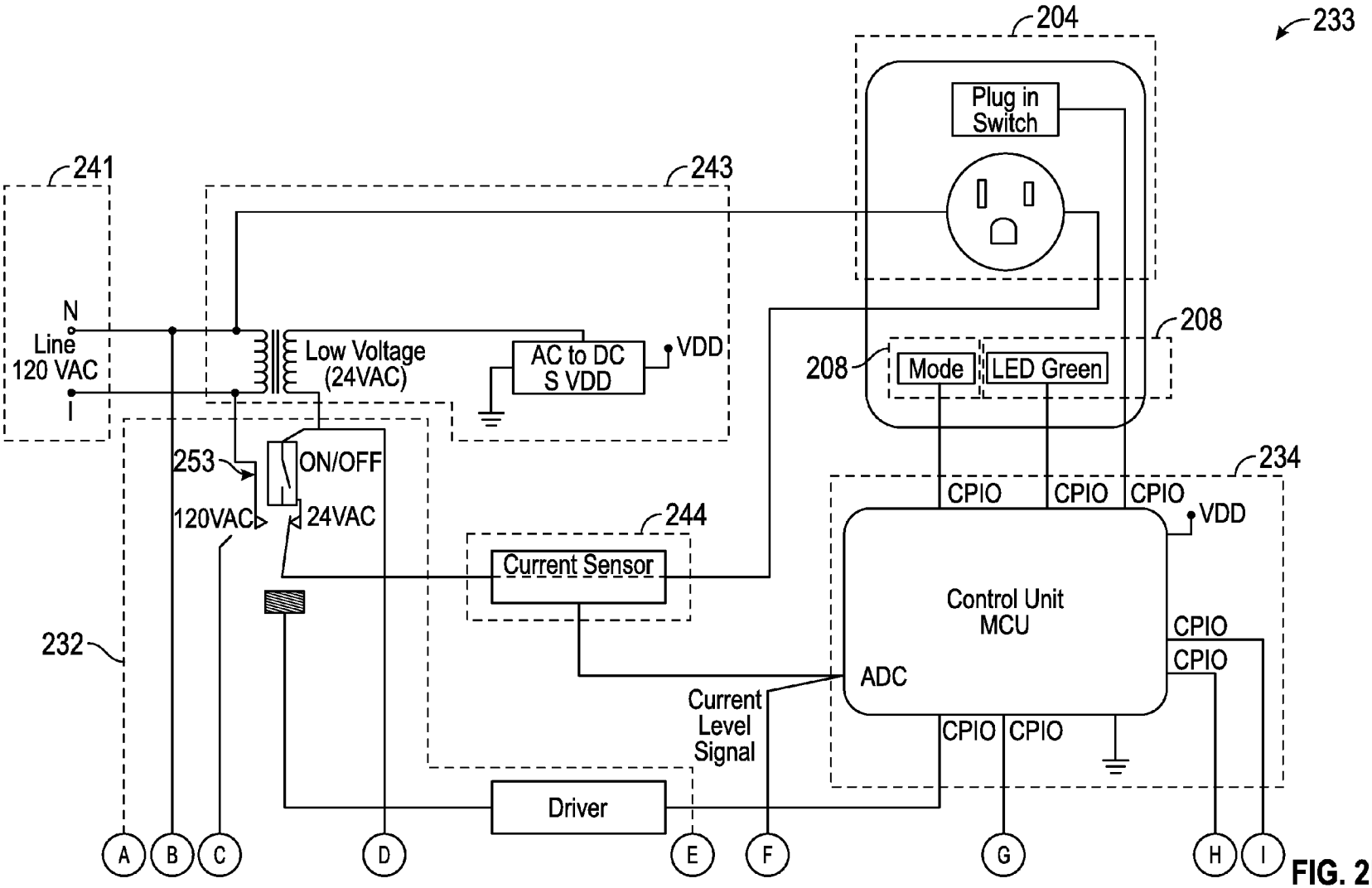
FIGS. 2K-1 and 2K-2 are a schematic illustrating an example of an embodiment of FIG. 2H.

FIG. 2J is a schematic 231 example of an embodiment of the block diagram 229 of FIG. 2I with an additional current sensor 254 and an additional voltage sensor 294. The schematic 231 illustrates the current sensor 254 that monitors a ground socket of the plug outlet modules 204, 206. The ground socket may be connected to a ground portion of the high power input interface 241. The schematic 231 also illustrates a voltage sensor 294. The voltage sensor 294 monitors a voltage level at the high power input interface 241. Both the voltage sensor 294 and the current sensor 254 are connected with the processor module 234. The processor module 234 may utilize the current level sensed by the current sensor 254 and the voltage level sensed by the voltage sensor 294 to control the relays 252. The relays 252 may be controlled to connect the plug outlet module 204 to the power source 230 dependent upon the current level sensed by the current sensor 254 and the voltage level sensed by the voltage sensor 294.

Figures 2, 2K:
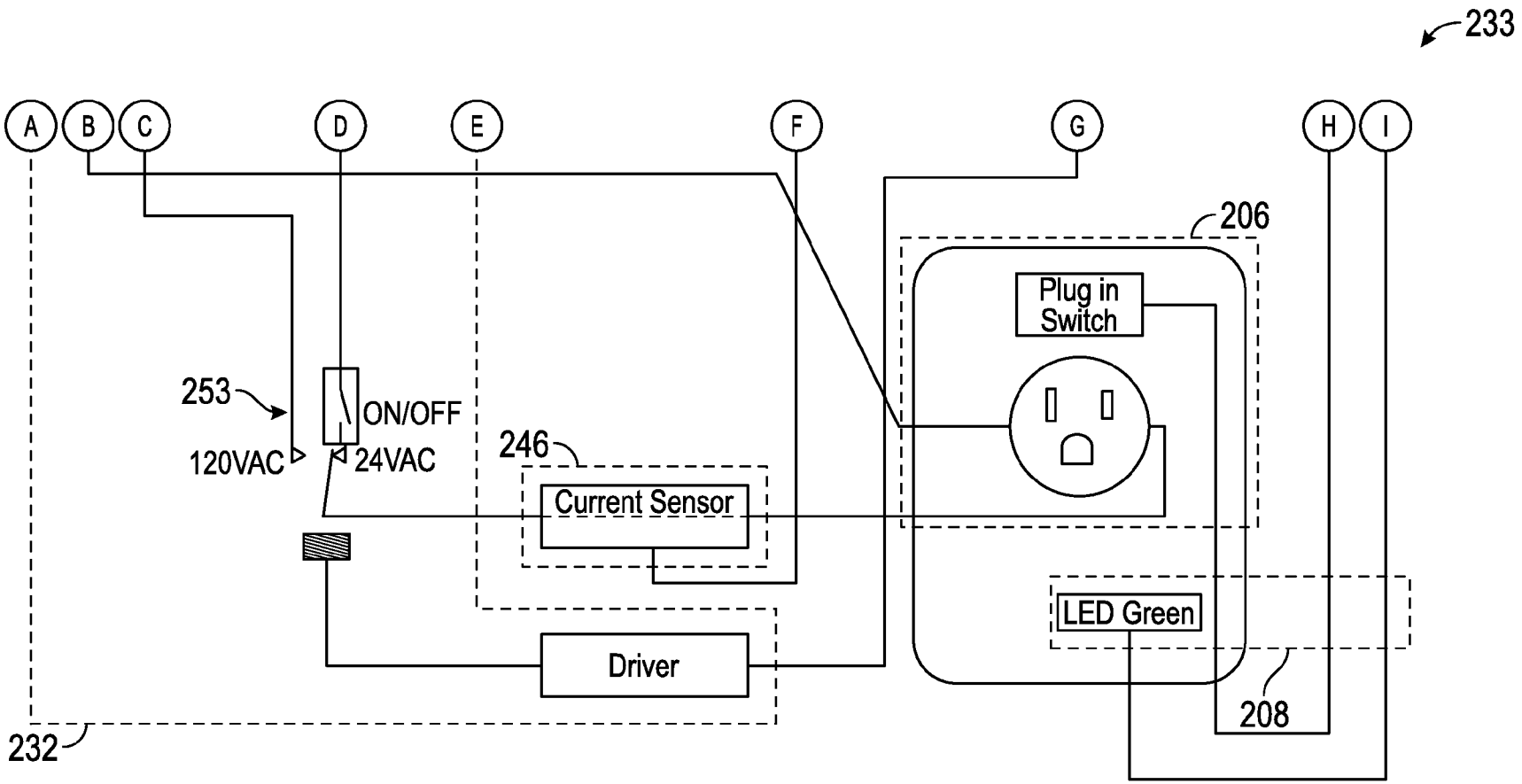

FIGS. 2K-1 and 2K-2 are a schematic 233 example of an embodiment of the block diagram 229 of FIG. 2I with switches 253. As illustrated in the schematic 233, the safety module 232 utilizes switches 253 rather than relays 252. Points A, B, C, D, E, F, G, and I on FIG. 2K-1 connect with same points A, B, C, D, E, F, G, H, and I on FIG. 2K-2.

Figure 2L:
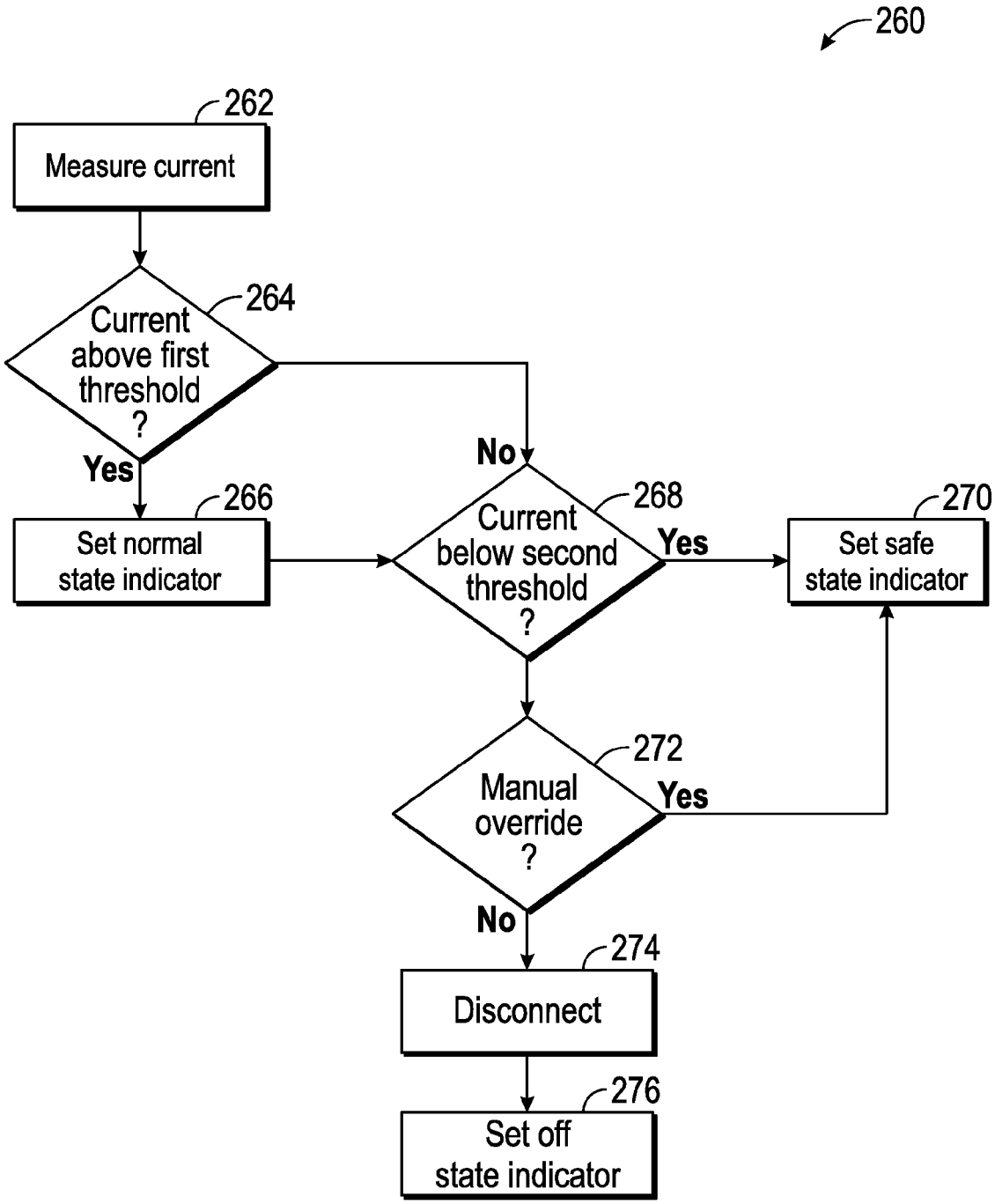
FIG. 2L is a flow chart of a process illustrating an example of an embodiment of operation of LED indicator lights that may be included in the user interface module of a smart outlet.

FIG. 2L is a flow chart of a process 260 for operation of LED indicator lights as the user interface module 208, 210 in the smart outlet 200 of FIG. 2A in accordance with an exemplary embodiment. The process 260 may be performed by the processor module 234. Although the process 260 is illustrated relative to the plug outlet module 204, current sensor module 244, safety module 232, indicator user interface functional module 208, input user interface functional module 209, and processor module 234, the process 260 may be applied relative to a plug outlet module, current sensor module, safety module, indicator user interface functional module, input user interface functional module, or processor module as appropriate for different applications in accordance with different embodiments. The process 260 may start at block 262.

At block 262, the processor module 234 may read a current level at the plug outlet module 204 using the current sensor 244 module.

At block 264, the processor module 234 determines whether the measured current level is above a first current threshold. If the measured current level is above the first current threshold, the process 260 may proceed to block 266. If the current level is not above the first current threshold, the process may proceed to block 268.

At block 266, the processor module controls the indicator user interface functional module 208 to indicate a normal state operation. The normal state of operation may be indicated by illuminating a colored LED.

At block 268, the processor module 234 determines whether the measured current level is below a second threshold. If the measured current level is below the second threshold, then the process 260 proceeds to block 270. If the measured current level is not below the second threshold, then the process 260 proceeds to block 242.

At block 270, the processor module 234 controls the indicator user interface functional module 208 to indicate a safe state. The safe state may be indicated by illuminating a colored LED.

At block 272, the processor module 234 determines whether the input user interface functional module 209 has been manipulated to indicate a manual override. The manual override may be indicated by a user pressing a button of the input user interface functional module 209. If the manual override is indicated, then the process proceeds to block 270. If the manual override is not indicated, then the process proceeds to block 274.

At block 274, the processor module 234 controls the safety module to not connect the plug outlet module 204 and the power source 230.

At block 276, the processor module controls the indicator user interface functional module 208 to indicate an off state. The off state may be indicated by illuminating a colored LED.

In certain embodiments, smart outlets 102 of FIG. 1A may have multiple housings. At least one of the housings may be configured to fit within a wall socket and be inserted within a wall.

Figure 3A:
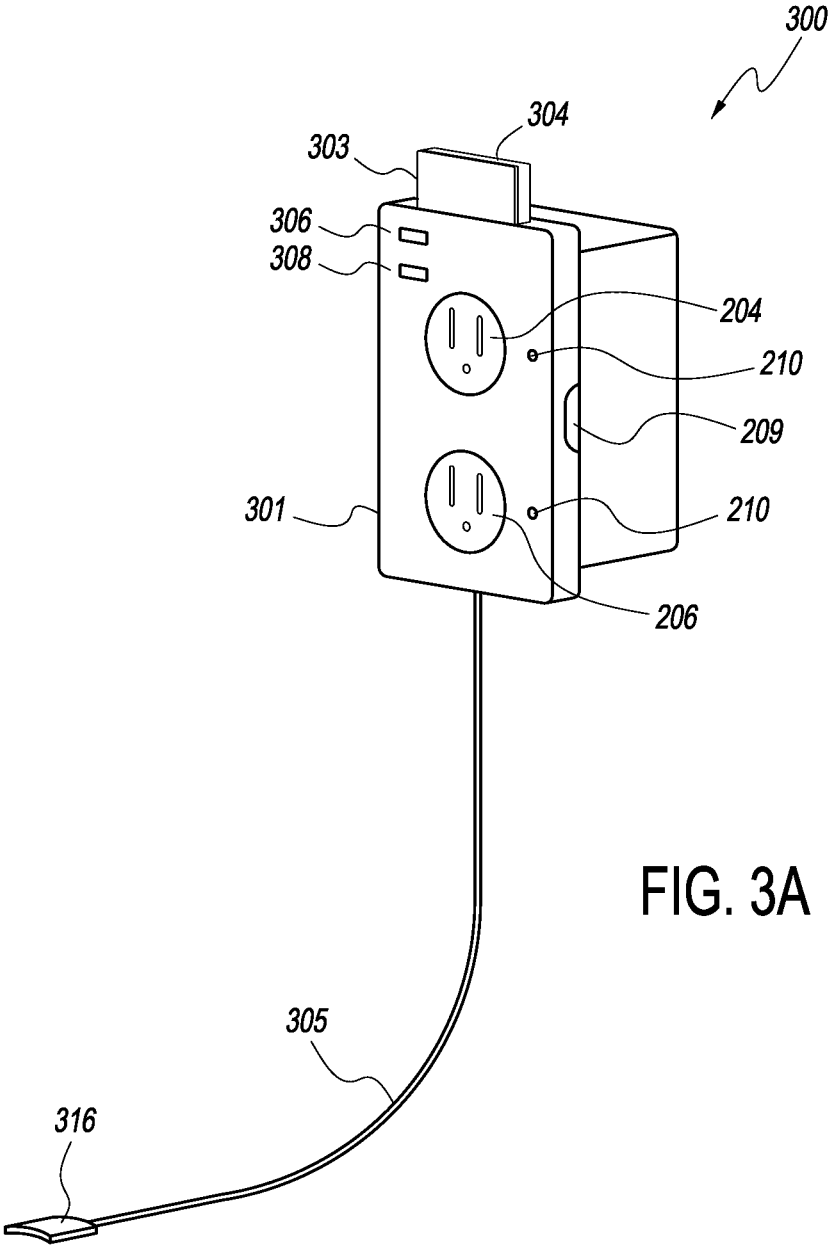
FIG. 3A is a perspective view illustrating an example of an embodiment of a smart outlet.

FIG. 3A is an illustration of the smart outlet 102 of FIG. 1A with modules in a different configuration than the modular shock proof outlet of FIG. 2A in accordance with an exemplary embodiment. Also, the smart outlet 300 of FIG. 3A includes three housings 301, 303, 305 which may be integrated together using connectors, as discussed further below. Housing 301 may be configured to fit within a wall socket and be inserted within a wall such that the surface of the socket is substantially flush with the wall. Housings 303, 305 may be integrated external to the housing 301. As illustrated in FIG. 3A, the smart outlet 102 includes a wireless communication functional module 304, USB charging functional modules 306, 308, and a combined sensor and user interface functional module 316 in addition to the plug outlet modules 204, 206, the indicator user interface functional modules 208, 210, the input user interface functional module 209.

Figure 3B:
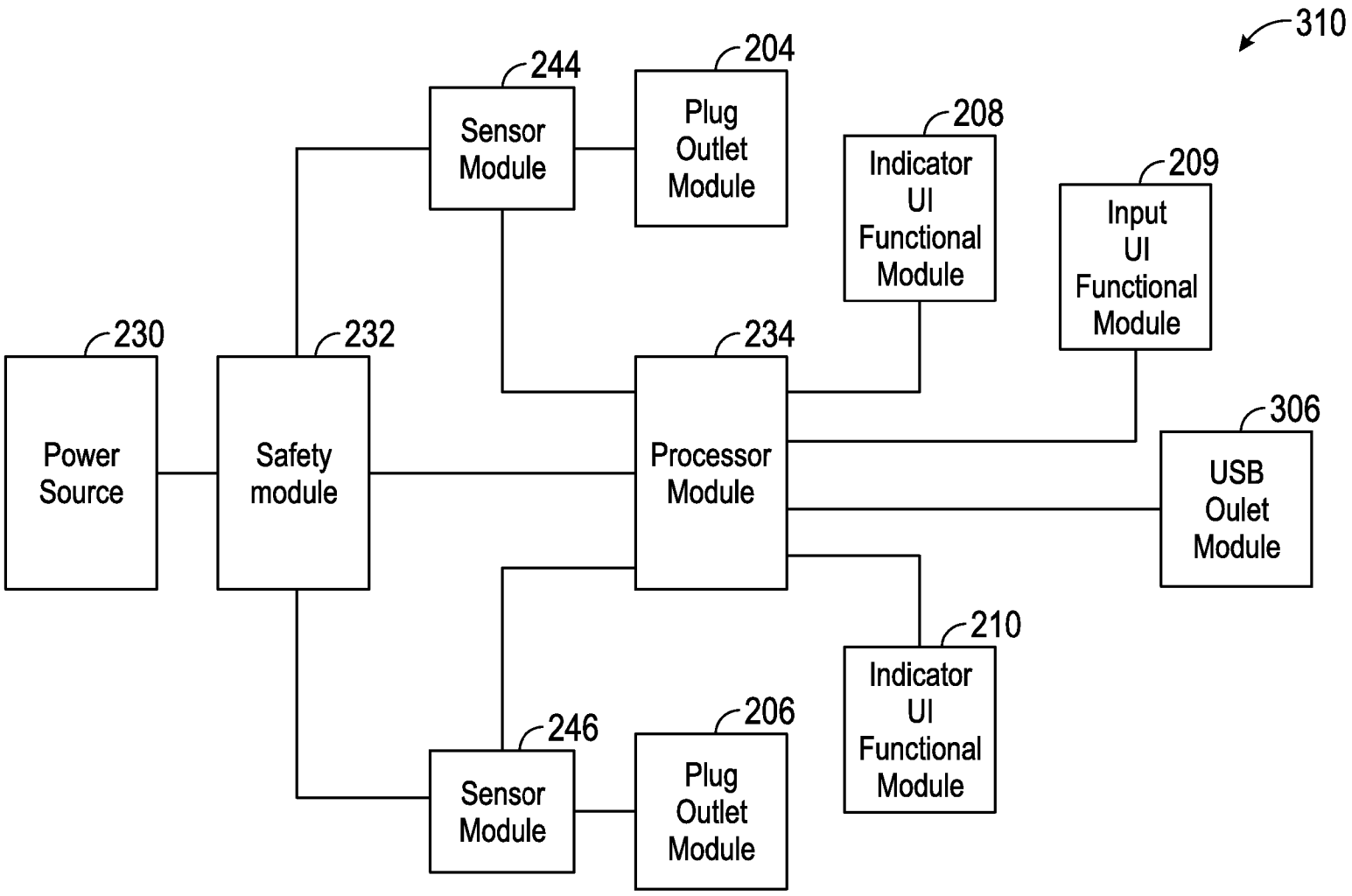
FIG. 3B is a block diagram illustrating an example of an embodiment of a smart outlet (for example, of FIG. 3A).

FIG. 3B is a block diagram 310 example of an embodiment of the smart outlet 300 of FIG. 3A without the wireless communication functional module 304 and the combined sensor and user interface functional module 316. The block diagram 310 is similar to the block diagram 228 of FIG. 2H but illustrates how the processor module 234 is connected with the USB outlet module 306. The USB outlet module 306 may provide power to an external device via the USB outlet module. The modules of the block diagram 310 are within the housing 301.

Figure 3C:
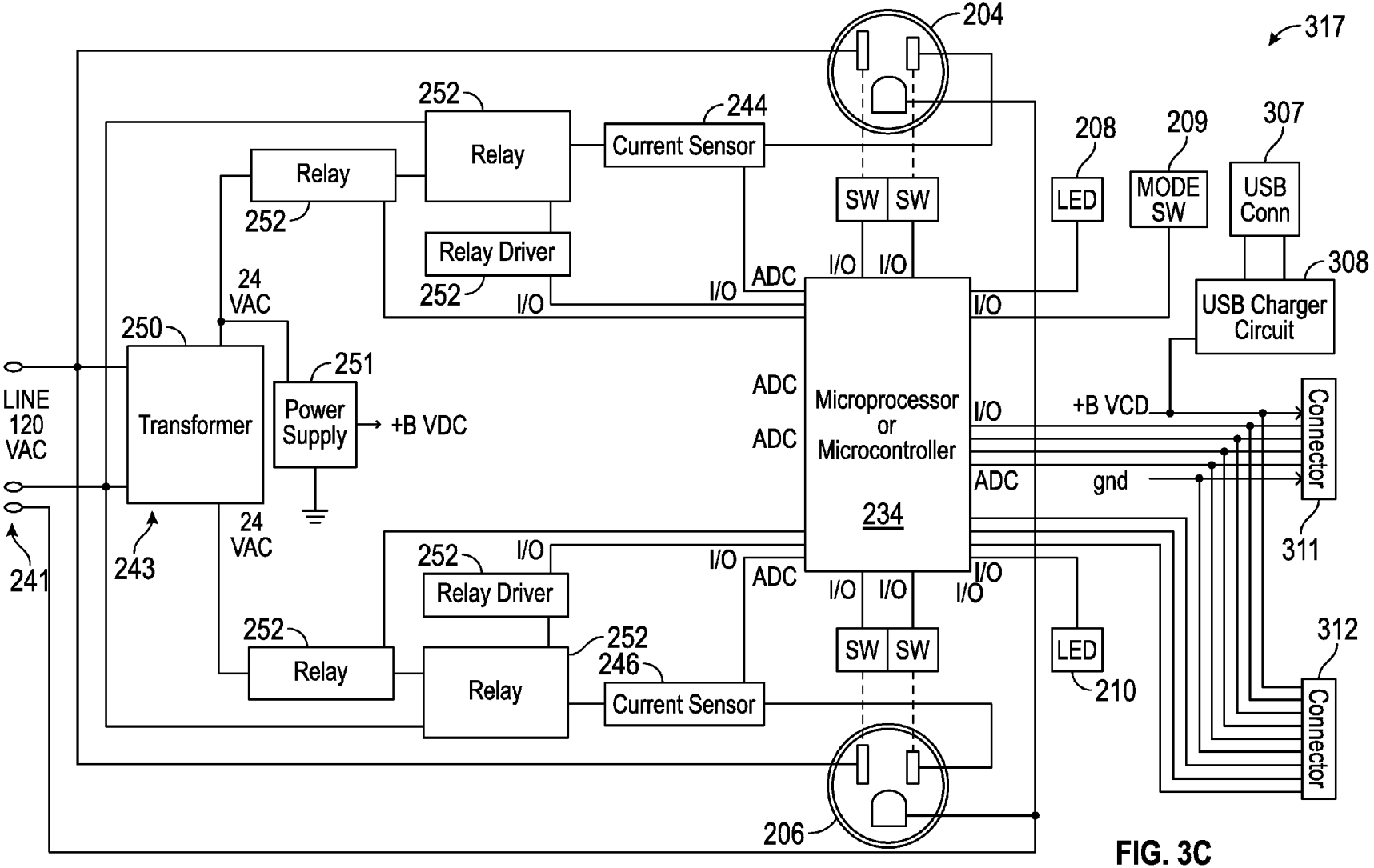
FIG. 3C is a schematic illustrating an example of an embodiment of a smart outlet (for example, of FIG. 3B).

FIG. 3C is a schematic 317 example of an embodiment of the block diagram 310 of FIG. 3B. The schematic 317 illustrates that the USB outlet module 306 (FIG. 3B) may include a USB interface/connector 307 and a USB charging circuit 308. The schematic 317 also illustrates two connectors 311, 312 that may be used to connect additional modules with the processor module 234. The connectors 311, 312 may be a five pin connector or a connector such that different modules can be connected and removed from the smart outlet in a modular fashion.

Figure 3D:
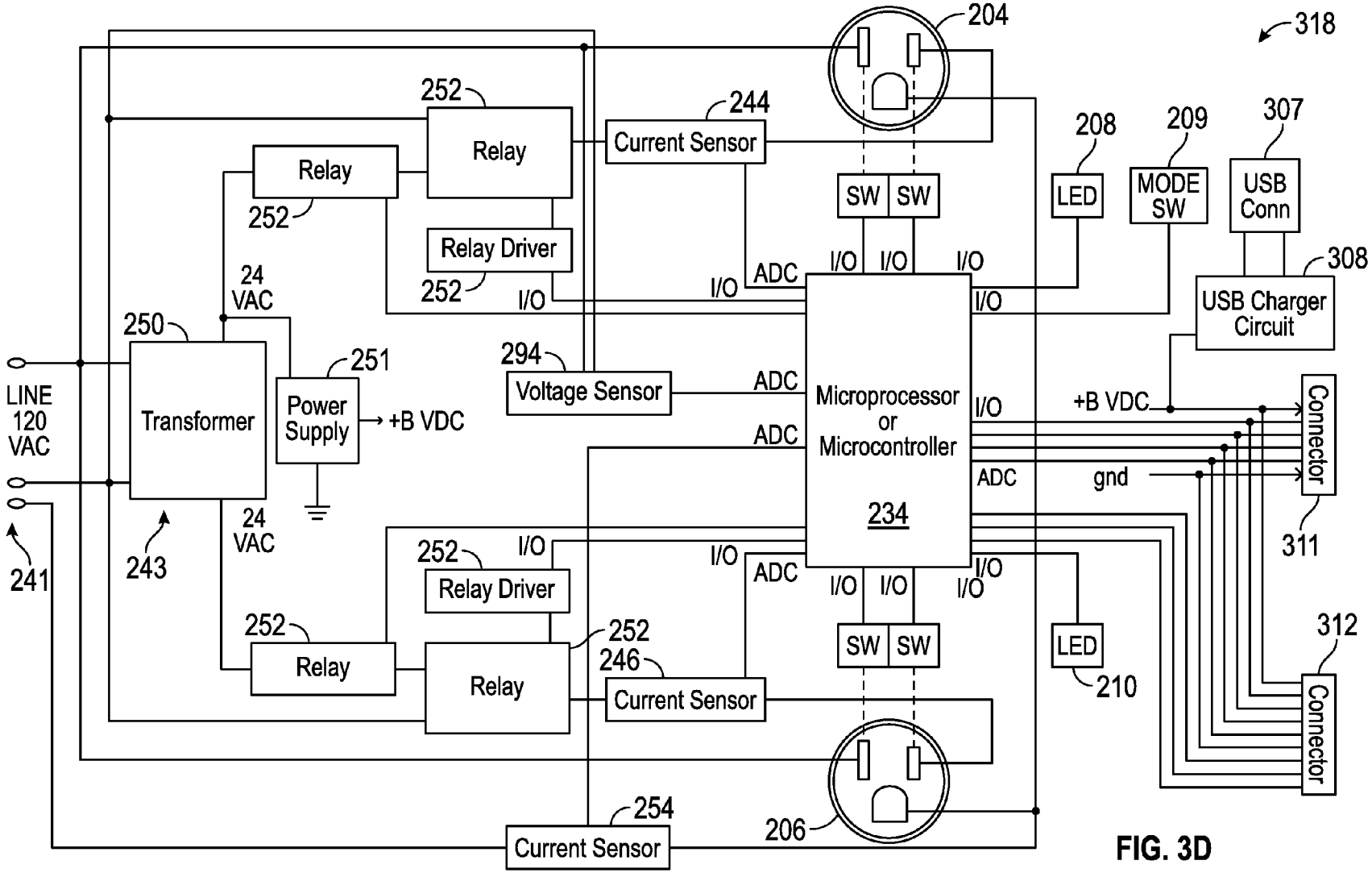
FIG. 3D is a schematic illustrating an example of an embodiment of a smart outlet (for example, of FIG. 3C).

FIG. 3D is a schematic 318 example of an embodiment of the block diagram 317 of FIG. 3C. The block diagram 318 illustrates that the processor module 234 is connected with the current sensor 254 and the voltage sensor 294 as discussed further in connection with FIG. 2J.

Figure 3E:
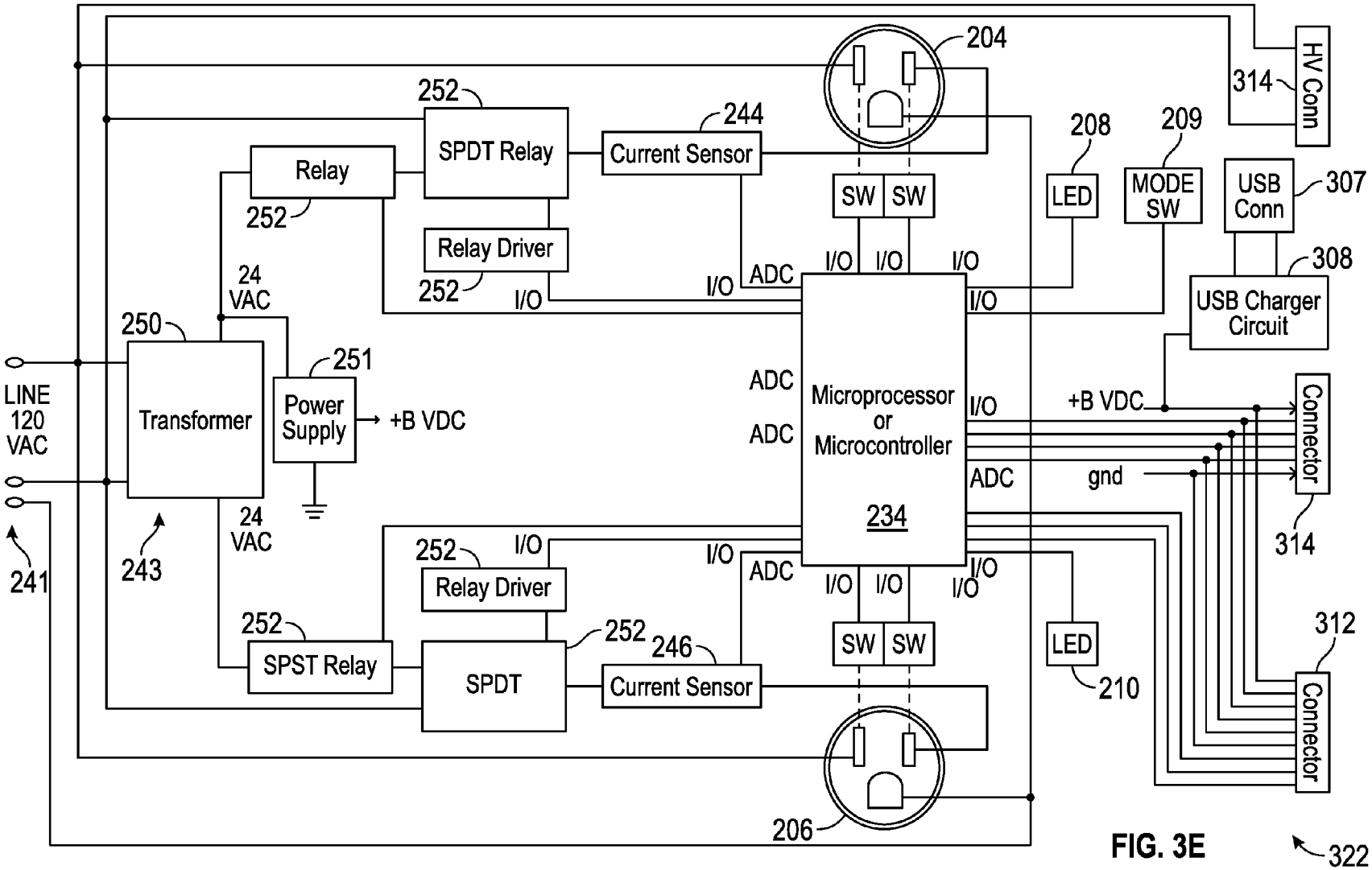
FIG. 3E is a schematic illustrating an example of an embodiment of a smart outlet that includes a power line communication.

FIG. 3E is a schematic 322 example of an embodiment of the block diagram 317 of FIG. 3C with power line communication. The schematic 322 illustrates how a power line communication connector 314 may be connected with the processor module 234, the safety module 232 and the high power input interface 241. The power line communication connector 314 may be used to expand the smart outlet 102 with additional modules that can utilize power line communication. Power line communication is a method of carrying data (via a modulated carrier signal) on a conductor that is also used simultaneously for AC electrical power transmission.

Figure 3F:
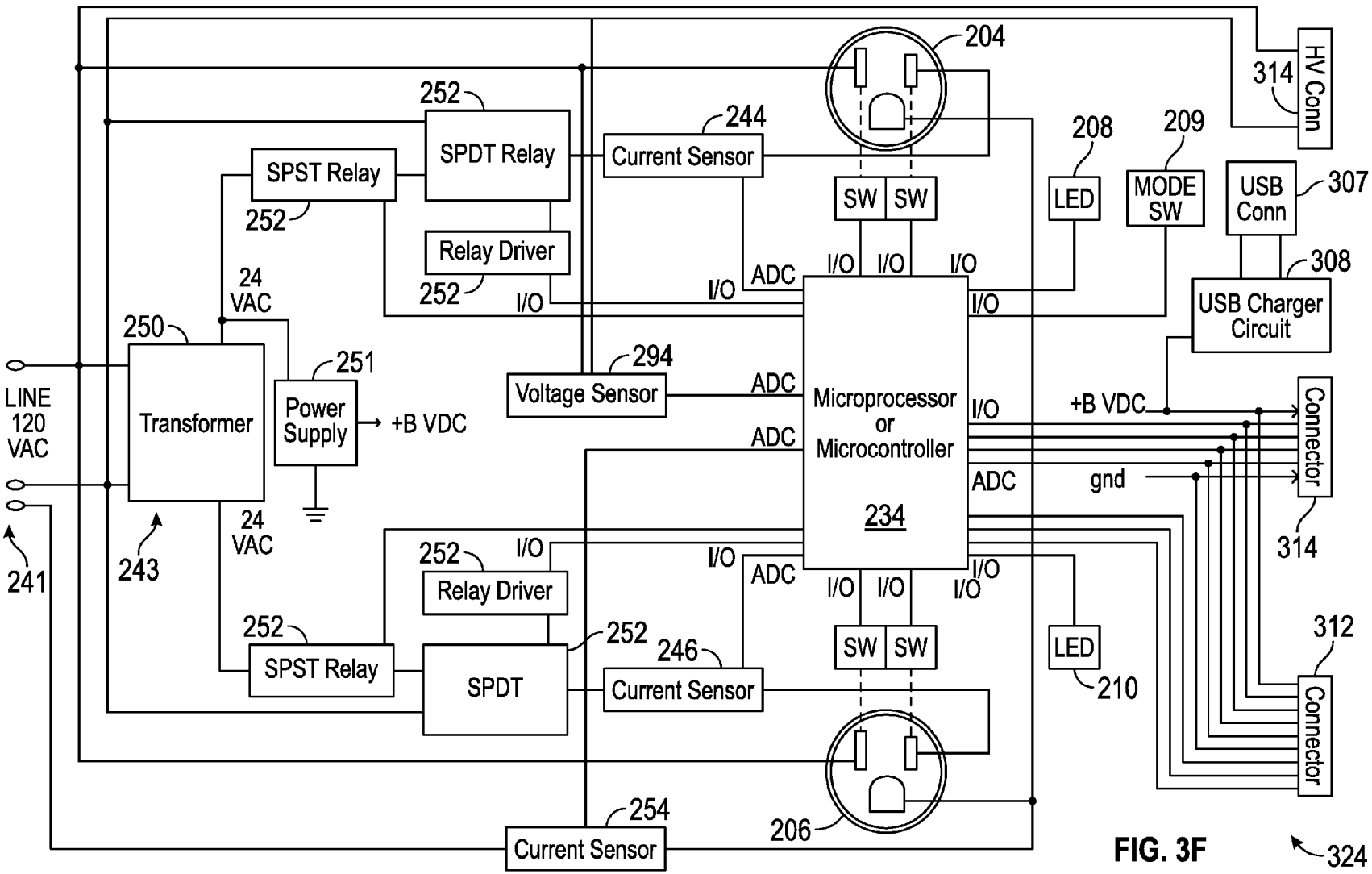
FIG. 3F is a schematic illustrating an example of an embodiment of a smart outlet (for example, of FIG. 3E).

FIG. 3F is a schematic 324 example of an embodiment of the schematic 322 of FIG. 3E. The block diagram 324 illustrates the processor module 234 connected with the additional current sensor 254 and the additional voltage sensor 294 as discussed further in connection with FIG. 2J.

Figure 3G:
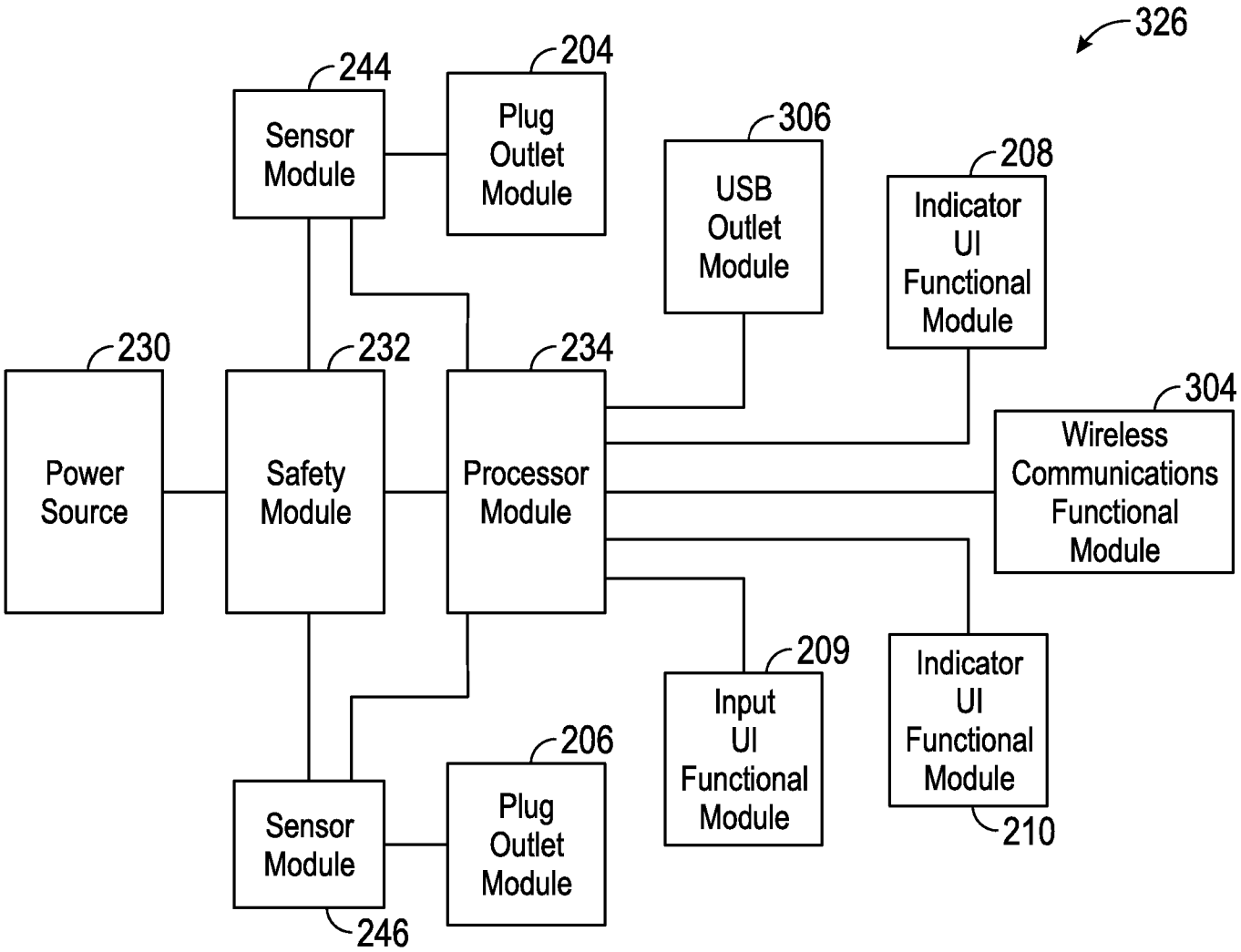
FIG. 3G is a block diagram illustrating an example of an embodiment of a smart outlet (for example, of FIG. 2A).

FIG. 3G is a block diagram 326 example of an embodiment of the smart outlet 300 of FIG. 3A without the combined sensor and user interface functional module 316. The block diagram 326 is similar to the block diagram 310 of FIG. 3B but illustrates how the wireless communications functional module 304 may be connected with the processor module 234. The wireless communications functional module 304 may provide sources of data input and output from over a wireless network for the processor module 234 to use in controlling the smart outlet. Also, the wireless communications functional module 304 may be within the housing 303. The housing 303 may be connected with the housing 301.

Figures 1, 3H:
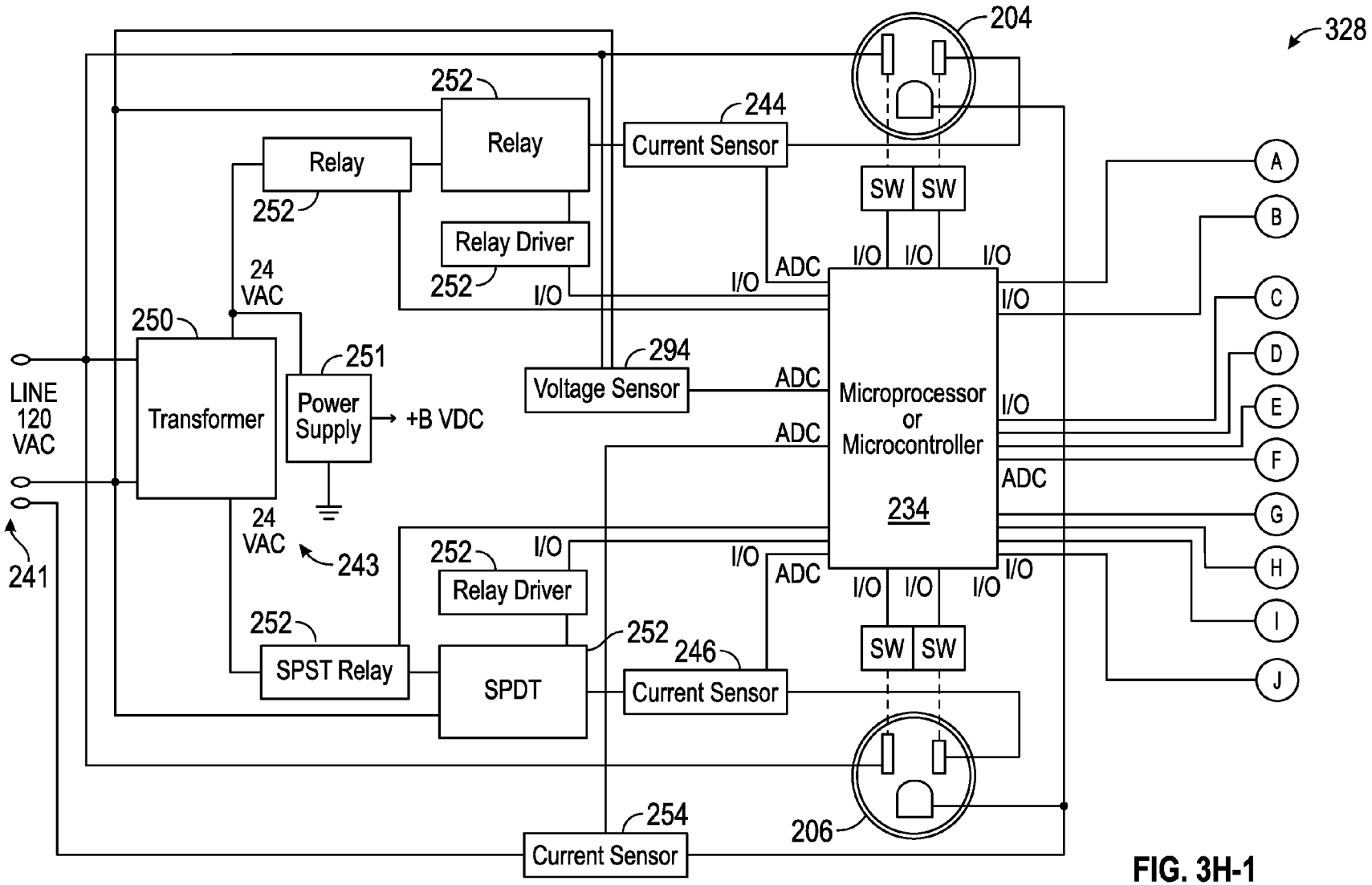
Figures 2, 3H:
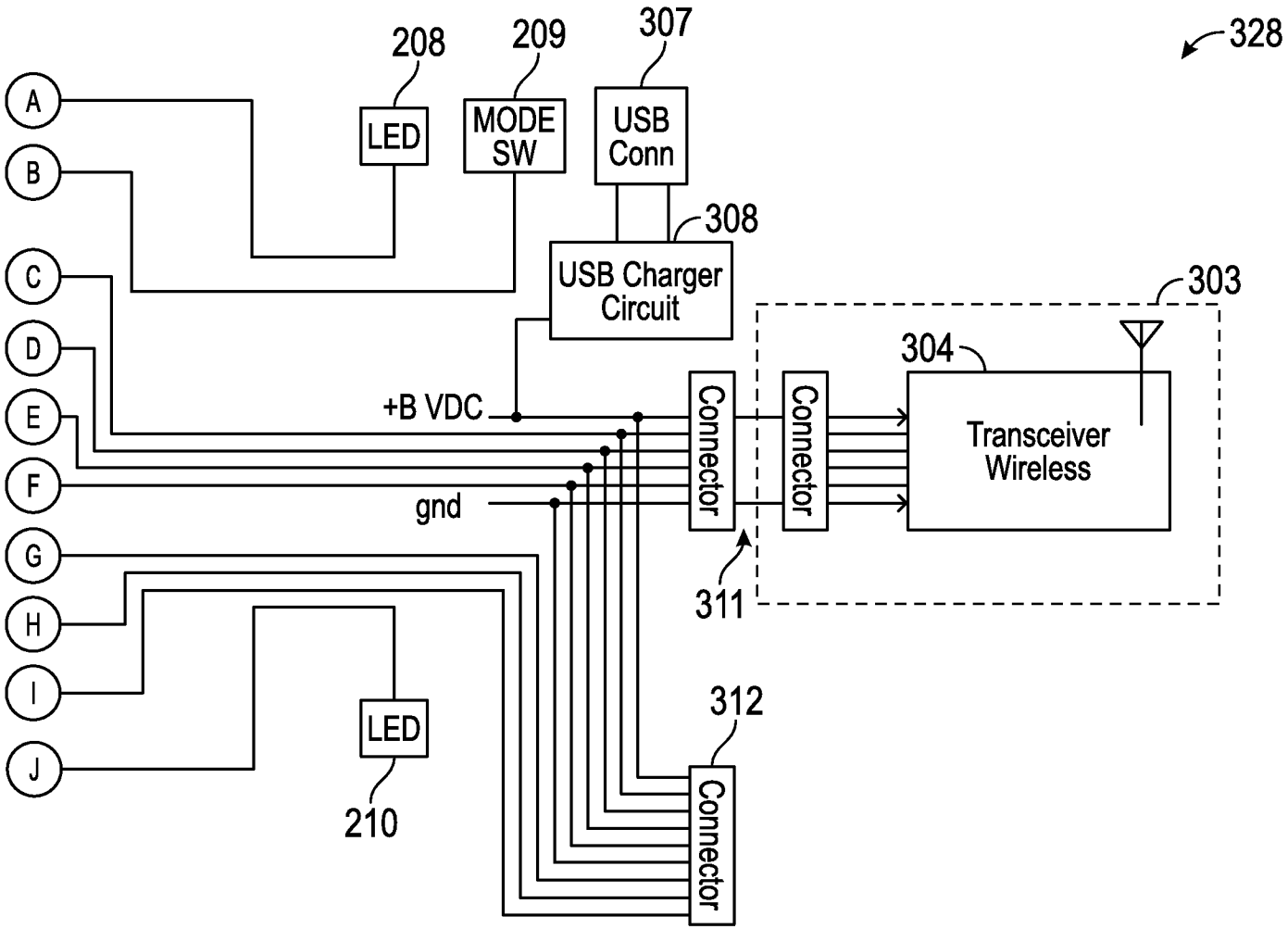

FIGS. 3H-2 and 3H-2 are a schematic 328 example of an embodiment of the block diagram 326 of FIG. 3G. The schematic 328 illustrates how the wireless communications module 304 is connected with the processor module 234. Also, the schematic 328 illustrates how the connector 311 connects the wireless communications module 304 with the processor module 234. Points A, B, C, D, E, F, G, H, I, and J on FIG. 3H-1 connect with same points A, B, C, D, E, F, G, H, I, and J on FIG. 3H-2.

Figure 3I:
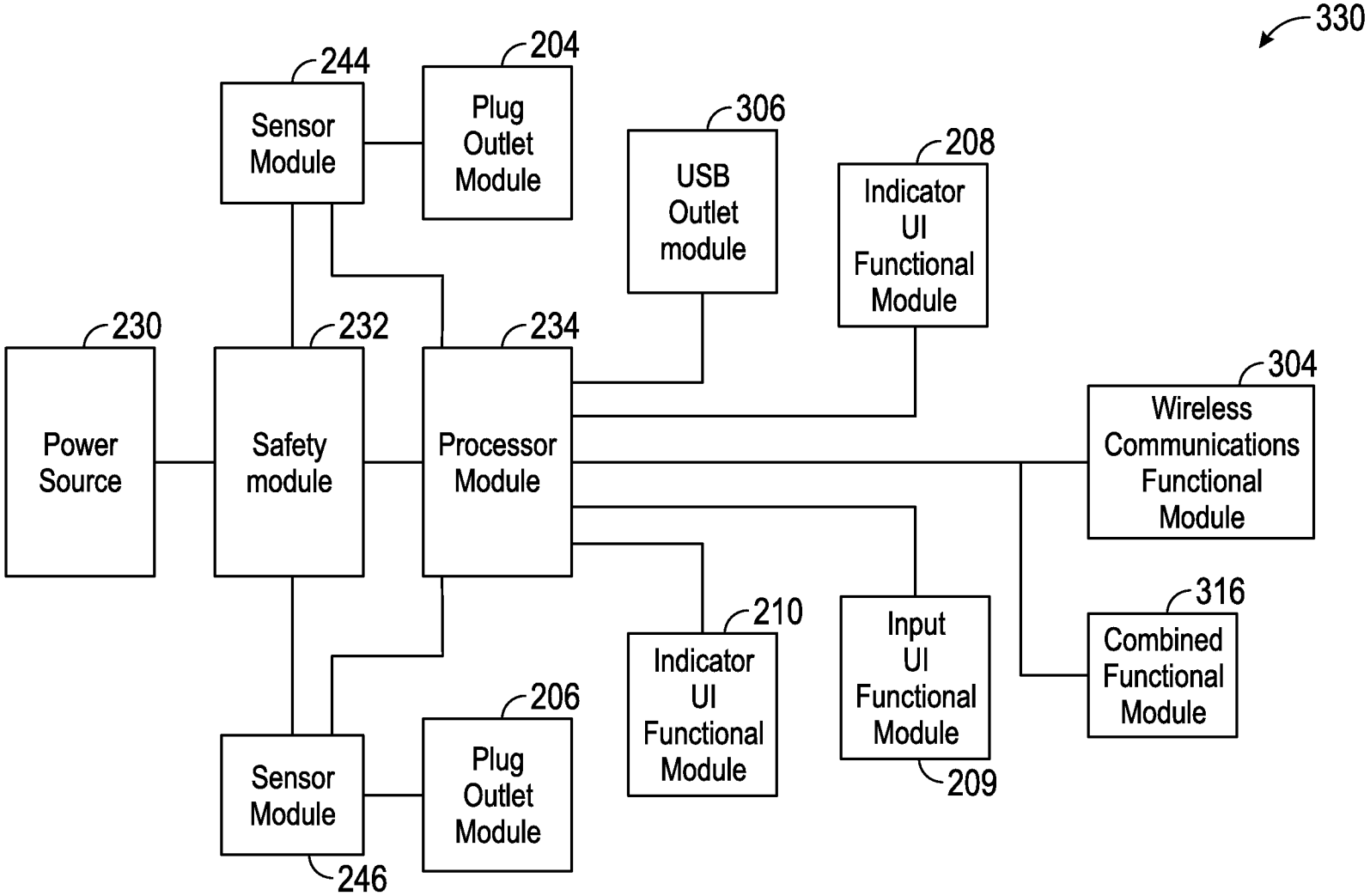
FIG. 3I is a block diagram illustrating an example of an embodiment of the smart outlet (for example, of FIG. 3A).

FIG. 3I is a block diagram 330 example of an embodiment of the smart outlet 300 of FIG. 3A. The block diagram 330 is similar to the block diagram 326 of FIG. 3G but illustrates the combined sensor and user interface functional module 316 connected with the processor module 234.

Figures 1, 3J:
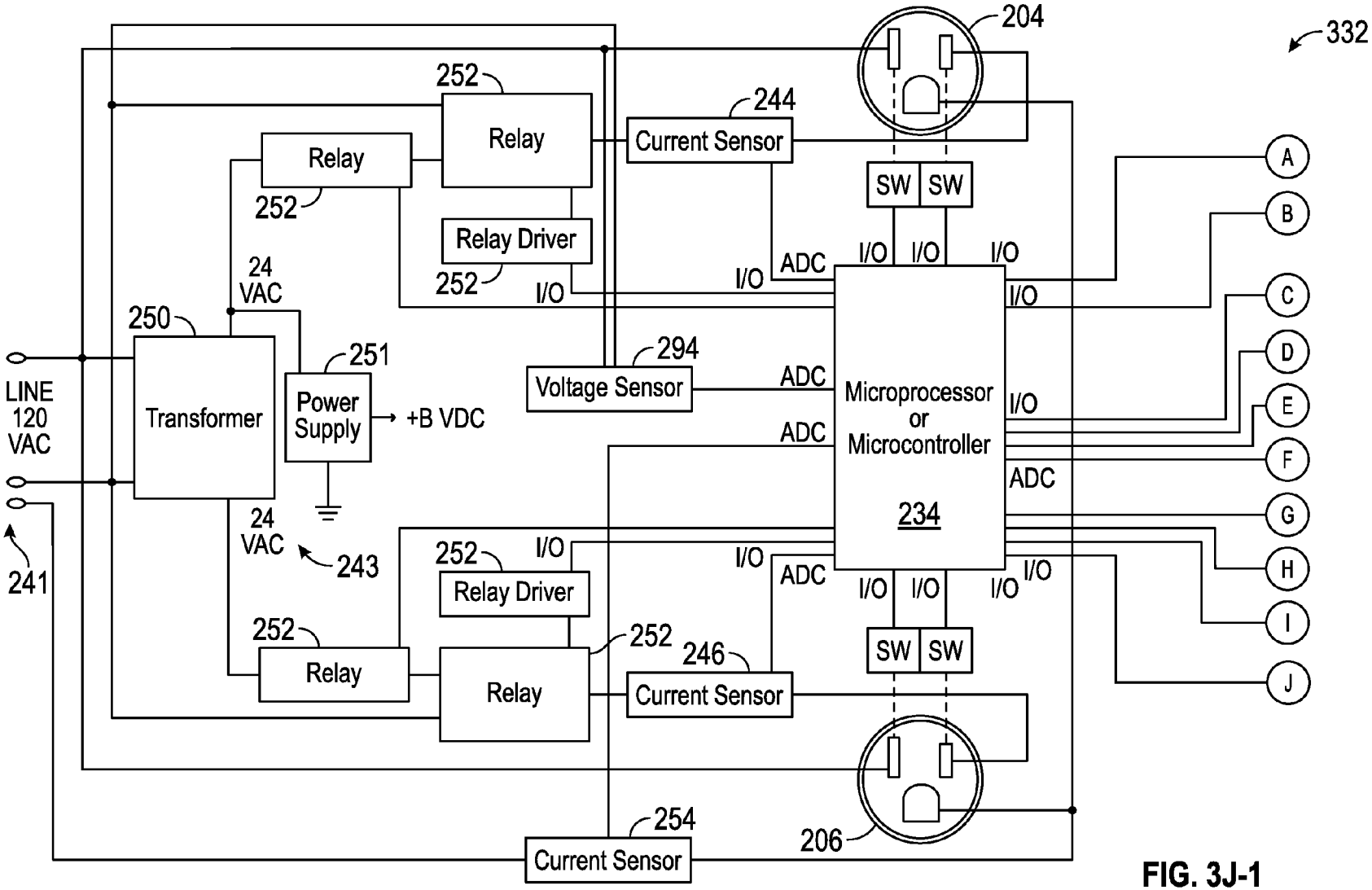
Figures 2, 3J:
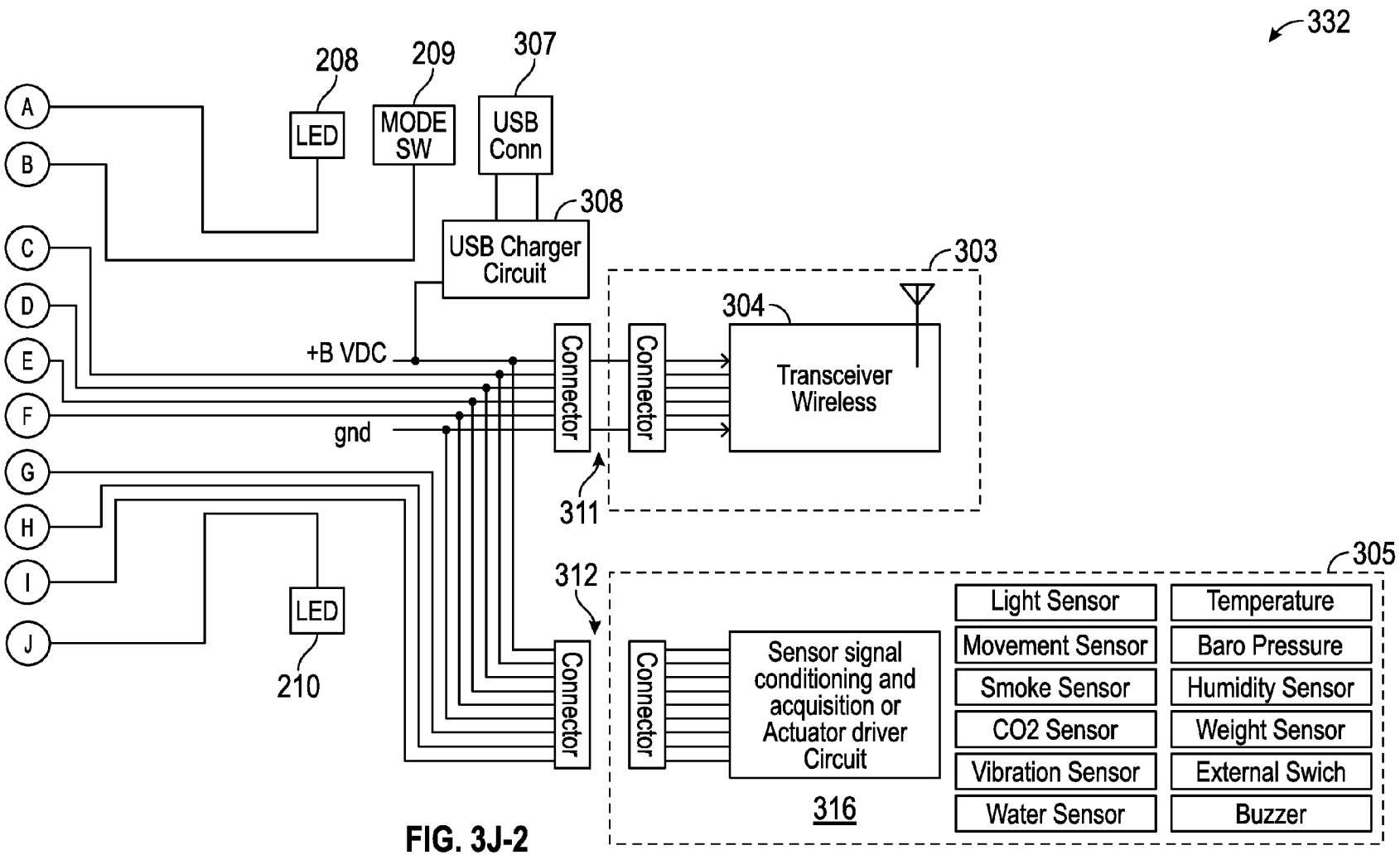

FIGS. 3J-1 and 3J-2 are a schematic 332 example of an embodiment of the block diagram 330 of FIG. 3I. The schematic 332 illustrates how the combined sensor and user interface functional module 316 is connected with the processor module 234. Also, the schematic 332 illustrates how the connector 312 connects the combined sensor and user interface functional module 316 with the processor module 234. Furthermore, the combined sensor and user interface functional module 316 may be within the housing 305 connected with the housing 301. Points A, B, C, D, E, F, G, H, I, and J on FIG. 3J-1 connect with same points A, B, C, D, E, F, G, H, I, and J on FIG. 3J-2.

Figure 3K:
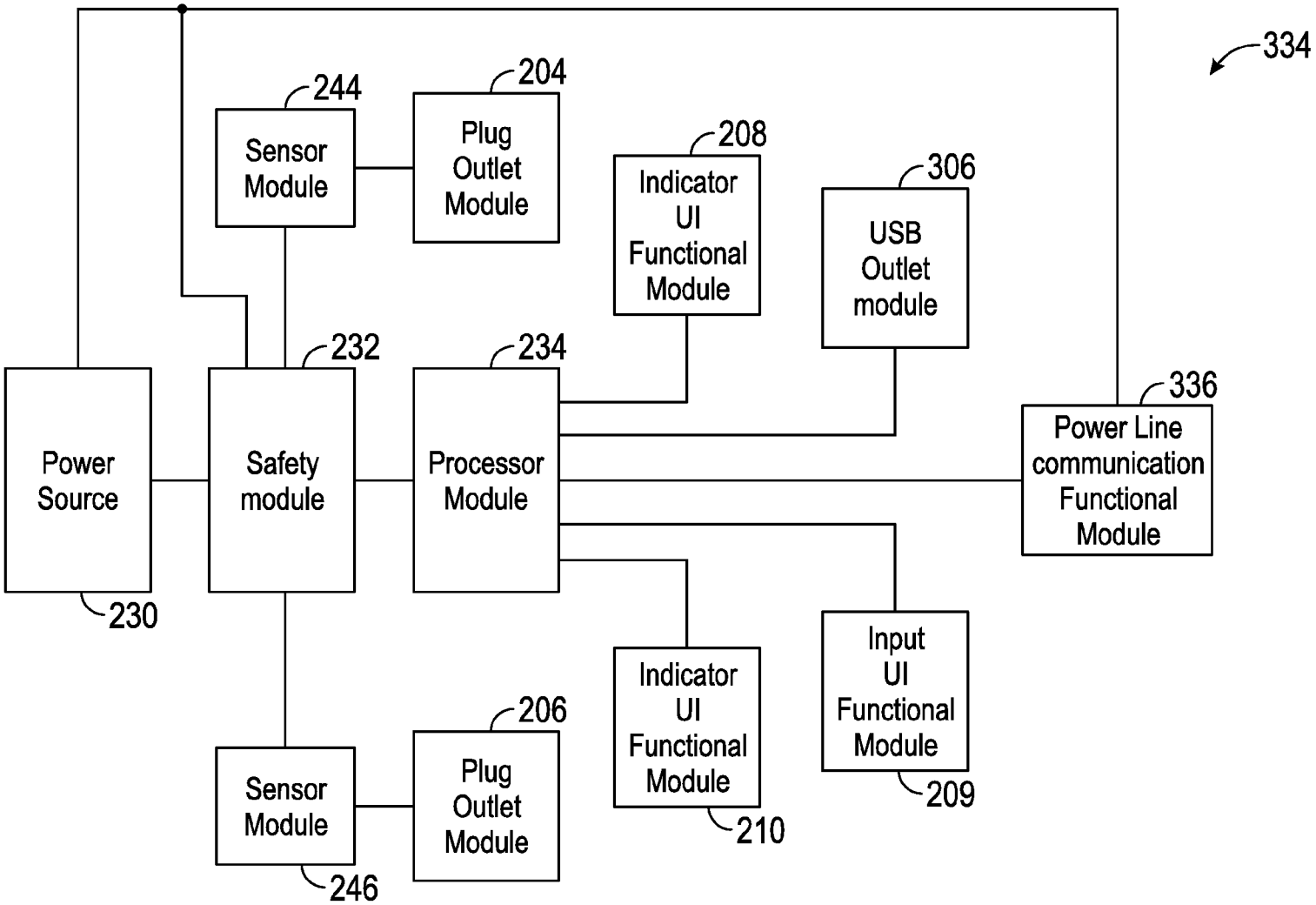
FIG. 3K is a schematic illustrating an example of an embodiment of the smart outlet of FIG. 3A having a power line communication functional module.

FIG. 3K is a block diagram 334 example of an embodiment of the smart outlet 300 of FIG. 3A with a power line communication functional module. The block diagram 334 is similar to the block diagram 326 of FIG. 3G but illustrates the power line communication functional module 336 in lieu of the wireless communications functional module 304. The power line communication functional module 336 may be connected with the processor module 234, safety module 232 and the high power input interface 241 to provide sources of data input and output from over a wireless network for the processor module 234 to use in controlling the smart outlet.

Figures 1, 3L:
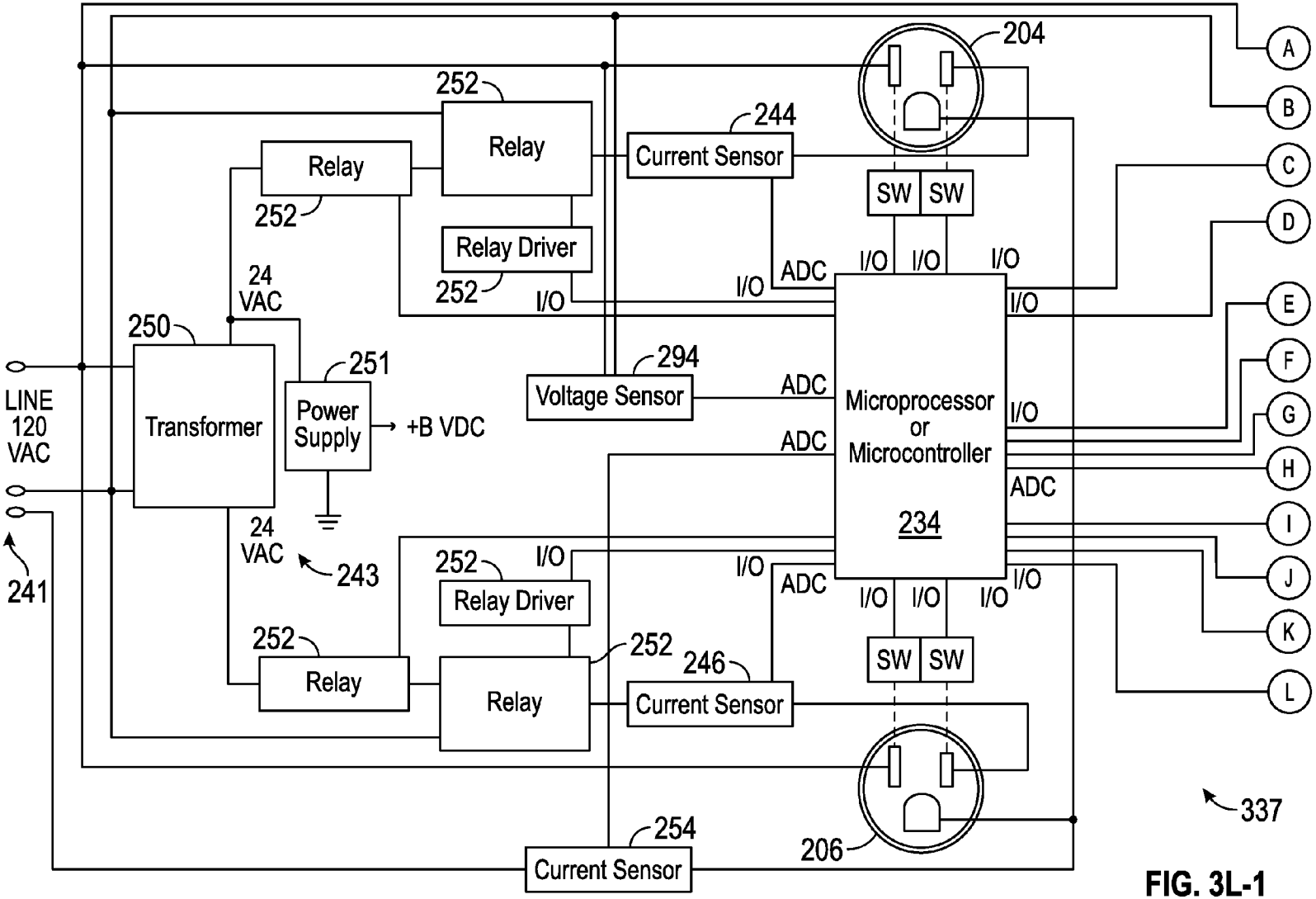
Figures 2, 3L:
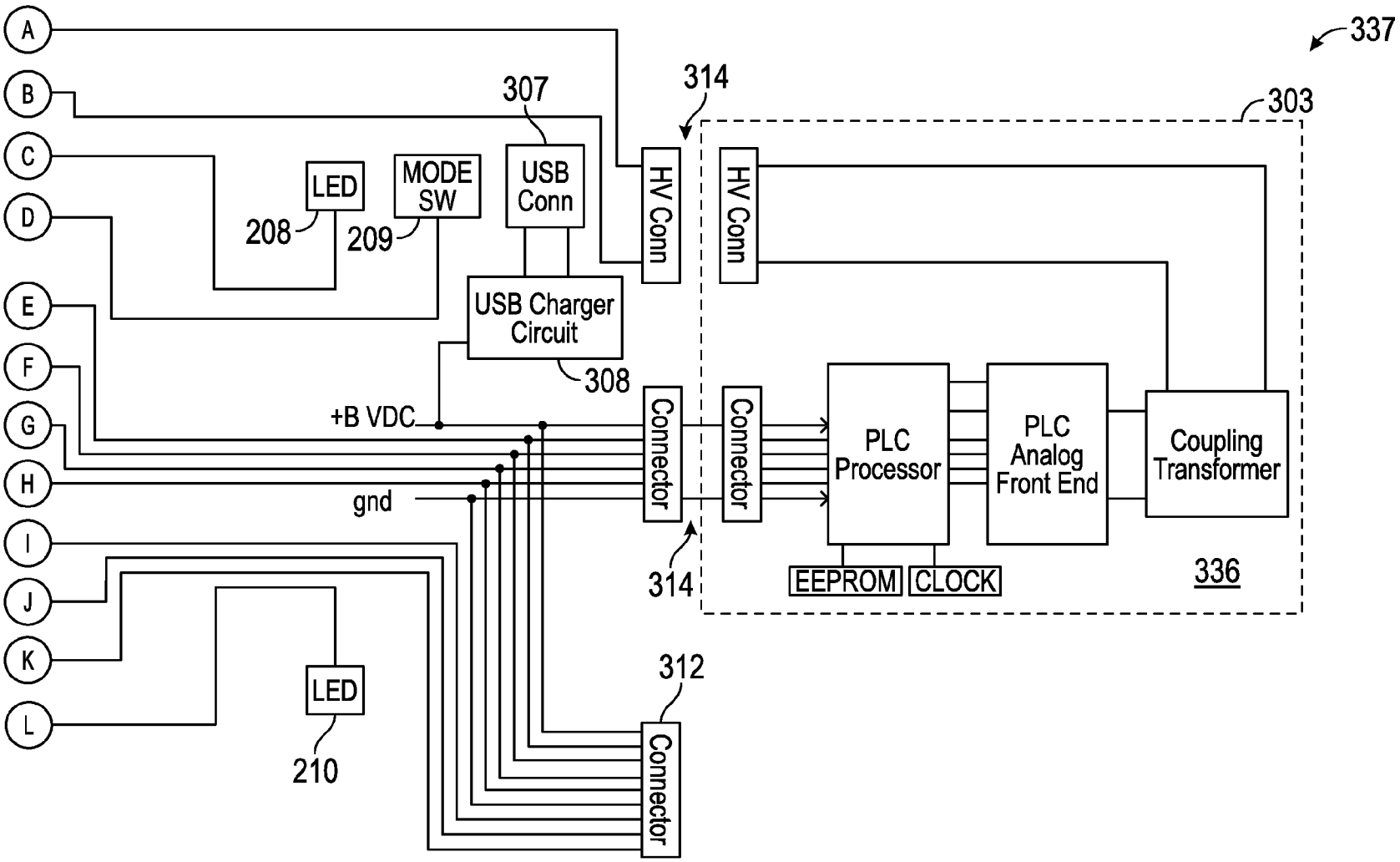

FIGS. 3L-1 and 3L-2 are a schematic 337 example of an embodiment of the block diagram 334 of FIG. 3K. The block diagram 337 is similar to the block diagram 328 of FIGS. 3H-1 and 3H-2 but illustrates how the power line communication functional module 336 is connected with the processor module 234, the safety module 232 and the high power input interface 241. The block diagram 337 also illustrates how the power line communication function module 336 is connected with the power line communication connector 314. Furthermore, the power line communication function module 336 may be within the housing 303 connected with the housing 301. Points A, B, C, D, E, F, G, H, I, J, K, and L on FIG. 3L-1 connect with same points A, B, C, D, E, F, G, H, I, J, K, and L on FIG. 3L-2.

Figure 3M:
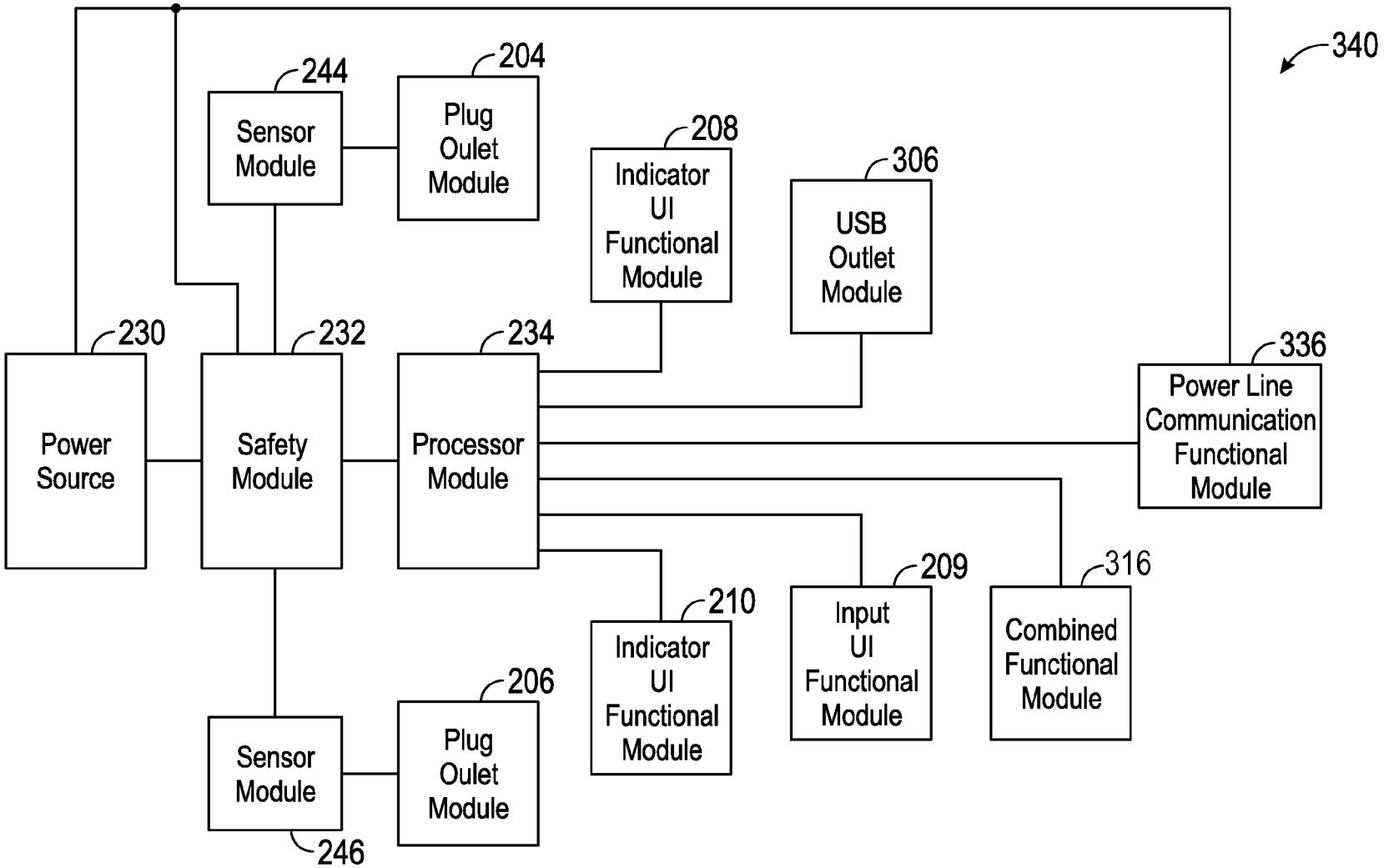
FIG. 3M is a block diagram illustrating an example of an embodiment of the smart outlet of FIG. 3A with a power line communication functional module and the combined sensor and user interface functional module.

FIG. 3M is a block diagram 340 example of an embodiment of the smart outlet 300 of FIG. 3A with a power line communication functional module 336 and the combined sensor and user interface functional module 316. The block diagram 340 is similar to the block diagram 334 of FIG. 3K but illustrates the combined sensor and user interface functional module 316 connected with the processor module 234.

Figures 1, 3N:
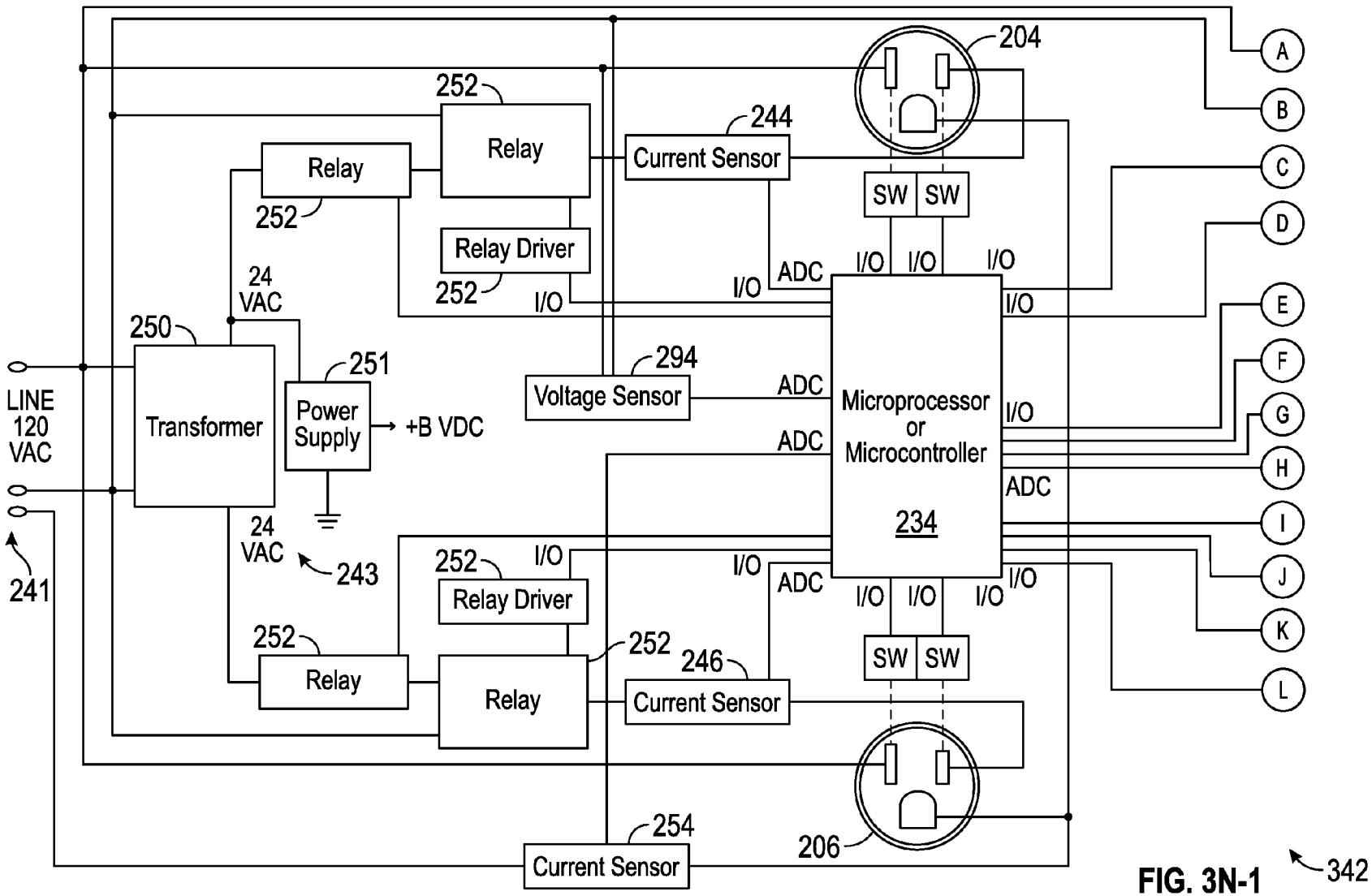
Figures 2, 3N:
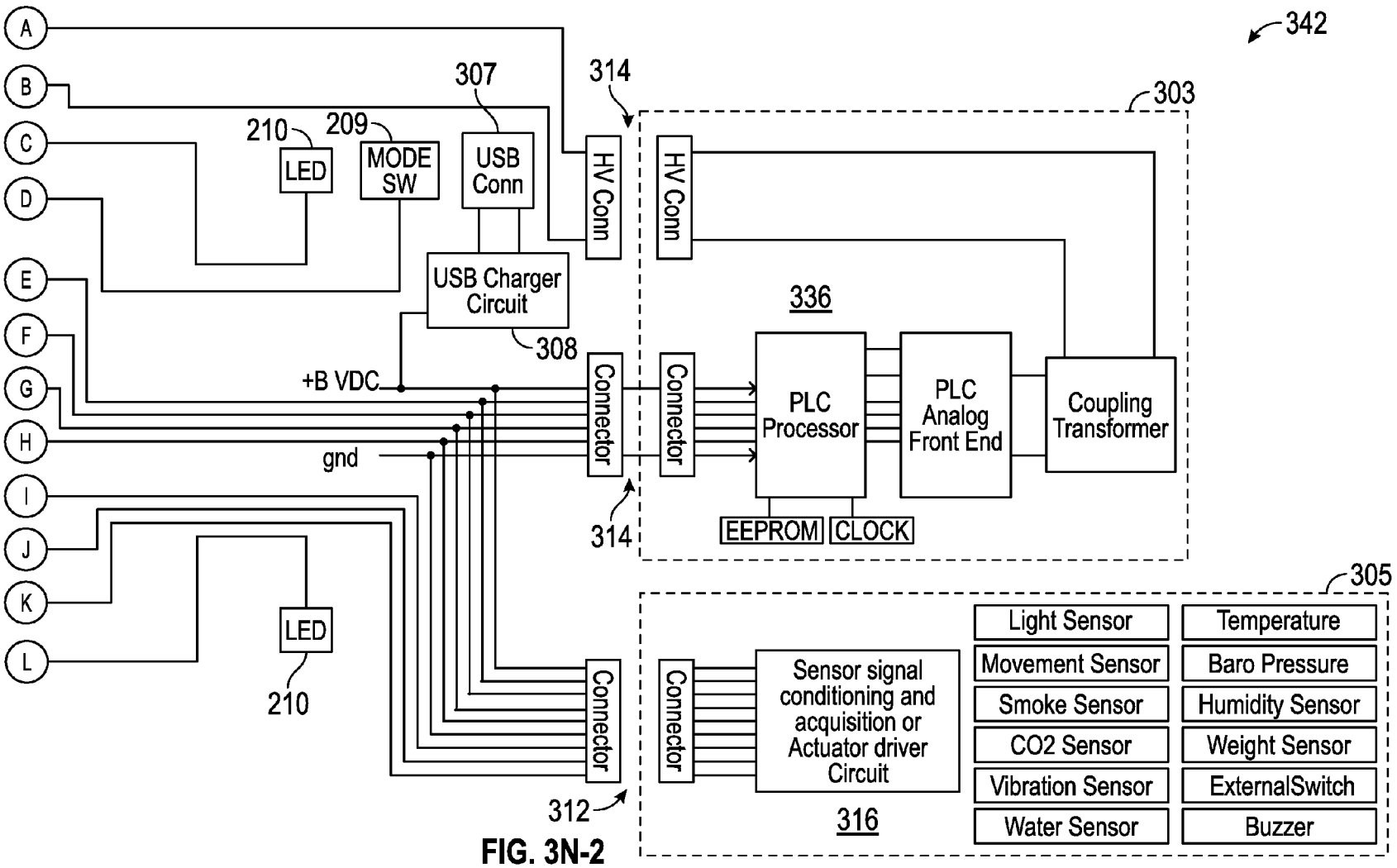

FIGS. 3N-1 and 3N-2 are a schematic 342 example of an embodiment of the block diagram 340 of FIG. 3M in accordance with an exemplary embodiment. The block diagram 342 is similar to the block diagram 337 of FIGS. 3L-1 and 3L-2 but illustrates how the combined sensor and user interface functional module 316 is connected with the processor module 234 via the connector 312. Furthermore, the combined sensor and user interface functional module 316 may be within the housing 305 connected with the housing 301. Points A, B, C, D, E, F, G, H, I, J, K, and L on FIG. 3N-1 connect with same points A, B, C, D, E, F, G, H, I, J, K, and L on FIG. 3N-2.

Figure 4A:
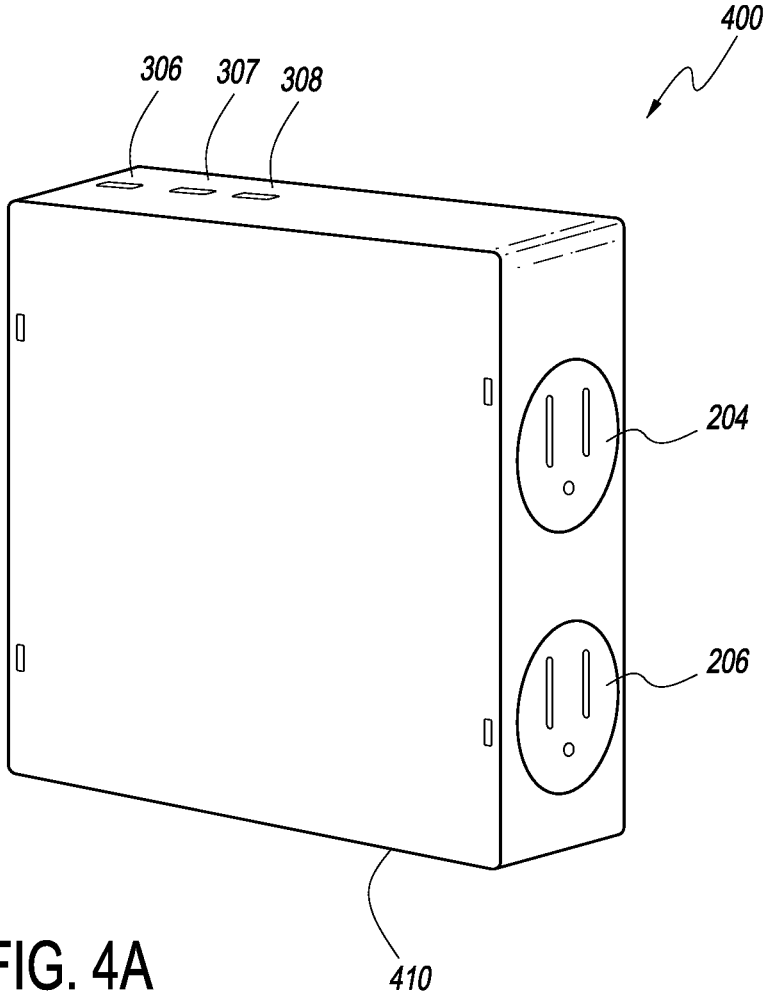
FIG. 4A is perspective view illustrating an example of an embodiment of a smart outlet (for example, of FIG. 1A) in a housing.

In certain embodiments, smart outlet 102 may have a single housing that may interface with a wall socket and be external to the wall socket. FIG. 4A is an illustration of an exemplary embodiment 400 the modular shock proof electrical 102 outlet of FIG. 1A with a housing 410 that may be located external to a wall socket. In the smart outlet 400 of FIG. 4A, two plug outlet modules 204, 206 and three USB outlet modules 306, 307, 308 are illustrated.

Figures 1, 4B:
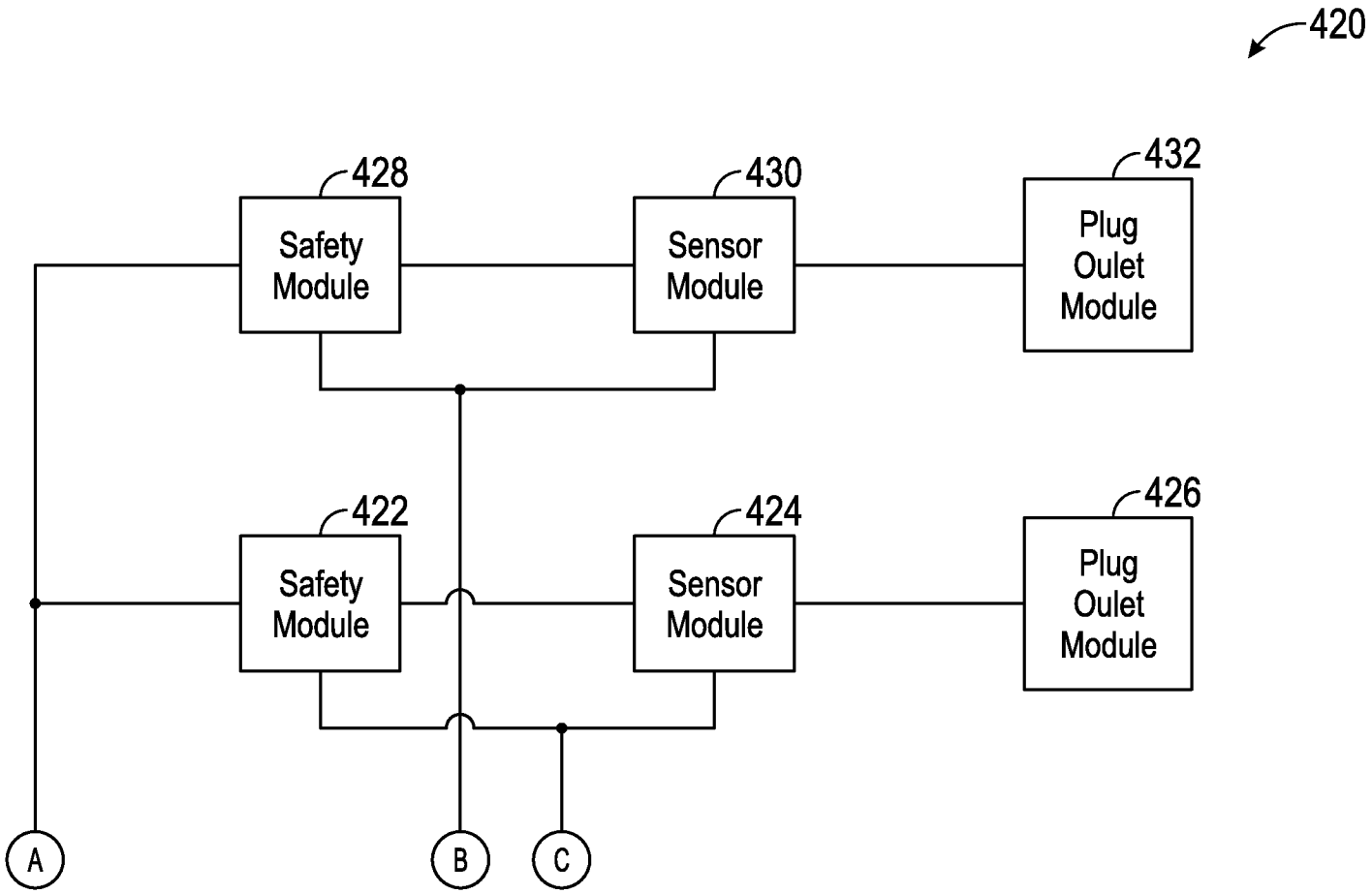
Figures 2, 4B:
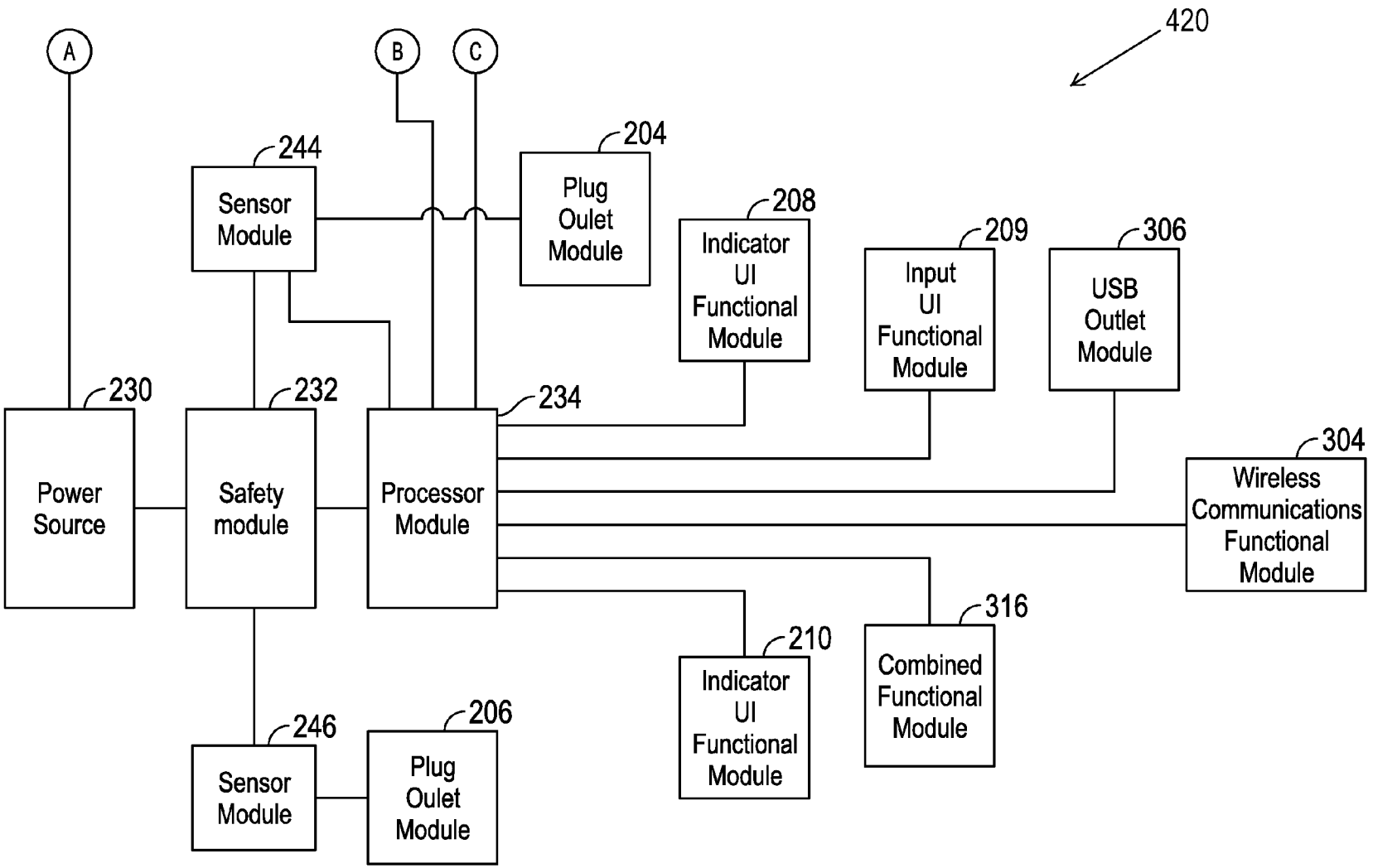
Figures 1, 4C:
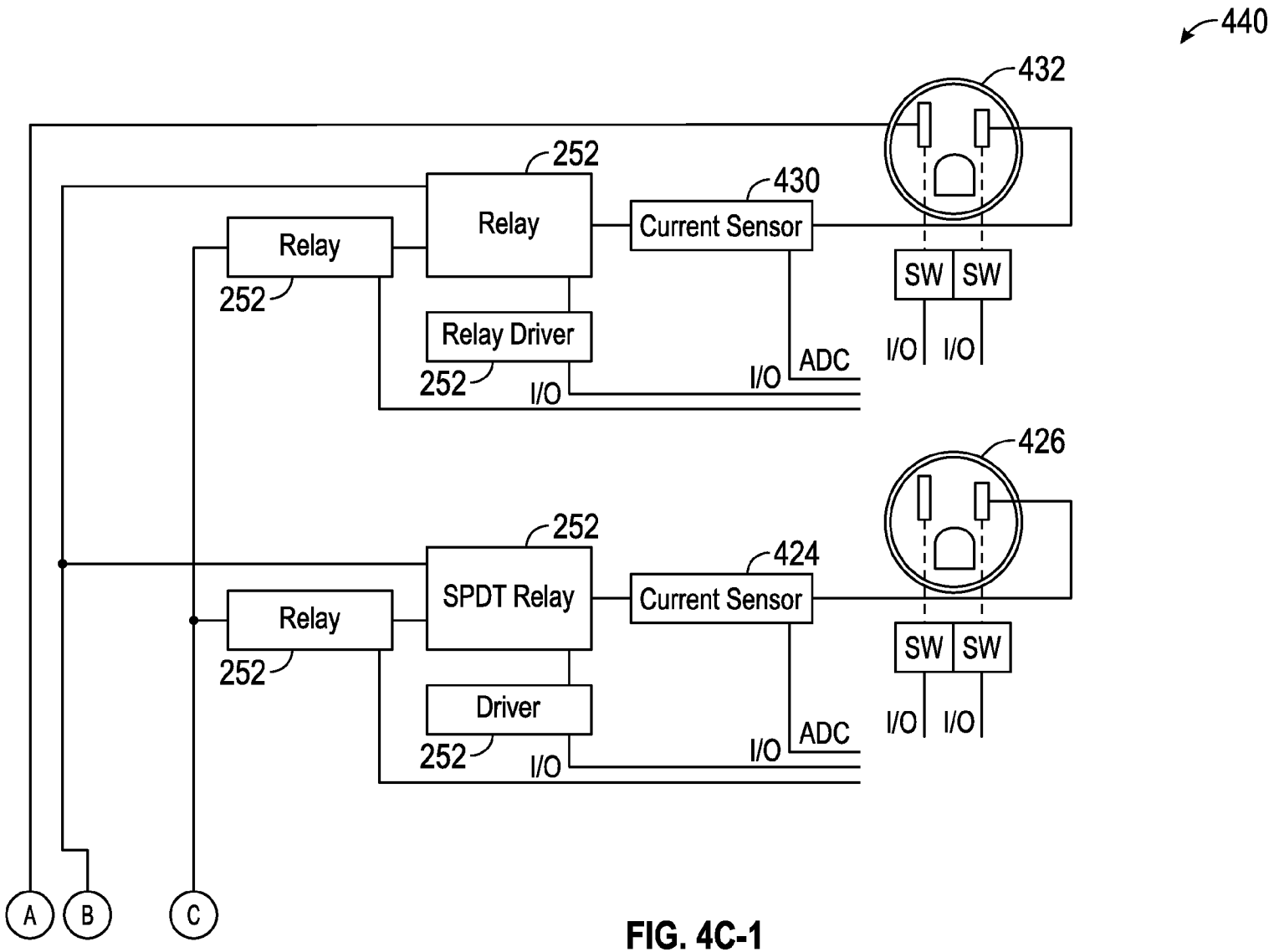
Figures 2, 4C:
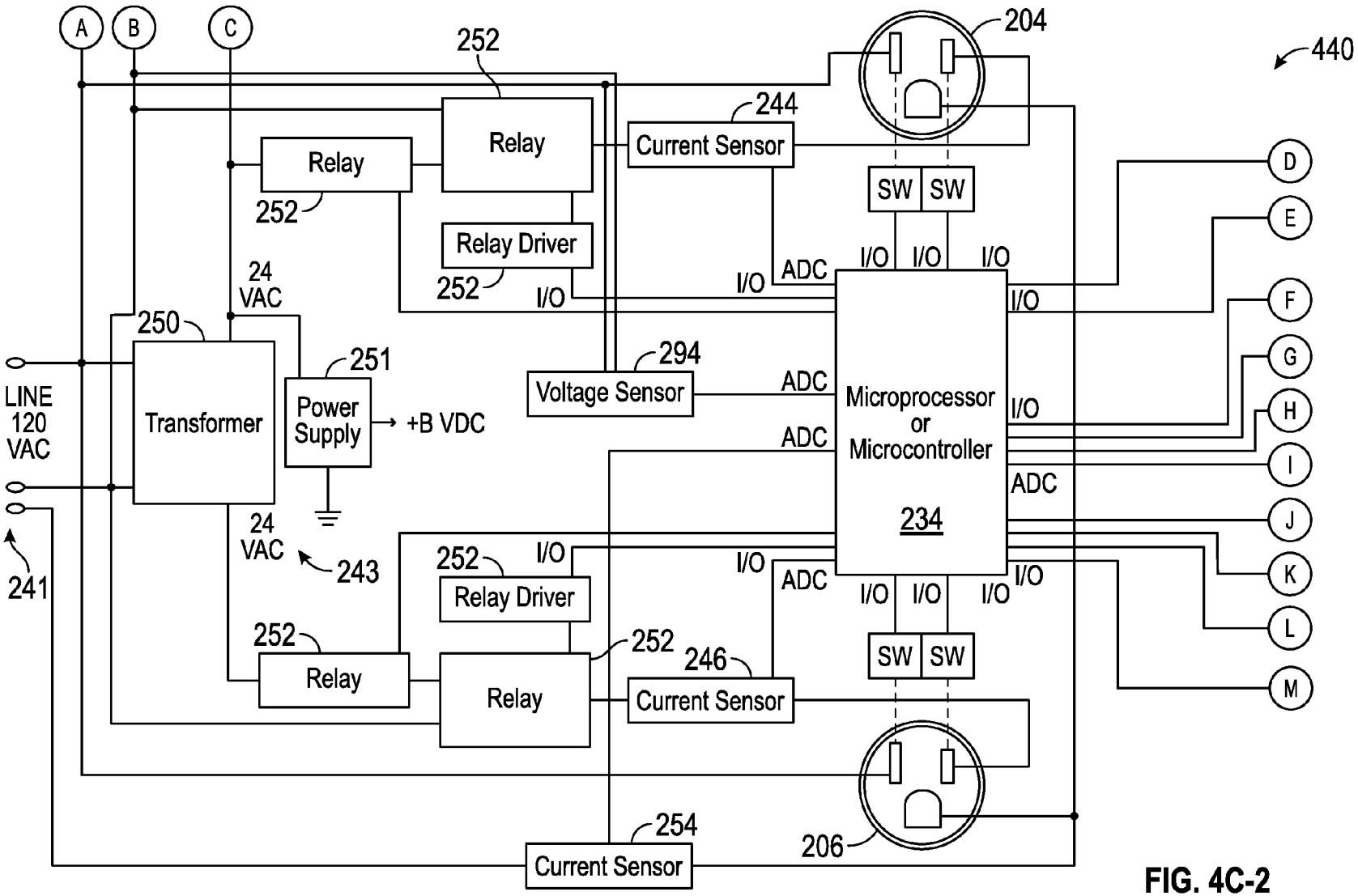
Figures 3, 4C:
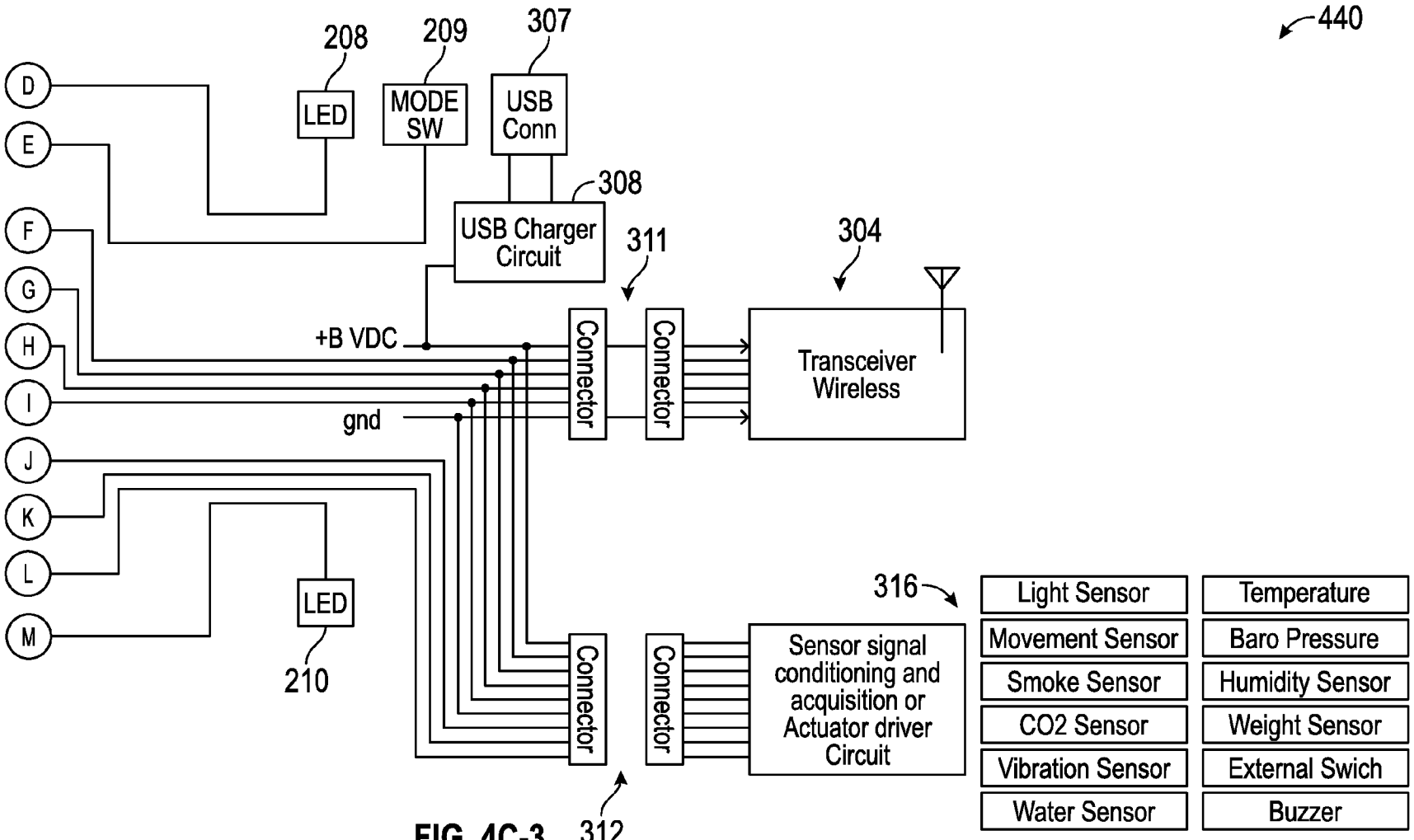

FIGS. 4B-1 and 4B-2 are a block diagram 420 example of an embodiment of the smart outlet of FIG. 4A. The block diagram 420 is similar to the block diagram 330 of FIG. 3I but includes additional safety modules 428, 422, sensor modules 430, 424, and plug outlet modules 432, 426. The safety modules 422, 428 may be connected with the power source 230, and the processor module 234. The sensor modules 430, 424 may both be connected with the processor module 234 and either the safety module 428 and plug outlet module 432 or the safety module 422 and the plug outlet module 426. Thereby, the processor module 234 may control the safety modules 422 and 428 based upon the readings of the sensor modules 430, 424. Points A, B, and C on FIG. 4B-1 connect with same points A, B, and C on FIG. 4B-2.

FIGS. 4C-1, 4C-2, and 4C-3 are a schematic 440 example of an embodiment of the block diagram 420 of FIGS. 4B-1 and 4B-2 in accordance with an exemplary embodiment. The block diagram 440 is similar to the block diagram 332 of FIGS. 3J-1 and 3J-2 and illustrates how the safety modules 422, 428 may include relays 252. Points A, B, and C on FIG. 4C-1 connect with same points A, B, and C on FIG. 4C-2. Points D, E, F, G, H, I, J, K, L, and M on FIG. 4C-2 connect with same points D, E, F, G, H, I, J, K, L, and M on FIG. 4C-3.

Figure 5A:
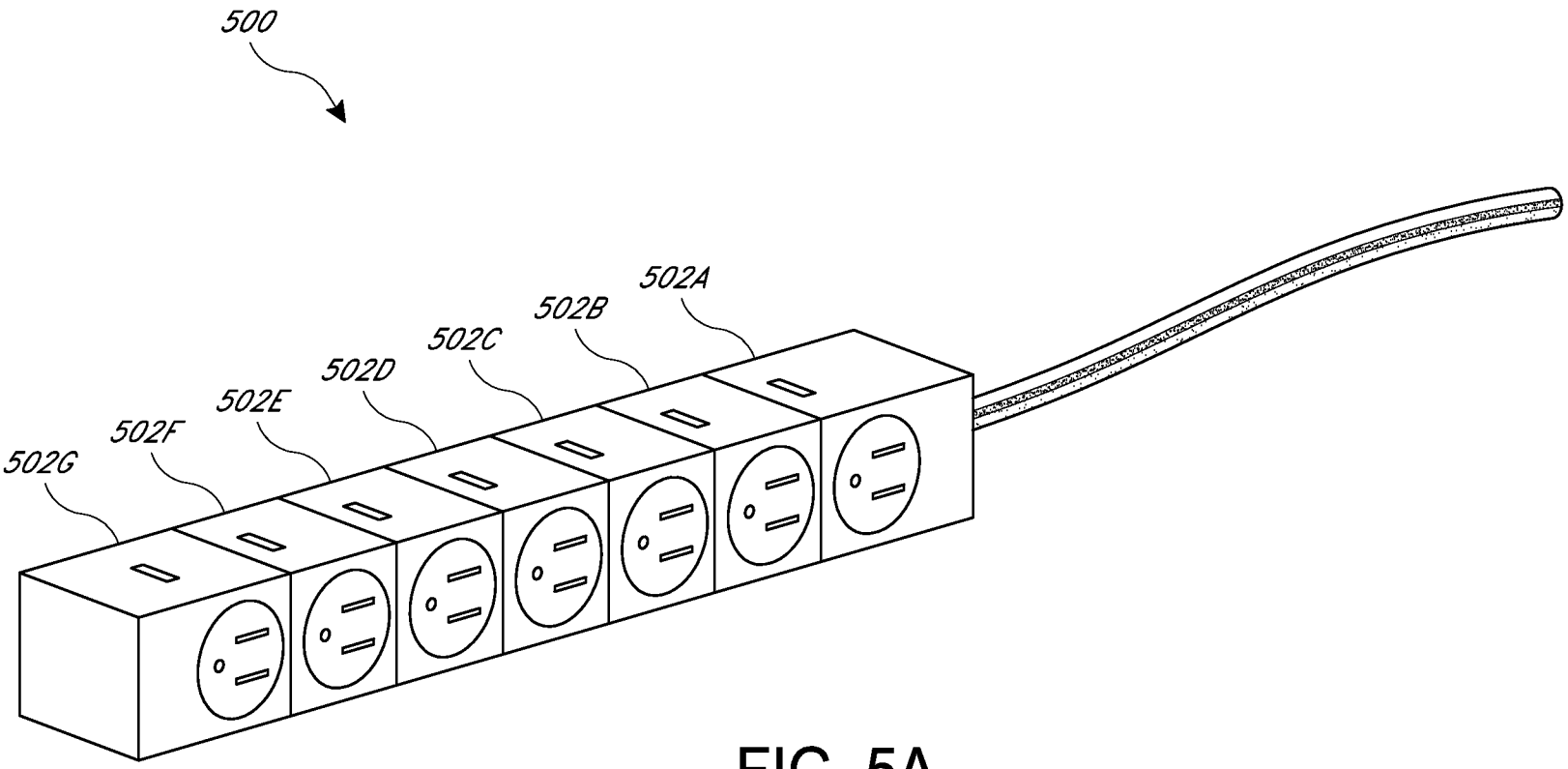
FIG. 5A is a perspective view illustrating an example of an embodiment of a modular smart outlet that includes multiple outlet modules.

In certain embodiments, a smart outlet 102 may be implemented with multiple housings interfaced with but external to a wall socket. FIG. 5A is an illustration of the smart outlet of FIG. 1A with modular housings 502A-G that include different modules in accordance with an exemplary embodiment. Each of the modules within the housings can be modularly connected with the smart outlet 500 of FIG. 5A in order to integrate the smart outlet 500 with an arbitrary number of modules.

Figure 5B:
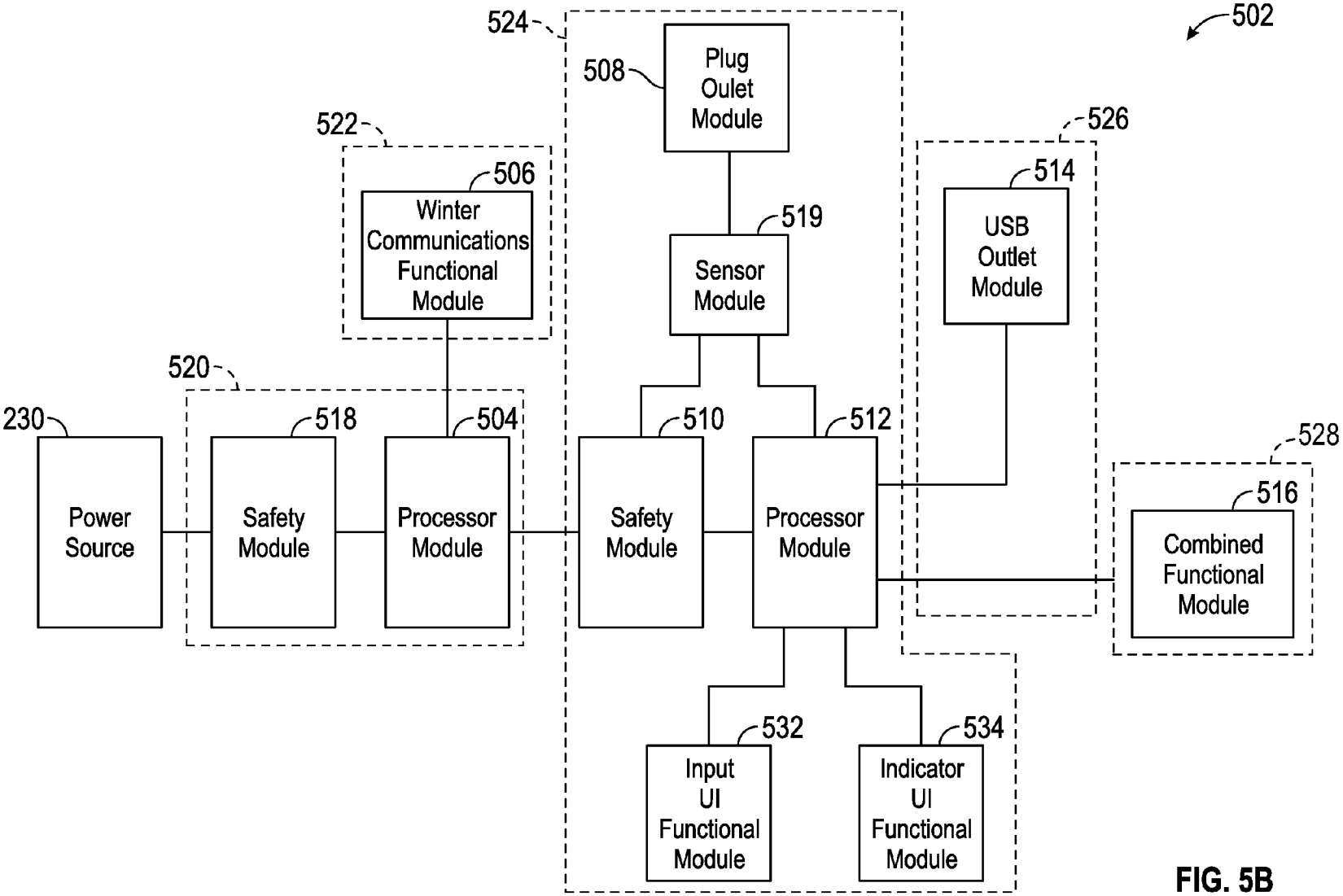
FIG. 5B is a block diagram illustrating an example of an embodiment of a smart outlet having different modules in different housings.

FIG. 5B is a block diagram 502 example of an embodiment of a smart outlet with modules in different housings. In the illustrated embodiment, a first housing 520 includes a sensor module 518 connected with a processor module 504. The sensor module 518 may be connected with the power source 230. A second housing 522 may include a wireless communications functional module 506. The wireless communications functional module 506 may be connected with the processor module 504. A third housing 524 may include a plug outlet module 508, a sensor module 519, safety module 510, input user interface functional module 532, indicator user interface functional module 534, and a processor module 512. The safety module 510 may be connected with the processor module 504. The sensor module 519 may be connected to the plug outlet module 508, processor module 512 and safety module 510. The processor module 512 may be connected to the input user interface functional module 532 and the indicator user interface functional module 534. A fourth housing 526 may include a USB output module 514. The USB output module may be connected with the processor module 512. The fifth housing 528 may include a combined sensor and user interface functional module 516 and be connected with the USB output module 514 and the processor module 512.

Figures 1, 5C:
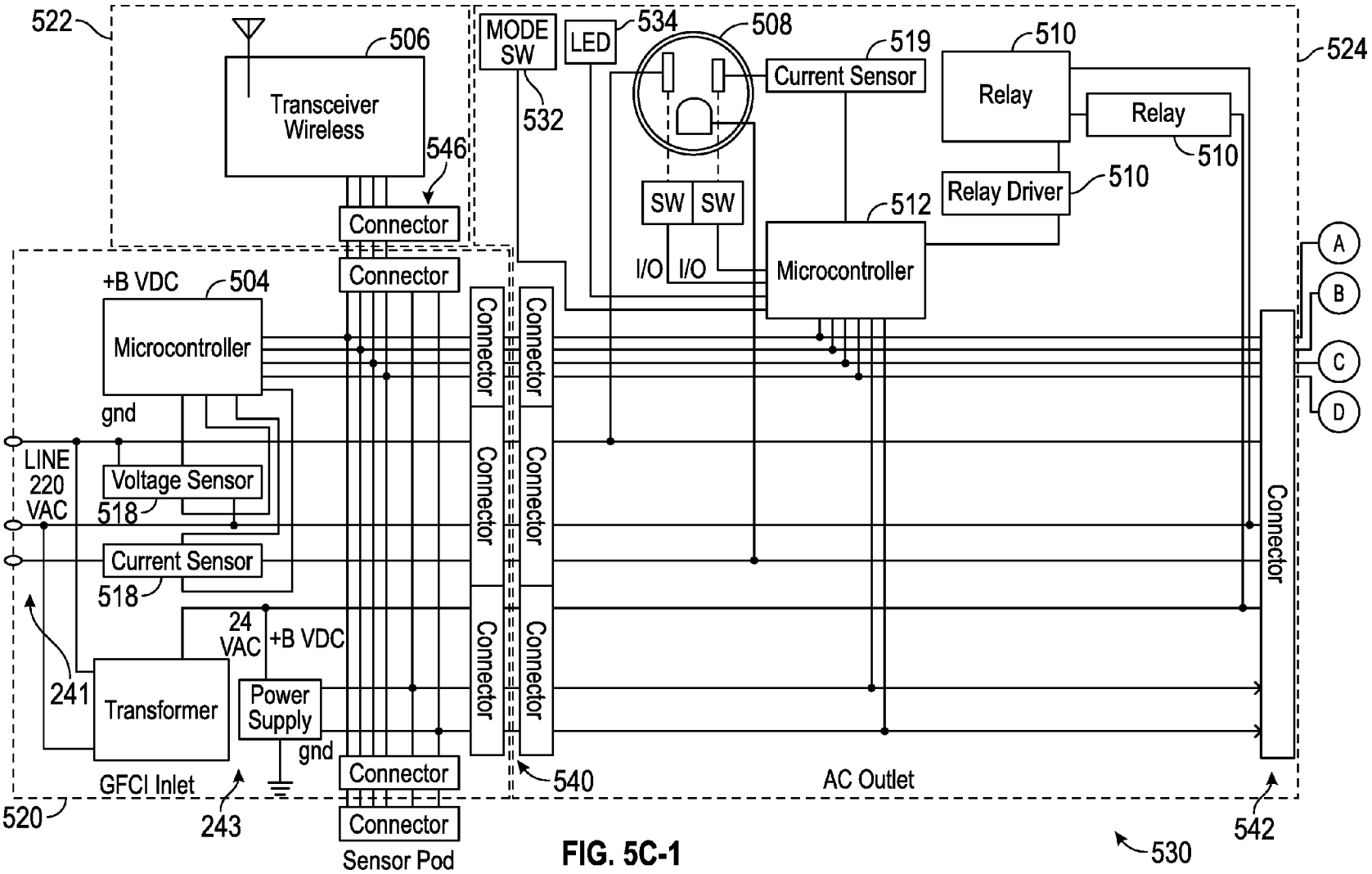
Figures 2, 5C:
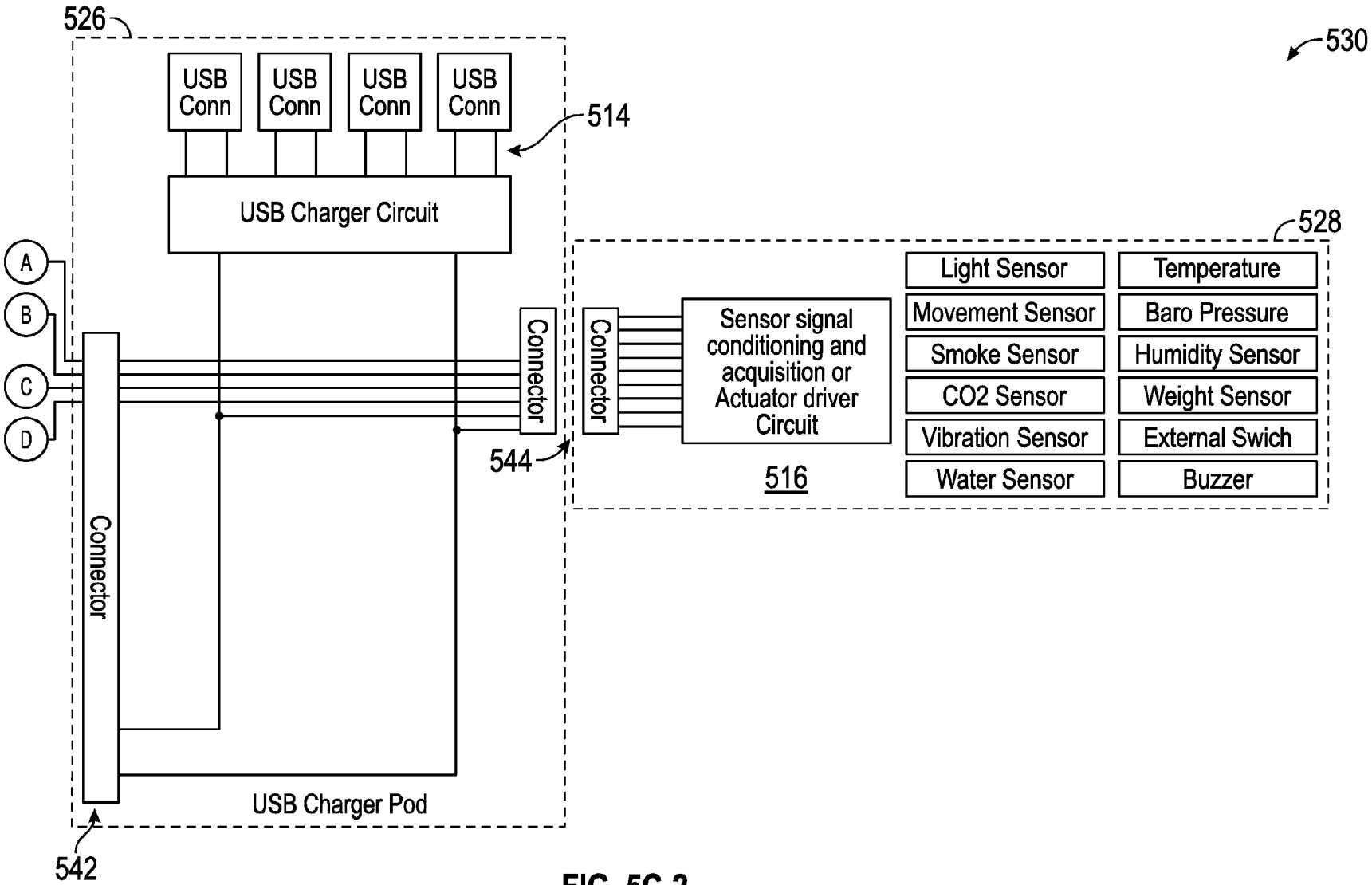

FIGS. 5C-1 and 5C-2 are a schematic 530 example of an embodiment of the block diagram 502 of FIG. 5B in accordance with an exemplary embodiment. The block diagram 530 illustrates how the various housings 520, 522, 524, 526, and 528 may be connected using connectors 546, 540, 542, 544. Points A, B, C, and D on FIG. 5C-1 connect with same points A, B, C, and D on FIG. 5C-2.

In certain embodiments, the smart outlet may have a sensor module internal to the at least one housing that encompasses the smart outlet. The sensor module may be configured to evaluate or monitor one or more operations of the smart outlet, for example, to measure or determine one or more characteristics of the shock proof electrical outlet. In some embodiments, the one or more characteristics are used to determine a performance level or to perform diagnostics. In some embodiments, the sensor module may sense the shock proof electrical outlet's interfacing with external devices, for example, a plug that receives power from the shock proof electrical outlet.

Figure 6A:
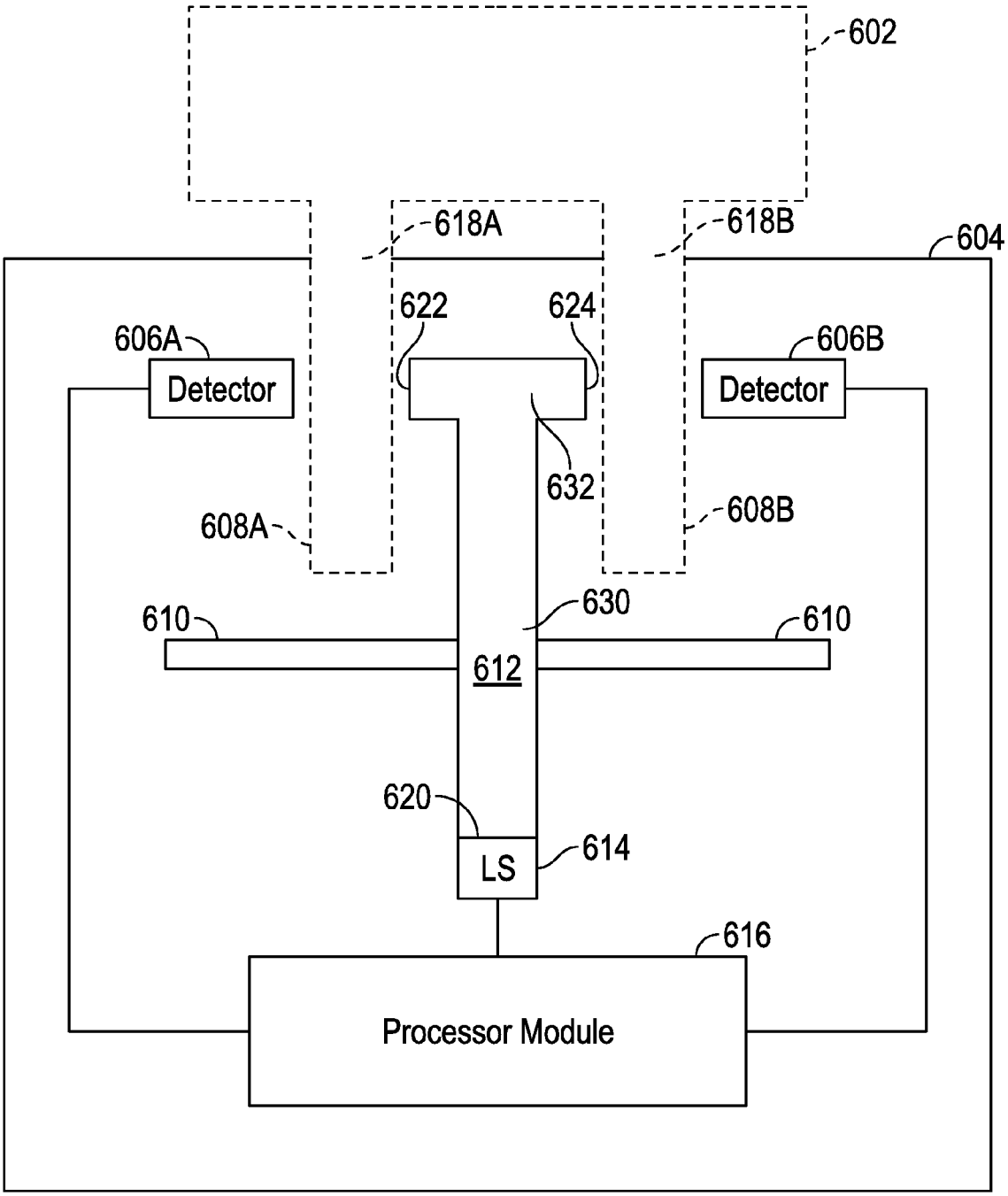
FIG. 6A is a block diagram illustrating an example of an embodiment of a sensor module that can be used in a smart outlet.

FIG. 6A is a block diagram illustrating a representation of a sensor module that can be used in certain embodiments. FIG. 6A illustrates a plug 602 with two prongs 608A, 608B. The plug 602 represents a plug that may be attached to a of a variety of different electrical appliances, for example, a phone or a computer. Each of the prongs 608A, 608B of the plug 602 may be inserted into a receptacle constructed to receive the prong 608A, 608B, such as a hole or an opening on a planar surface of the shock proof electrical outlet 604.

The shock proof electrical outlet 604 may include a waveguide 612. The waveguide 612 may be any structure that guides light to propagate within the waveguide 612 in a particular direction. The waveguide 612 may have three ports 620, 622, 624. A first port 620 of the waveguide 612 may be an entry port configured to receive light emitted from a light source 614. A second port 622 and third port 624 of the waveguide 612 may be exit ports configured to emit light received at the first port 620. The waveguide 612 may be "T"-shaped formed with a first axis and a second axis. The first axis may be orthogonal to the second axis. A first section 632 of the waveguide 612 extending along the first axis may be shorter than a second section 630 of the waveguide 612 that extends along the second axis. The second port 622 and third port 624 of the waveguide 612 may be aligned along the first axis at the first section 632 of the waveguide 612. The first port 620 may be on a portion of the second section 630 positioned distal to the first section 632 and positioned proximal to the light source 614.

The light source 614 may disposed near or be coupled to the waveguide 612 such that the light source 614 emits light that that is received on the first port 620 and enters the waveguide. The light source 614 may be configured to emit light (for example, Infra-Red light) or any other type of radiation that may be detected by the detectors 606A, 606B. For example, the emitted light may be within the visible spectrum of light (for example, about 430-790 THz in frequency or 390-700 nm in wavelength) or may not be visible to a human eye.

The shock proof electrical outlet may include detectors 606A, 606B aligned along the first axis. The detectors 606A, 606B may be physically separated from the waveguide 612 by a space formed from the receptacle constructed to receive the prong 608A, 608B. The detectors 606A, 606B may be configured to detect light emitted from the second port 622 or the third port 624. The detectors 606A, 606B may be any type of detector (for example, a photodetector) capable of detecting the light emitted from the light source 614. In certain embodiments, the detectors 606A, 606B are configured to detect light coming from a particular direction as guided by the waveguide 612. Thereby, the waveguide 612 may guide light from the light source 614 to each of the detectors 606A, 606B.

The processor module 616 may be in electrical communication with the detectors 606A, 606B and the light source 614. As introduced above, the processor module 616 may include a processor and memory to perform any type of processing based upon information generated by the smart outlet 604 or information from a source external to the smart outlet 604. The processor module 616 may process information generated by the combination of the detectors 606A, 606B, waveguide 612 and light source 614.

The waveguide 612 may be configured to guide the light emitted from the light source 614 in a manner that allows the detectors 606A, 606B to detect the presence of the prongs 608A, 608B. For example, in the illustrated embodiment, the waveguide 612 guides the light from the light source 614 and divides the light into two different paths directed to each detector 606A, 606B. The waveguide 612 and detectors 606A, 606B may be configured such that the presence of the prong 608A, 608B of the plug 602 obfuscates the light emitted from the light source 614 from one or both of the detectors 606A, 606B. Detection of light emitted from the light source 614 is indicative of no prong 614 being inserted within the receptacle, and no light being detected by one of the detectors 606A, 606B indicates that a structure (for example a plug prong) has been inserted within the receptacle.

The light source 614 and the processor module 616 may be on or coupled to a printed circuit board (not illustrated) within the smart outlet 604. The printed circuit board may provide a platform for the processor module 616 and light source 614 to be interconnected via electrical wiring on the printed circuit board. The printed circuit board may also include other electronic components of the smart outlet 604 (for example, the memory and/or other components of the sensor module).

In certain embodiments, a short protection shield 610 may be disposed between the prongs 608A, 608B and the circuit board to provide a barrier to physically separate the prongs 608A, 608B (and any other item that may enter the receptacle) from the processor module 616 and/or other electronics that reside on the printed circuit board. The short protection shield 610 may be of a material that inhibits foreign objects (for example, the prongs 608A, 608B) that enter from the receptacle from interfering with the internal components of the smart outlet 604. The short protection shield 610 thereby prevents unregulated electrical current between the prongs 608A, 608B and other components of the smart outlet 604.

Figure 6B:
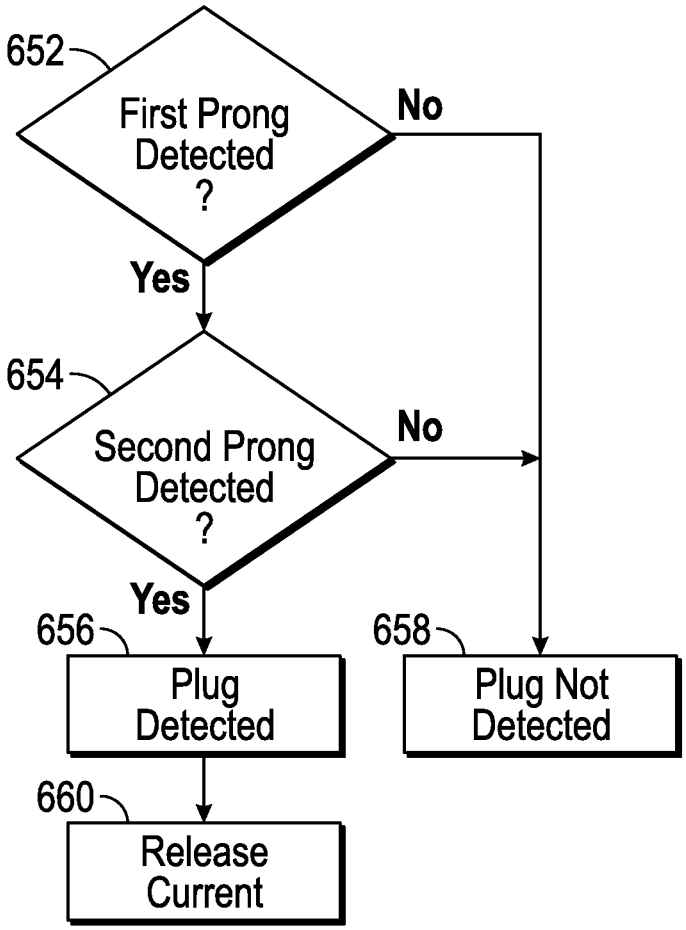
FIG. 6B is a flow chart illustrating an example of an embodiment of a process of determining whether both prongs of a plug are inserted into a smart outlet using the internal sensor module of FIG. 6A.

FIG. 6B is a flow chart illustrating a process of determining whether both prongs 608A, 608B of the plug 602 are interfaced with the smart outlet 604 using the internal sensor module of FIG. 6A in accordance with an exemplary embodiment. The process may be performed by the processor module 616 in communication with the detectors 606A, 606B. Although a plug 602 with two prongs 608A, 608B is described in the illustrated embodiments, the internal sensor module may sense any type of plug 602 with any number of prongs 608A, 608B (for example, a single prong or more than two prongs) as appropriate for different applications in accordance with different embodiments. At block 652, the processor module 616 may determine whether the first prong 608A is detected. The processor module 616 may determine whether the first prong 608A is detected by receiving signals from the detector 606A associated with the first prong 608A. The detector may detect whether light emitted from the light source 614 is received by the detector 606A. If the light is not received by the detector 606A, then the processor module determines that the first prong is detected. In certain embodiments, the detector 606A first determines that light is received and then is subsequently not received by the detector 606A in determining whether the first prong 608A is detected. At block 654, the processor module 616 may determine whether the second prong 608B is detected. Block 654 may occur after the first prong 608A is detected from block 652. The processor module 616 may determine whether the second prong 608B is detected by receiving signals from the detector 606B associated with the second prong 608B. The detector 606B may detect whether light emitted from the light source 614 is received by the detector 606B. If the light is not received by the detector 606B, then the processor module 616 determines that the second prong 608B is detected. In certain embodiments, the detector 606B first determines that light is received by the detector 606B and then is subsequently not received by the detector 606B in determining whether the second prong 606B is detected. In particular embodiments, the processor module 616 may make the determinations of detecting the first and second prongs 608A, 608B simultaneously. Although specific prongs are described as a first prong 608A or second prong 608B in the illustrated embodiments, the designation of a first or second prong is not as limited because any prong may be a first prong with the other prong being the second prong as appropriate for different applications in accordance with different embodiments.

At block 658, processor module 616 makes a determination that the plug 602 has not been detected. The determination that the plug 602 is not detected may occur if either the first prong 608A is not detected (block 652) or if the second prong 608B is not detected (block 654).

At block 656, the processor module 616 may determine that the plug 602 is detected. The determination that the plug 602 is detected may occur after the determination that the second prong 608B is detected (block 654).

At block 660, the processor module 616 allows the smart outlet 604 to release a sufficient amount of power to power or charge a device to the plug 602. As introduced above, the processor module 616 may release power by providing AC power to the plug 602 at or above a particular threshold.

As illustrated in FIG. 1B, smart outlets 102 may be network connected with other smart outlets 102 and remote functional modules 140 over the network 148. These remote functional modules 140 may interact with a particular smart outlet 102 based on the proximity of the remote functional module 140 to the smart outlet 102. Also, the computing device 144 may communicate with a smart outlet 102 to control the remote functional module 140.

Figure 7A:
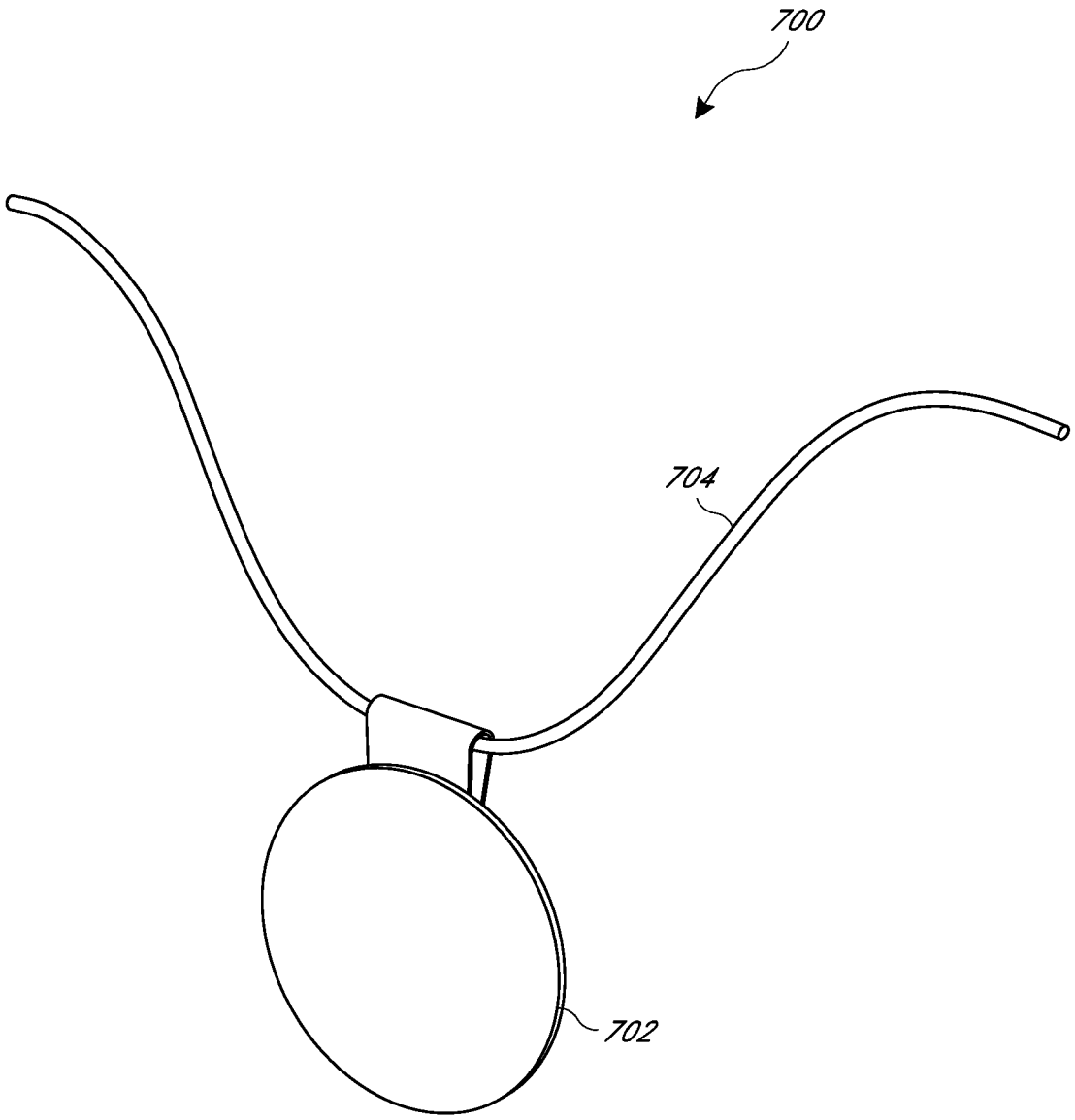
FIG. 7A illustrates a remote functional module (for example, of FIG. 1C) within a housing formed as a pendant that may be worn around a person's neck or hands using a string.

FIG. 7A illustrates an embodiment of a remote functional module 700 (for example, remote functional module 140 of FIG. 1C) within a housing formed as a pendant 702 that may be worn around a person's neck or hands using, for example, a cord or a chain 704. In some embodiments, the remote functional module 700 may include an accelerometer to determine activity level (such as whether the person using the remote functional module 700 has fallen), an emergency alert push button to broadcast occurrence of an emergency and/or a sensor (for examples a physiological sensor including but not limited to a thermometer or heartrate monitor to monitor the health of a person wearing the pendent 702.

Figure 7B:
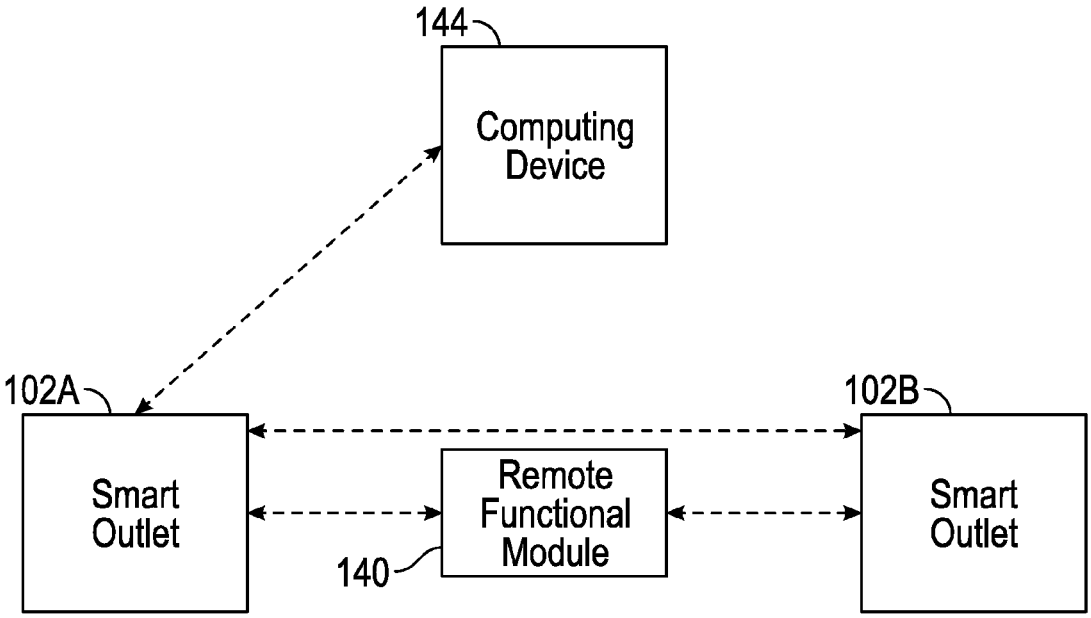
FIGS. 7B-7D illustrate various examples of how a remote functional module may communicate with different smart outlets and the computing device.
Figure 7C:
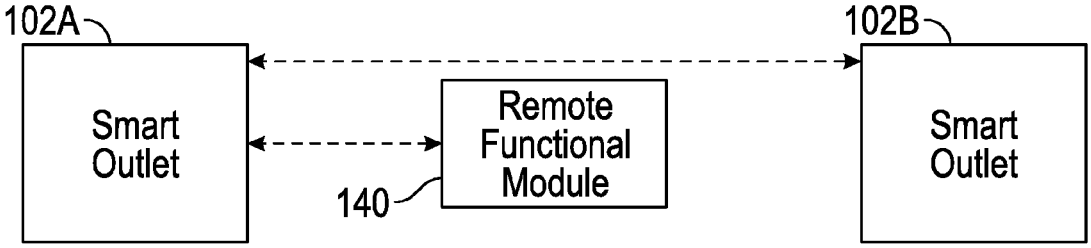
Figure 7D:
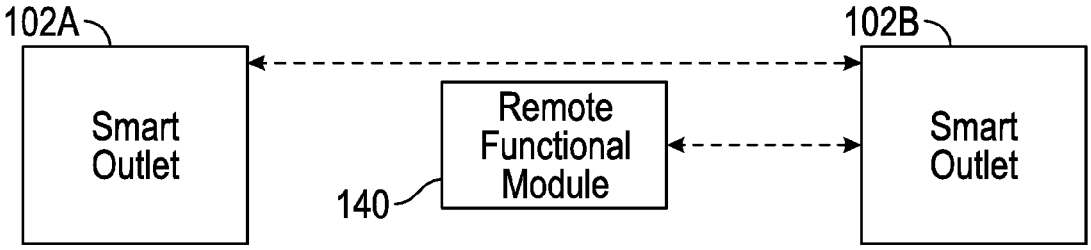

FIGS. 7B-D illustrate various examples of how the remote functional module 140 of FIG. 1B may communicate with different smart outlets 102A, 102B and the computing device 144 in accordance with an exemplary embodiment. As illustrated in FIG. 7B, the computing device 144 may communicate with a smart outlet 102A. The smart outlet 102A may also communicate with the remote functional module 140 and another smart outlet 102B. The smart outlet 102B may also communicate with the remote functional module 140. As illustrated in FIG. 7B, when the remote functional module 140 is closer to the smart outlet 102A than the smart outlet 102B, the remote functional module 140 may communicate with the smart outlet 102A and not with the smart outlet 102B. Similarly, as illustrated in FIG. 7D, when the remote functional module 140 is closer to the smart outlet 102B than the smart outlet 102A, the remote functional module 140 may communicate with the smart outlet 102B and not the smart outlet 102A.

Figure 8A:
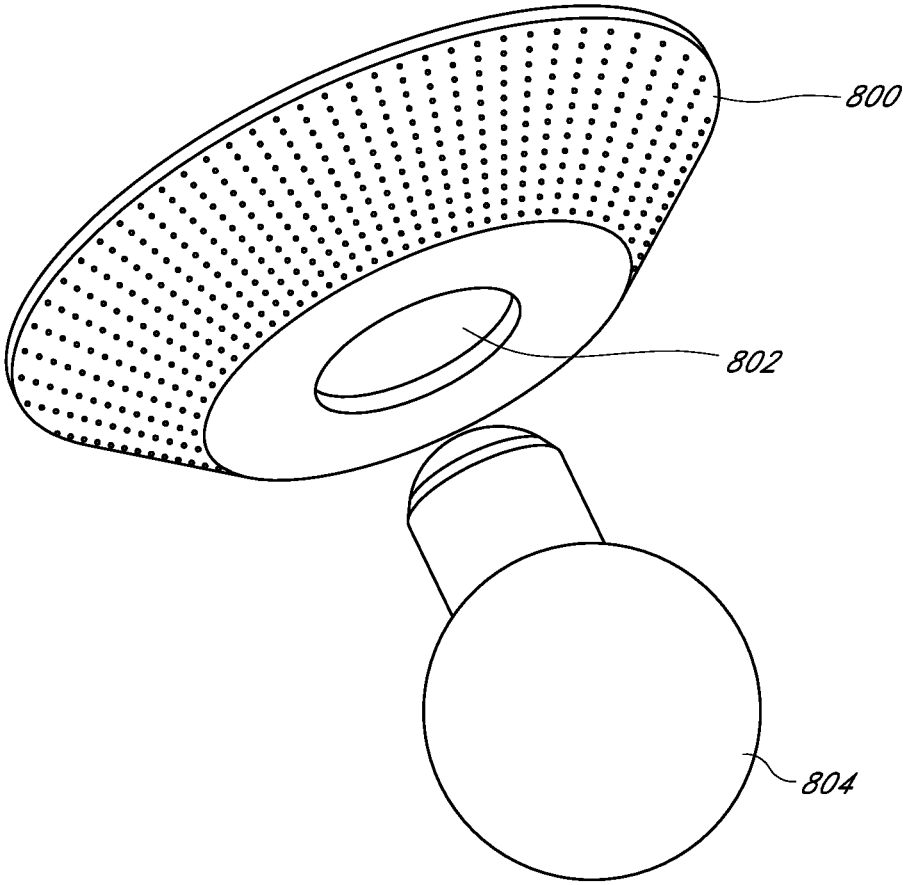
FIG. 8A illustrates an example of an embodiment of a smart outlet that includes an output module that is a lampholder socket module.
Figure 8B:
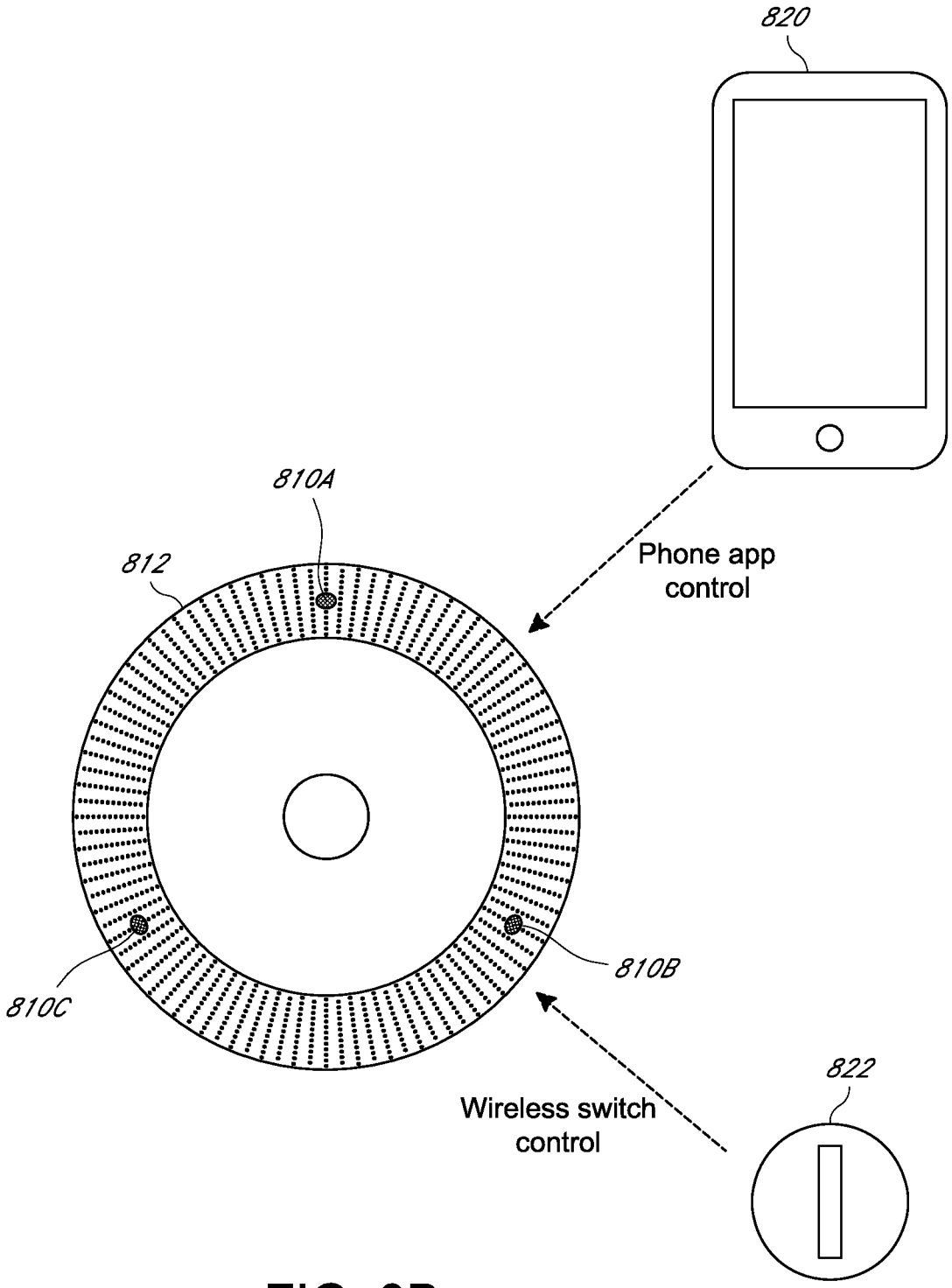
FIG. 8B illustrates how the smart outlet of FIG. 8A includes a speaker as a user interface functional module and several camera/motion sensors as sensor functional modules in accordance with an exemplary embodiment.

FIG. 8A illustrates an example of an embodiment of a smart outlet 800 with a lampholder socket module 802. As illustrated in FIG. 8A, the lampholder socket module 802 may include a single socket configured to receive a lamp 804. As illustrated in FIG. 8B, embodiments of the smart outlet 800 may include a speaker 812 as a user interface functional module. The smart outlet 800 may include a motion sensor as a sensor functional module. The smart outlet 800 may include a camera as a sensor functional module. The smart outlet 800 may include a hybrid camera and motion sensor as a sensor functional module. In the illustrated embodiment, the smart outlet 800 includes three hybrid camera and motion sensors 810A, 810B, 810C as sensor functional modules. One or more computing devices 144, for example, a smartphone along 820, may communicate with and/or control the smart outlet 800 wirelessly over a network.

For example, the hybrid camera and motion sensors 810A-C may be utilized as motion sensors with an unobstructed view of a particular area adjacent to the smart outlet 800. Also, the hybrid camera and motion sensors 810A-C may record video data with a 360 degree view of a particular area (in virtue of the illustrated placement of the three hybrid camera and motion sensors 810A-C). The speaker 812 may be utilized for music and alert broadcasting. Also, the remote functional module 822 may be configured to control the smart outlet 800 controlling the lamp 804 to dim in a particular manner.

Figure 9A:
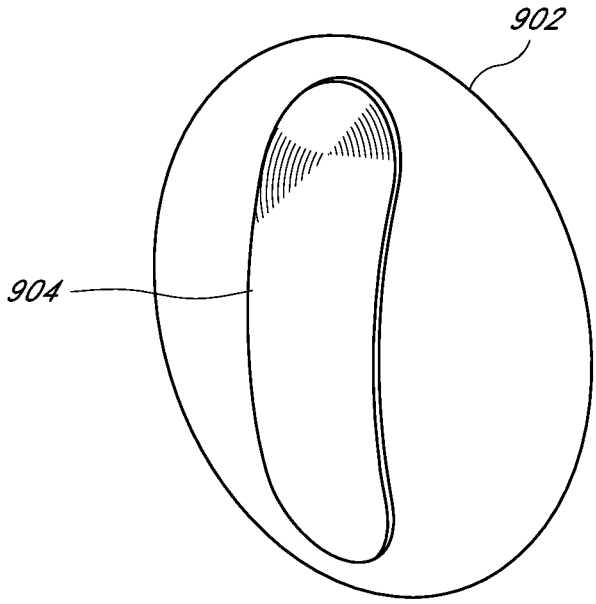
FIG. 9A illustrates a remote functional module with a user interface functional module implemented as a switch and slide dimmer in accordance with an exemplary embodiment.

FIG. 9A illustrates a remote functional module 140 with a user interface functional module 122 implemented as a switch and slide dimmer 902 in accordance with an exemplary embodiment. The switch and slide dimmer 902 includes a button area 904 that may be used to control a smart outlet 102. This control may be wireless.

Figure 9B:
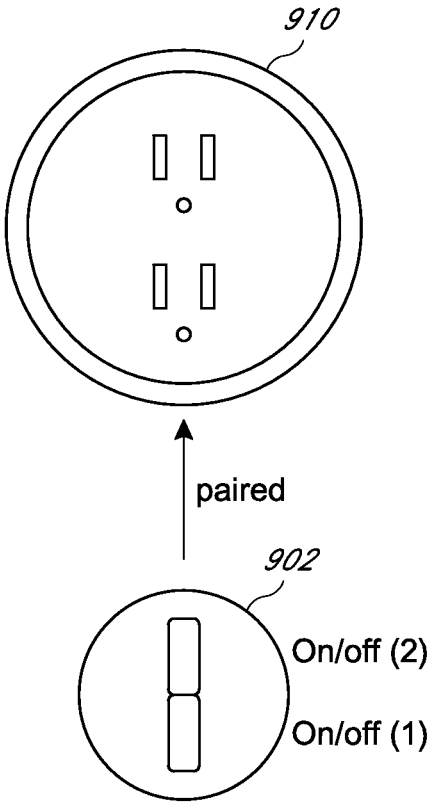
FIG. 9B illustrates the switch and slide dimmer used as a switch, for example, the switch and slide dimmer may communicate with a smart outlet with plug output modules to switch the smart outlet on and/or off in accordance with some embodiments.

FIG. 9B illustrates the switch and slide dimmer 902 used as a switch in accordance with an exemplary embodiment. For example, the switch and slide dimmer 902 may communicate with a smart outlet 910 with plug output modules to switch the smart outlet 910 on and/or off.

Figure 9C:
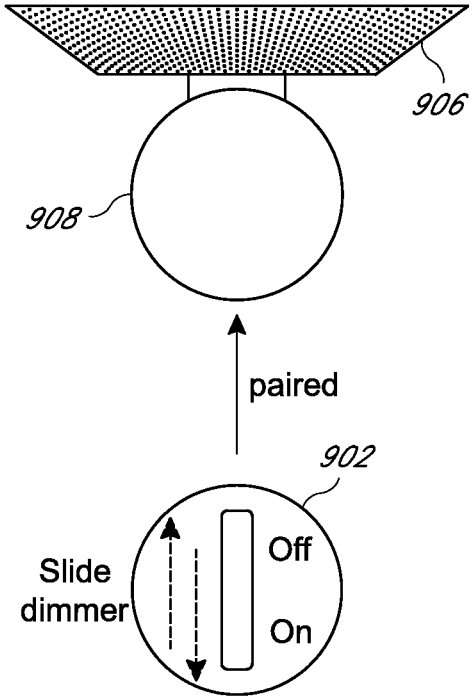
FIG. 9C illustrates the switch and slide dimmer used as a dimmer in accordance with some embodiments.

FIG. 9C illustrates the switch and slide dimmer 902 used as a dimmer in accordance with an exemplary embodiment. For example, the switch and slide dimmer 902 may communicate with a smart outlet 906 with a lampholder socket module to dim a lamp 908.

Figure 10A:
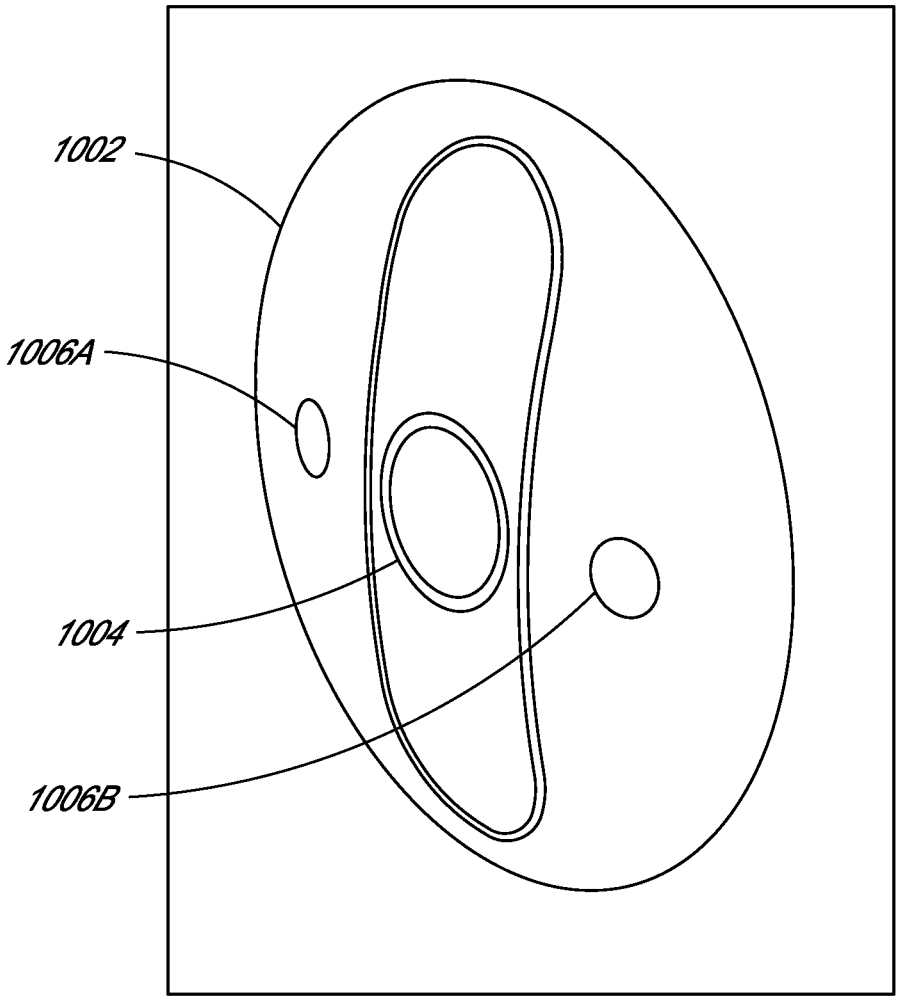
FIG. 10A illustrates a remote functional module implemented with a camera and motion sensors, in accordance with some embodiments.
Figure 10B:
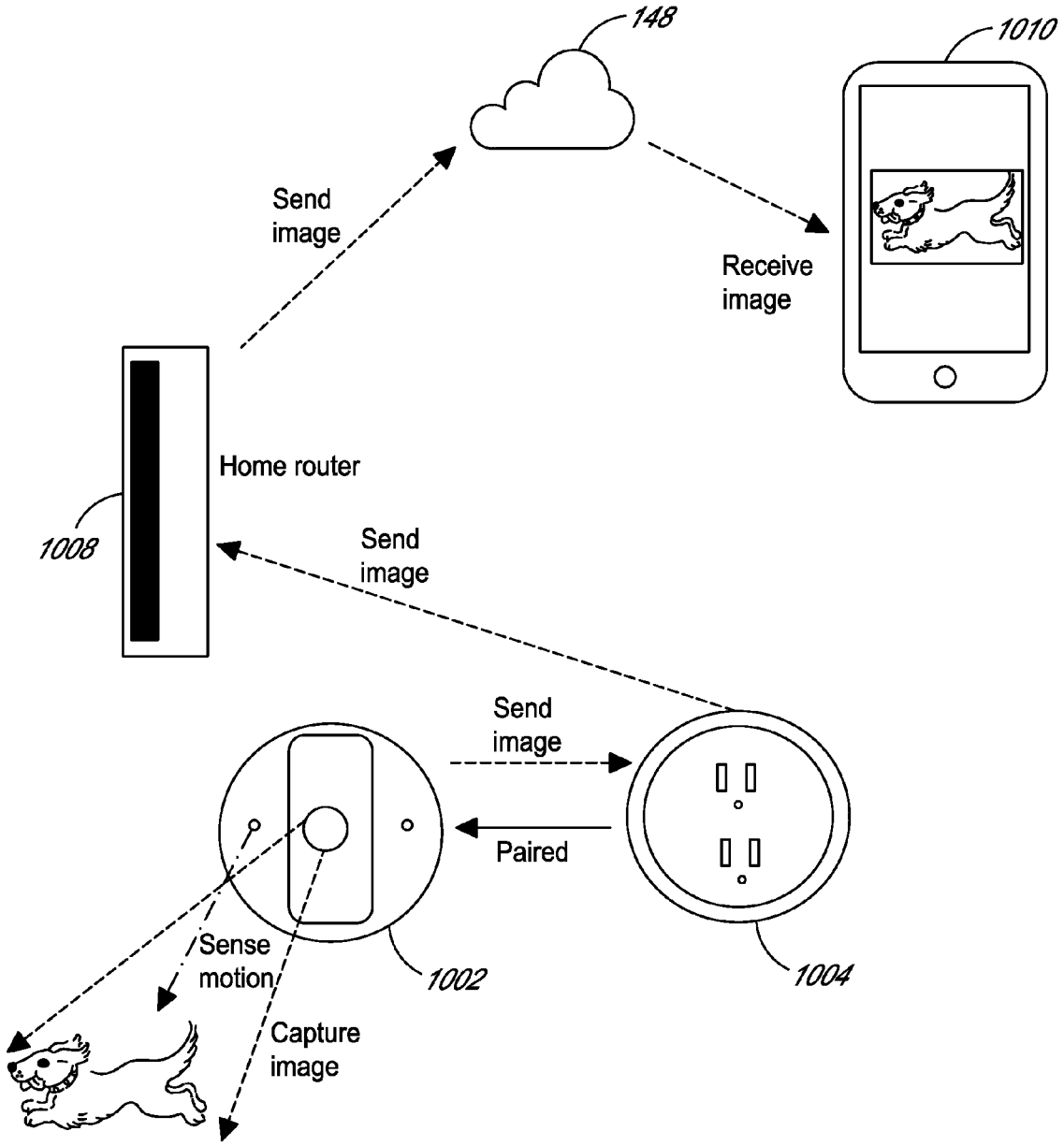
FIG. 10B illustrates how the remote functional module may capture images upon sensing motion by the motion sensors in accordance with some embodiments.

FIG. 10A illustrates a remote functional module 1002 implemented with a camera 1004 and motion sensors 1006A, 1006B in accordance with an exemplary embodiment. As illustrated in FIG. 10B, the remote functional module 1002 may capture images upon sensing motion by the motion sensors 1006A, 1006B. The remote functional module 1002 may also capture images as instructed by the computing device 144. The remote functional module 1002 may communicate with a smart outlet 1004 by sending images to the modular shock proof electrical outlet 1004 and receiving commands from the modular shock proof electrical outlet. The modular shock proof electrical outlet 1004 may communicate with the computing device 144, such as a tablet computer 1010 by receiving commands from the computing device 144 and sending the captured image to the computing device 144 over the network 148 using a router 1008.

Figure 11A:
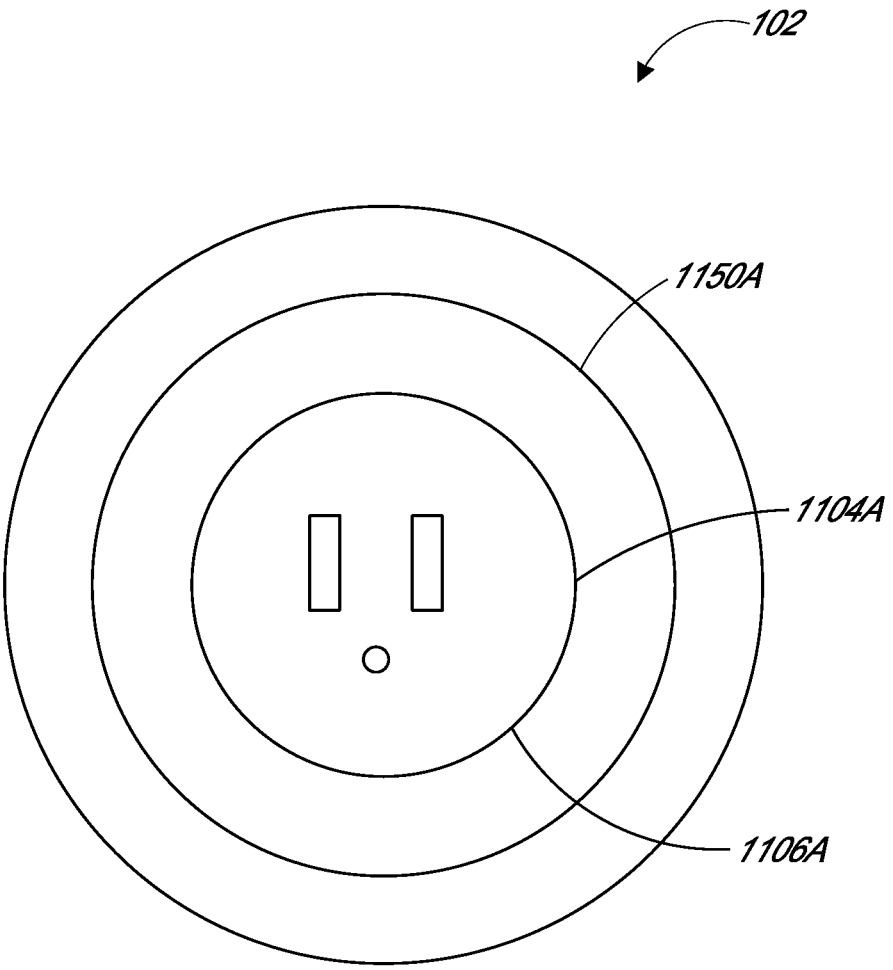
FIG. 11A illustrates a smart outlet with one plug outlet module and a capacitance sensor module located at the plug outlet module in accordance with some embodiments.

FIG. 11A illustrates an example of an embodiment of a smart outlet 102 that includes one plug outlet module (or socket) 1106A and a capacitance sensor 1104A disposed at least in part inside of a housing of the smart outlet 102, which may also be inside of the plug outlet module 1106A. In various embodiments, the capacitance sensor 1104A is configured to generate a capacitance field and sense a disturbance in the field, the disturbance being indicative of a person, or an object, within the vicinity of the plug outlet module 1106A. For example, the capacitance sensor module 1104 may be configured to detect when a person is within a certain distance of the smart outlet 102. The distance may be predetermined and set or programmed into the smart outlet 102, and may be, at any distance in the range of 0-20 inches, for example the set distance may be 1, 2, 3, 4, 5, 6, 7, 8, 9, 10, 11, 12, 13, 14, 15, 16, 17, 18, 19, or 20 inches. In some embodiments, the distance may be greater than 20 inches. The capacitance sensor 1104A may include an antenna 1150A that is connected to the capacitance sensor 1104A and configured to generate a field and also to sense a disturbance in the field, the disturbance being indicative of the presence of a person (or object) in the field. The antenna 1150A may be disposed around at least a portion of the plug outlet module 1106A, or the smart outlet 102. In some embodiments the antenna 1150A may be disposed around a perimeter of the smart outlet 102. In some embodiments the antenna 1150A may be disposed around a portion of the smart outlet 102. The antenna 1150A may be disposed at least in part on the surface of (or just beneath) a housing of the smart outlet 102 to allow, when the capacitance sensor 1104A is activated, for a field produced by the capacitance sensor 1104A to best propagate into an area around the plug outlet module 1106A. The detection of a disturbance in capacitance may be used to determine whether the plug outlet module 1106A is to be connected to the power source 104 and provide power to a socket, that is, if a person is within a certain proximity distance power may not be supplied to an outlet. In some embodiments, if a plug is already in an outlet and power is being supplied to the plug, detecting the presence of a person within the set (or programmed) proximity distance will not interrupt the power being provided to the plugged in device.

Figure 11B:
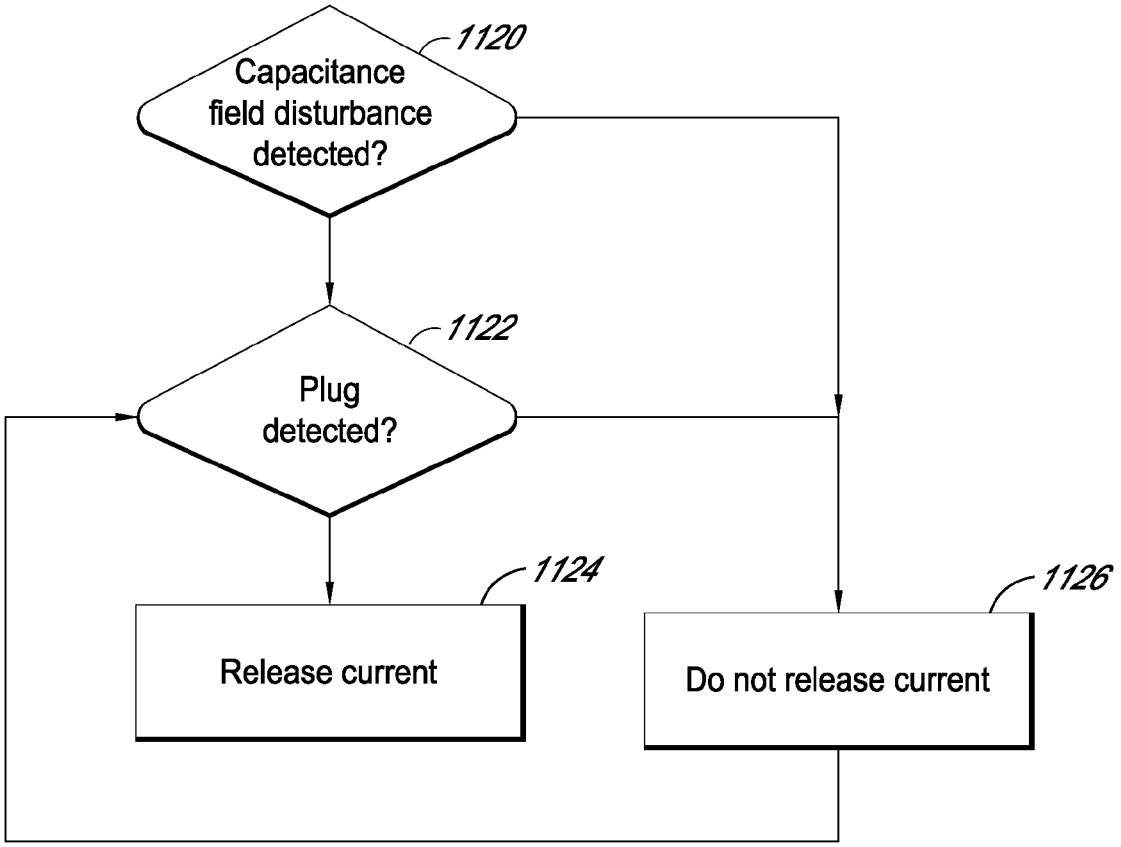
FIG. 11B is a flow chart illustrating a process of determining whether current should be released to the plug outlet module using the capacitance sensor module of FIG. 11A, in accordance with some embodiments.

FIG. 11B is a flow chart illustrating a process 1121 of determining whether current should be released to the plug outlet module 1106A using the capacitance sensor module 1104A of FIG. 11A in accordance with an exemplary embodiment. The process 1121 may be performed by the processor module 126 that controls a safety module 128 to selectively connect and/or disconnect the power source 104 from the plug outlet module 1106A. The process starts at block 1120.

At block 1120, the processor module 126 reads the capacitance sensor module 1104A to determine whether capacitance adjacent to the capacitance sensor module 1104 has been disturbed. A capacitance sensor may operate according to the principle that an electric field and a capacitance are generated between two conductive objects that have different voltage potentials and are physically separated from one another. The capacitance between the two conductive objects generally increases as the surface areas of the objects increase, or as the distance between the objects decreases. If the disturbance in capacitance has not been detected, the process proceeds to block 1126. If the disturbance in capacitance has been detected, the process proceeds to block 1122.

At block 1122, the processor module 126 determines whether a plug is interfaced with the plug outlet module 1106A. This determination may be made as discussed further in connection with FIG. 6B. If the plug is interfaced with the plug outlet module 1106A, then the process proceeds to block 1124. If the plug is not interfaced with the plug outlet module 1106A, then the process proceeds to block 1126.

At block 1121, the processor module 126 controls the safety module 128 to release current from the power source 104 to the plug outlet module 1106A.

At block 1126, the processor module 126 controls the safety module 128 to not release current from the power source 104 to the plug outlet module 1106A.

Figure 11C:
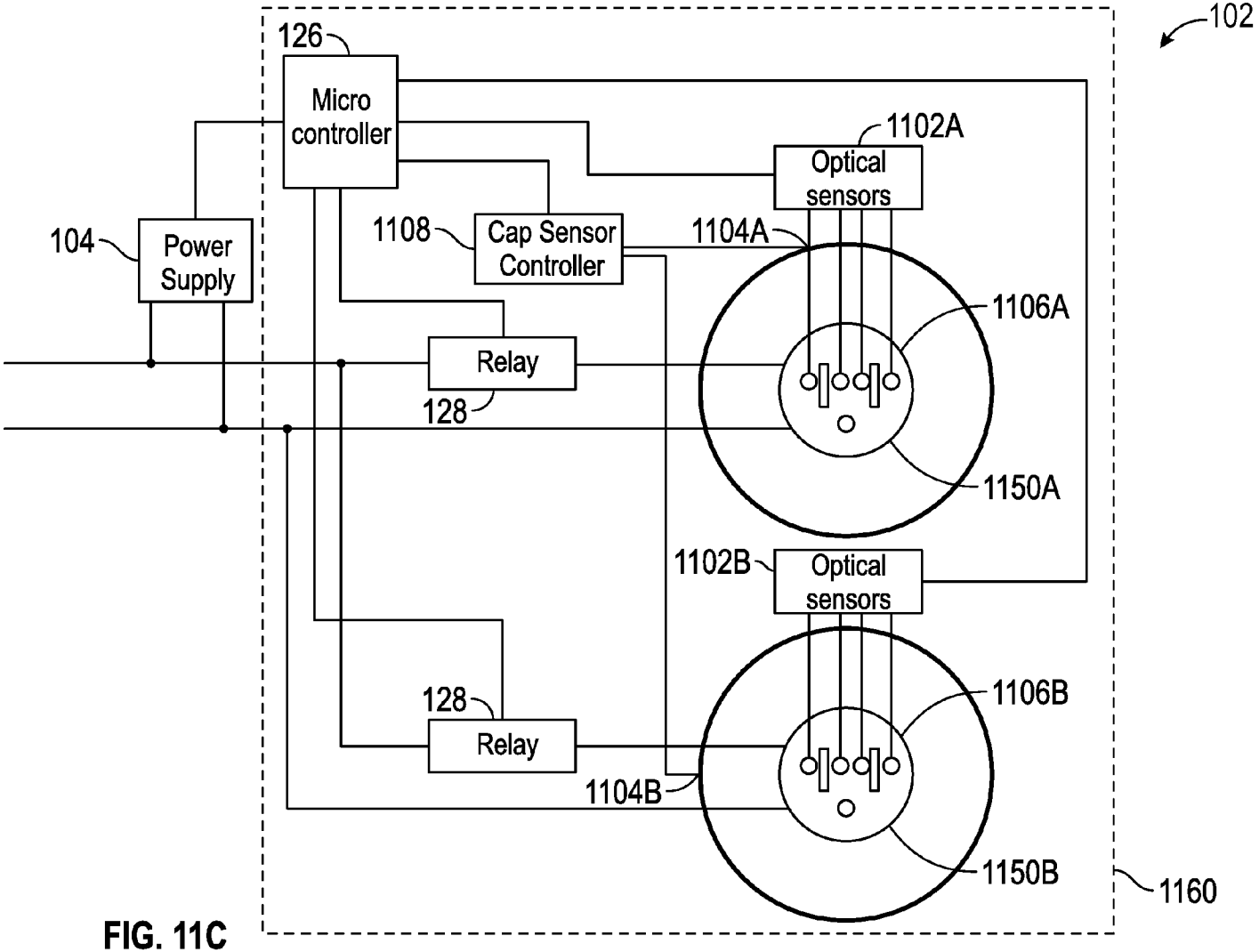
FIG. 11C is a schematic of the smart outlet with the plug outlet module and a capacitance sensor module and a plug outlet module and capacitance sensor module, in accordance with some embodiments.

FIG. 11C is a schematic illustrating an example of a smart outlet 102 that includes two plug outlet modules 1106A and 1106B, and two capacitance sensors 1104A and 1104B. The capacitance sensors 1104A and 1104B may also be referred to as capacitance sensor modules. In this embodiment, each of the plug outlet modules 1106A and 1106B includes a capacitance sensor 1104A and 1104B each having an antenna 1150A and 1150B, respectively coupled thereto. The housing 1160 (illustrated by a dashed line in FIG. 11C) represents a housing of the smart outlet 102 that houses the components of the smart outlet 102, as illustrated. The optical sensors 1102A and 1102B each include four optical sensor components located adjacent to the sockets of the plug outlet modules 1106A and 1106B. Also, a capacitance sense controller 1108 is utilized by the processor module 126 to control the capacitance sensors 1104A and 1104B. The capacitance sensor 1104A may include a capacitance sensor antenna 1150A disposed around the plug outlet module 1106A (or disposed around a portion of the smart outlet 102). The capacitance sensor module 1104B may include a capacitance sensor antenna 1150B disposed around the plug outlet module 1106B (or disposed around a portion of the smart outlet 102). The safety modules 128 may be controlled by the processor module 126 to selectively connect and/or not connect the power source 104 to the plug outlet modules 1106A and 1106B. The safety modules 128 may include relays. The plug outlet modules 1106A, 1106B, the capacitance sensors 1104A, 1104B, optical sensors 1102A and 1102B, capacitance sense controller 1108, processor module 126, capacitance sensor antennas 1150A 1150B, safety modules 128 may be disposed within and/or along the housing 1160 of the shock proof electrical outlet 102. Although the capacitance sensors 1104A, 1104B are illustrated as being located at each plug outlet module 1106A, 1106B in the illustrated embodiment, there may be less capacitance sensor modules than plug outlet modules such that a single capacitance sensor module is associated with multiple capacitance sensor modules as appropriate for different applications in accordance with different embodiments. Also, a capacitance sensor module may include a capacitance sensor antenna located in different locations within and/or along a housing of the shock proof electrical outlet 102.

Figure 12B:
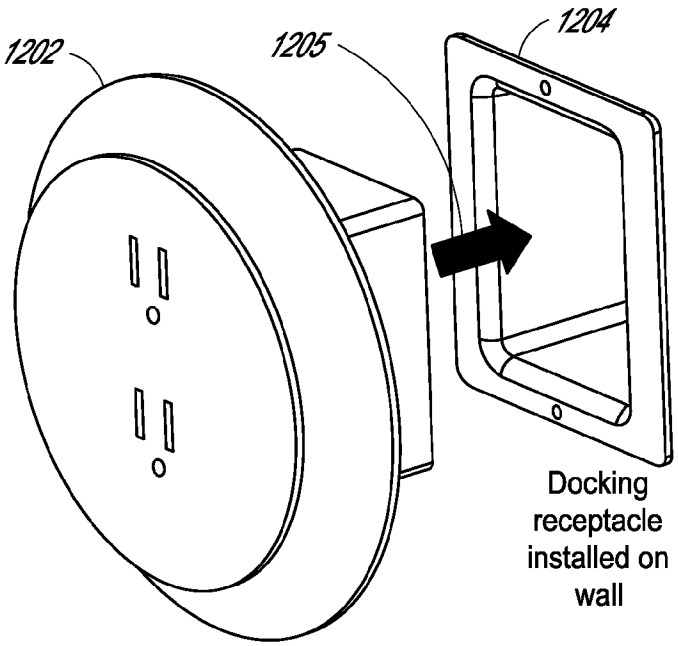
FIGS. 12A-12D are various views of a smart outlet and a docking receptacle, in accordance with some embodiments.
Figure 12A:
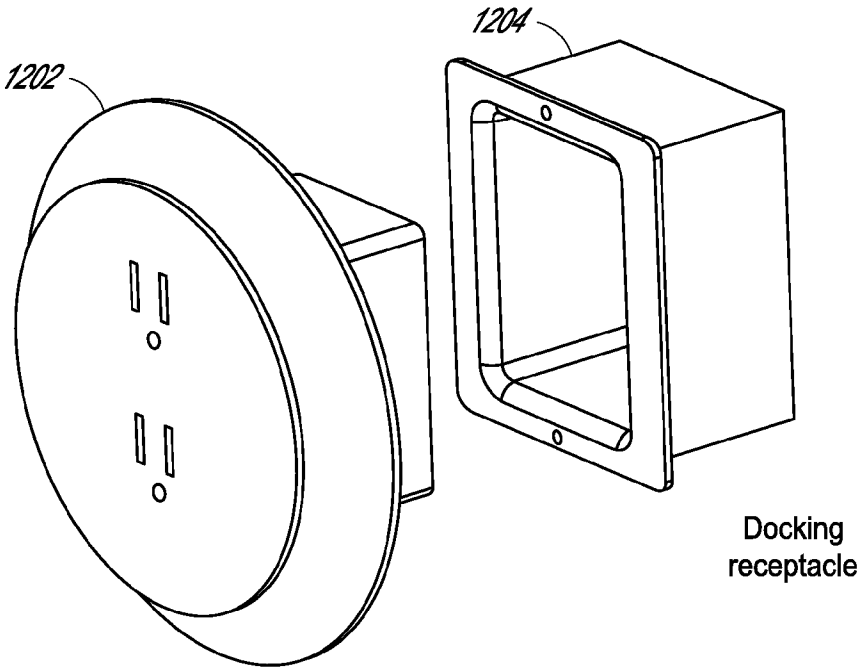
Figure 12D:
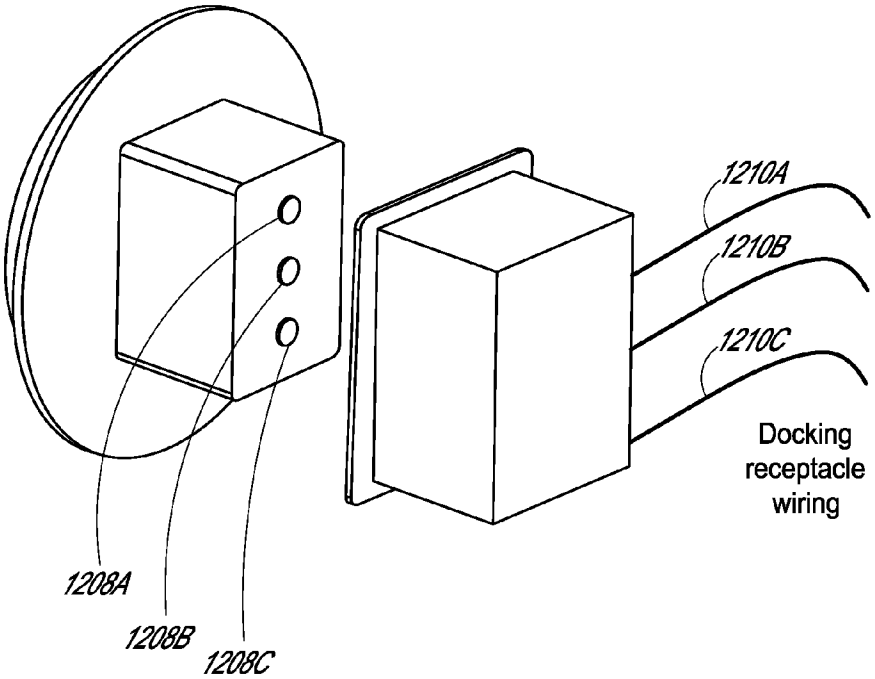
Figure 12C:
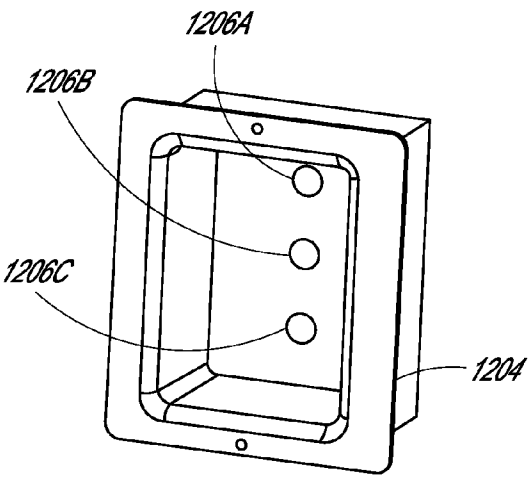

FIG. 12A is an exploded view illustration of a smart outlet 1202 and a docking receptacle 1204 in accordance with an exemplary embodiment. The docking receptacle 1204 may recessed into a wall such that it is flush with the wall and sized to receive the smart outlet 1202. FIG. 12B illustrates the exploded view diagram of FIG. 12B with an indicator 1205 that that the smart outlet may be inserted into the docking receptacle 1204 in accordance with an exemplary embodiment. FIG. 12C is a perspective front view of the docking receptacle 1204 in accordance with an exemplary embodiment. As illustrated in FIG. 12C, the docking receptacle has three docking receptacle contactors 1206A, 1206B, and 1206C. FIG. 12D is a perspective back view of the modular shock proof electrical outlet 1202 and the docking receptacle 1204 in accordance with an exemplary embodiment. The smart outlet 1202 may include the input interface implemented as input interface contactors 1208A, 1208B, 1208C that can contact the docking receptacle contactors 1206A, 1206B, 1206C. Power may be provided to the smart outlet 1202 from the power source 104 via the docking receptacle wiring 1210A, 1210B, 1210C when the input interface contactors 1208A, 1208B, 1208C are connected with the docking receptacle contactors 1206A, 1206B, 1206C.

Figure 13A:
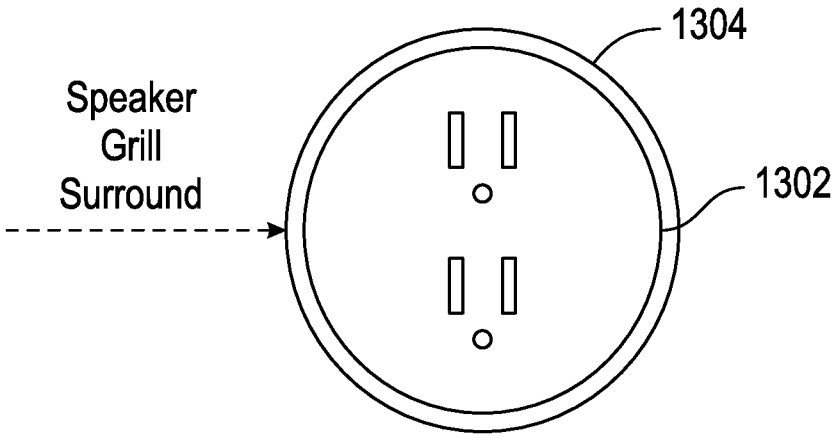
FIG. 13A illustrates a smart outlet with a user input functional module that is a speaker, in accordance with some embodiments.
Figure 13B:
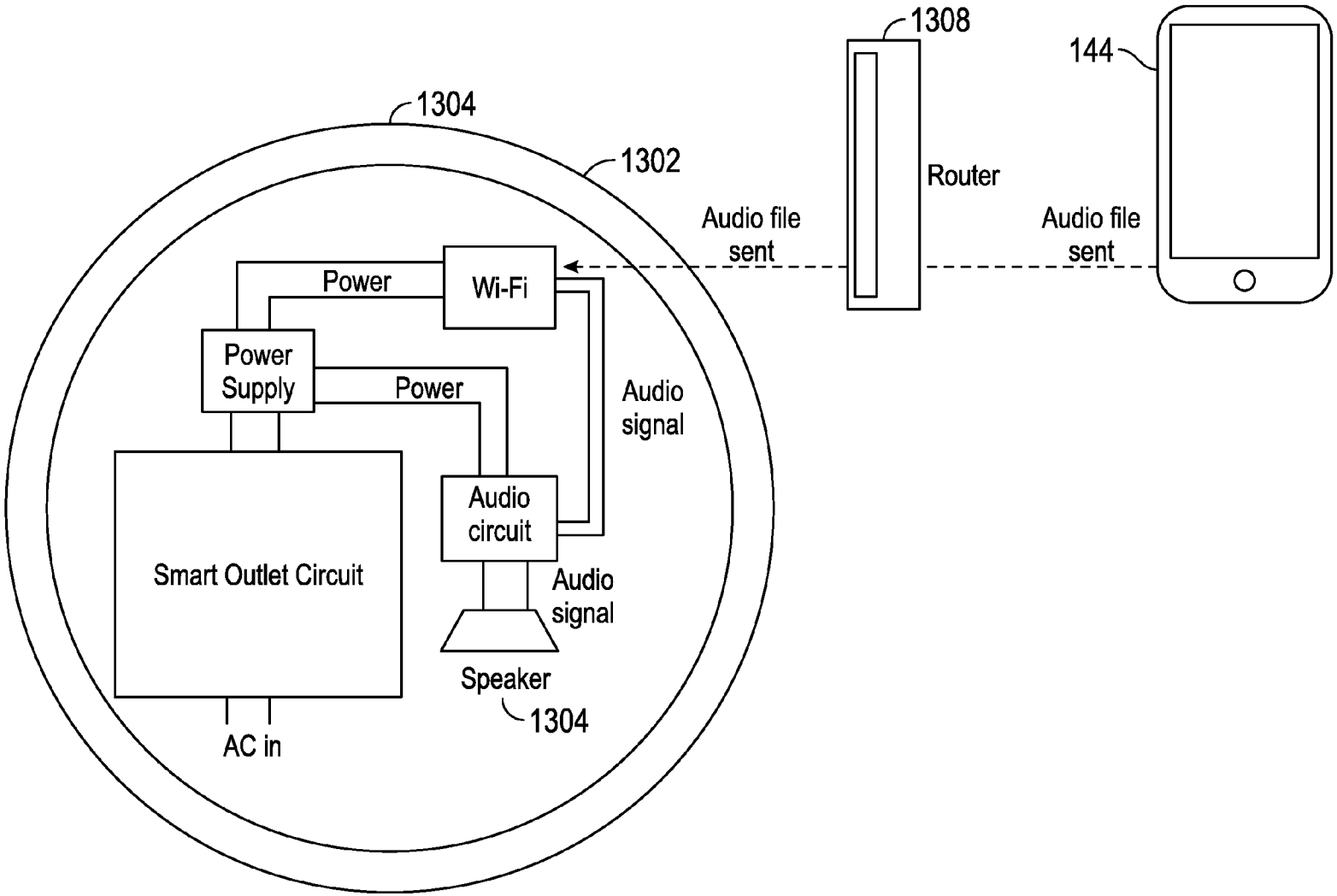
FIG. 13B illustrates how a speaker may output audio from a file sent to a smart outlet from the computing device via the router in accordance with an some embodiments.

FIG. 13A illustrates a smart outlet 1302 with a user input functional module that is a speaker 1304 in accordance with an exemplary embodiment. As illustrated in FIG. 13B, the speaker 1304 may output audio from a file sent to the smart outlet 1302 from the computing device 144 via the router 1308.

Figure 14:
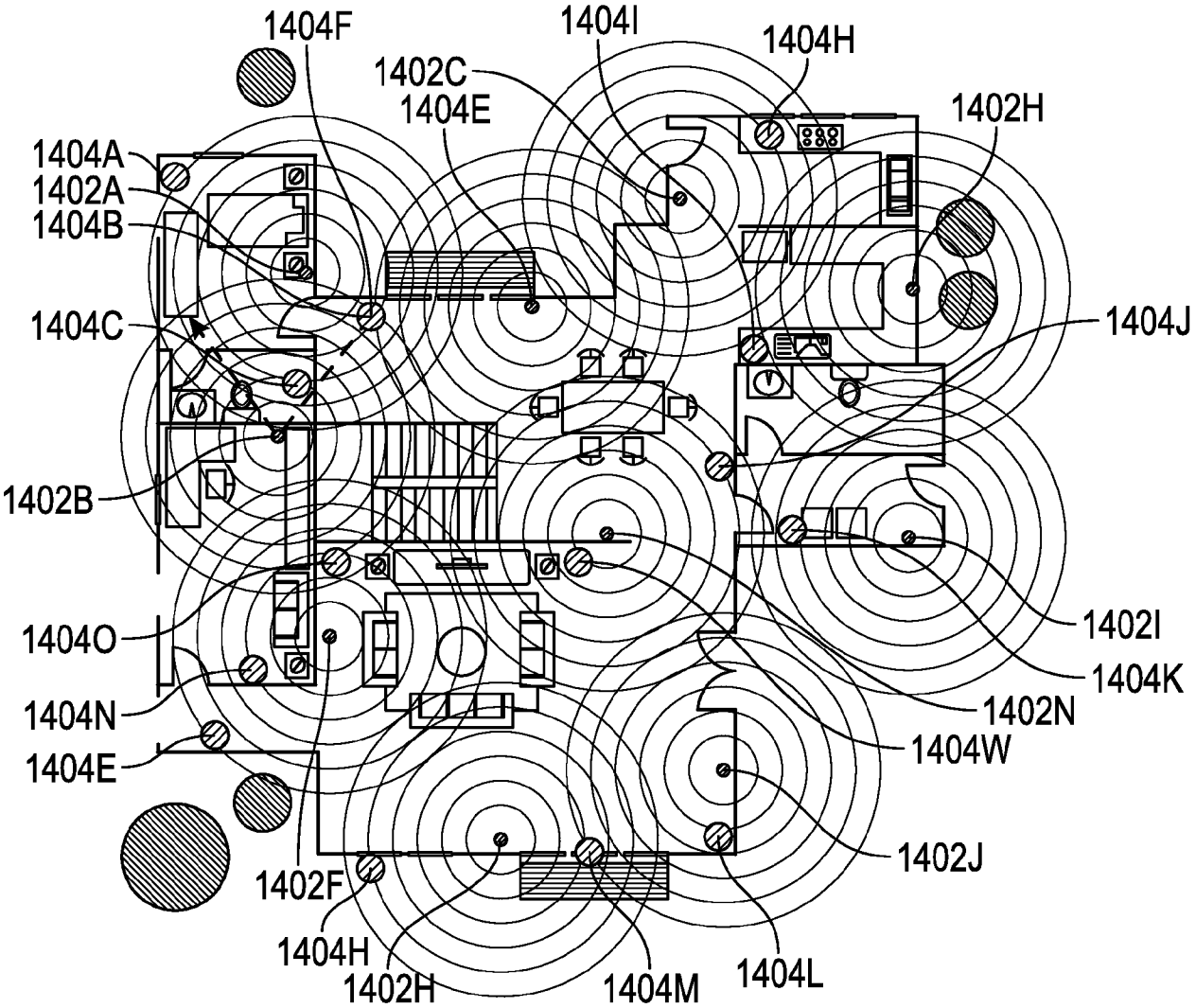
FIG. 14 illustrates a system with several smart outlets interfaced with each other over a network in accordance with some embodiments.

FIG. 14 illustrates a system with several smart outlets 1402A-M interfaced with each other over a network in accordance with an exemplary embodiment. Several remote functional modules 1404A-O may communicate with one or more of the smart outlets 1402A-N.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. The described functionality may be implemented in varying ways for each particular application, but such implementation decisions should not be interpreted as causing a departure from the scope of the embodiments.

The various illustrative blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., for example, a combination of a DSP and a microprocessor, a plurality of microprocessors, one or more microprocessors in conjunction with a DSP core, or any other such configuration.

The steps of a method or algorithm and functions described in connection with the embodiments disclosed herein may be embodied directly in hardware, in a software module executed by a processor, or in a combination of the two. If implemented in software, the functions may be stored on or transmitted over as one or more instructions or code on a tangible, non-transitory computer-readable medium. A software module may reside in Random Access Memory (RAM), flash memory, Read Only Memory (ROM), Electrically Programmable ROM (EPROM), Electrically Erasable Programmable ROM (EEPROM), registers, a hard disk, a removable disk, a CD ROM, or any other form of storage medium known in the art. A storage medium is coupled to the processor such that the processor can read information from, and write information to, the storage medium. In the alternative, the storage medium may be integral to the processor. Disk and disc, as used herein, includes compact disc (CD), laser disc, optical disc, digital versatile disc (DVD), floppy disk and Blu-Ray disc where disks usually reproduce data magnetically, while discs reproduce data optically with lasers. Combinations of the above should also be included within the scope of computer readable media. The processor and the storage medium may reside in an ASIC. The ASIC may reside in a user terminal. In the alternative, the processor and the storage medium may reside as discrete components in a user terminal.

For purposes of summarizing the disclosure, certain aspects, advantages and novel features of certain embodiments have been described herein. It is to be understood that not necessarily all such advantages may be achieved in accordance with any particular embodiment. Thus, the embodiments may be embodied or carried out in a manner that achieves or optimizes one advantage or group of advantages as taught herein without necessarily achieving other advantages as may be taught or suggested herein.

Various modifications of the above described embodiments will be readily apparent, and the generic principles defined herein may be applied to other embodiments without departing from the spirit or scope of the application. Thus, the present application is not intended to be limited to the embodiments shown herein but is to be accorded the widest scope consistent with the principles and novel features disclosed herein.

What is claimed is:

1. An electrical outlet for providing high voltage power to a device, comprising:

power input terminals for connection to a high voltage power source;

at least one power output socket configured to receive a plug configured to receive high voltage power;

a shock-proof circuit connected to the at least one power output socket, the shock-proof circuit comprising a capacitance sensor configured to sense a presence of a person within a proximity distance threshold of the electrical outlet;

at least one optical sensor configured to detect the insertion of plug prongs into a neutral line socket and a hot line socket of the at least one power output socket;

a communication circuit configured to communicate over a communication network; and a processor coupled to the communication circuit, the capacitance sensor, the at least one optical sensor and the shock-proof circuit, the processor and the shock-proof circuit collectively configured to determine when to provide high voltage power to the at least one power output socket based on information received from the capacitance sensor, the shock-proof circuit, and the optical sensor, and wherein the processor is configured to control the shock-proof circuit to not provide high voltage power to the at least one power output socket when proximity information the processor receives from the capacitance sensor indicates a person is within a proximity distance threshold of the at least one power output socket unless the processor detects a plug is already in the at least one power output socket and power is being supplied to the plug in which case the high voltage power is allowed to be provided to the at least one power output socket, wherein the processor and the communication circuit are further collectively configured to communicate information relating to an operation aspect of the electrical outlet with a remote computing device via the communication network.

2. The electrical outlet of claim 1, further comprising at least one other sensor in communication with the processor, wherein the processor is further configured to receive information from the at least one other sensor, and wherein the communication circuit is further configured to receive sensor information from the processor and sends the sensor information to a remote computing device.

3. The electrical outlet of claim 1, wherein the proximity distance threshold includes the distance of when a person is within one inch of the electrical outlet.

4. The electrical outlet of claim 1, wherein the capacitance sensor comprises at least one antenna disposed around a portion of the electrical outlet, the at least one antenna configured to transmit a field and receive information that results from a disturbance in the field.

5. The electrical outlet of claim 1, wherein the shock-proof circuit further comprises a current sensor coupled to a power output terminal of the at least one power output socket, the at least one current sensor configured to detect a low voltage power through the power output terminal, wherein the shock-proof circuit and the processor are collectively configured to provide high voltage power to the at least one power output socket when the current sensor current indicates that a load of an electrical device is coupled to the at least one power output terminal.

6. The electrical outlet of claim 1, wherein the at least one power output socket includes a first power output socket and a second power output socket, and the electrical outlet further comprises a first optical sensor and a second optical sensor, the first optical sensor configured to detect the insertion of plug prongs into a neutral line socket and a hot line socket of the first power output socket, and the second optical sensor configured to detect the insertion of plug prongs into a neutral line socket and a hot line socket of the second power output socket.

7. The electrical outlet of claim 1, further comprising a housing around at least a portion of the at least one power output socket, the shock-proof circuit, the communication circuit and the processor.

8. The electrical socket of claim 7, wherein the housing is configured to fit into a wall such that a portion of the housing is disposed inside the wall and a portion of the housing extends outside of the wall, and the housing is further configured to have a flat surface disposed towards the portion of the housing that is configured to be disposed inside the wall such that the flat surface substantially contacts a planar surface of the wall when the housing is disposed inside the wall.

9. The electrical outlet of claim 7, further comprising at least one sensor in communication with the processor, wherein the processor is further configured to receive information from the at least one sensors, and the communication circuit is further configured to receive sensor information from the processor and send the sensor information to a remote computing device, and wherein the at least one capacitance sensor is positioned at least partially outside of the housing.

10. The electrical outlet of claim 1, wherein the at least one capacitance sensor or at least one current sensor is in wireless communication with the communication circuit.

11. The electrical outlet of claim 1, wherein the communication circuit is configured to wirelessly connect to a communication network and send information from the sensors to a computing device via the communication network.

12. The electrical outlet of claim 1, wherein the communication circuit and the processor are collectively configured to communicate, via the communication network, with another electrical outlet coupled to the communication network.

13. The electrical outlet of claim 1, wherein the processor is configured to control the shock-proof circuit to provide high voltage power to the at least one power output socket when a current sensor indicates that the load connected to the at least one power output socket is an electronic device.

14. The electrical outlet of claim 13, wherein the processor is further configured to control the shock-proof circuit to not provide high voltage power to the at least one power output socket when the capacitance sensor indicates the presence of the person within the threshold distance and the current sensor does not indicate that an electronic device is already connected to the at least one power output socket.

15. The electrical outlet of claim 1, wherein the capacitance sensor is further configured to sense a presence of an object.

16. A method for operating an electrical outlet comprising one or more power output sockets, comprising:

sensing that a person is within a threshold distance to the electrical outlet using a capacitance sensor;

optically sensing that plug prongs are inserted into a power output socket of the electrical outlet;

sensing a load condition at the power output socket using a current sensor, the load condition indicative of an electrical device connected to the power output socket and receiving power; and stopping providing high voltage power to the power output socket while the person is within the threshold distance to the electrical outlet unless a plug is detected as inserted in the power output socket and power is being supplied to the plug in which case the high voltage power is allowed to be provided to the power output socket.

17. The method of claim 13, further comprising:

providing high voltage power to the power output socket when the person is no longer within the threshold distance to the electrical outlet.

18. The method of claim 17, wherein the electrical outlet comprises a capacitance sensor configured to sense the proximity of a person to the electrical outlet.

19. The method of claim 18, wherein the capacitance sensor comprises at least one antenna disposed around at least a portion of the electrical outlet.

20. An apparatus for providing high voltage power to a device, comprising:

power input terminals for connection to a high voltage power source;

an electrical outlet comprising at least one power output socket configured to receive a plug configured to receive high voltage power;

a shock-proof circuit connected to the at least one power output socket, the shock-proof circuit comprising a capacitance sensor including an antenna disposed around a portion of the apparatus and a current sensor configured to detect a low voltage power through the power output terminal; and a processor coupled to the shock-proof circuit, the processor configured to sense that a person is within a threshold distance to the electrical outlet using the capacitance sensor, sense that a device is not plugged into the at least one power output socket using the current sensor, and stop providing high voltage power to the at least one power output socket while the person is within the threshold distance to the electrical outlet unless the processor detects a plug is inserted in the at least one output socket and power is being supplied to the plug in which case the high voltage power is allowed to be provided to the at least one output socket.

* * * * *